US008845413B2

(12) United States Patent
Hirato et al.

(10) Patent No.: US 8,845,413 B2
(45) Date of Patent: Sep. 30, 2014

(54) GAMING MACHINE CAPABLE OF MOVING AT LEAST ONE VISUAL RECOGNITION TARGET IN A TOP BOX

(75) Inventors: Jun Hirato, Koto-ku (JP); Takeshi Iso, Koto-ku (JP); Megumi Shimohata, Koto-ku (JP); Kou Kobayashi, Koto-ku (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 345 days.

(21) Appl. No.: 12/913,465

(22) Filed: Oct. 27, 2010

(65) Prior Publication Data

US 2011/0117998 A1 May 19, 2011

(30) Foreign Application Priority Data

Nov. 13, 2009 (JP) ..... 2009-260356

(51) Int. Cl.
*A63F 9/00* (2006.01)
*G07F 17/32* (2006.01)
*G07F 17/34* (2006.01)

(52) U.S. Cl.
CPC ..... *G07F 17/3211* (2013.01); *G07F 17/3244* (2013.01); *G07F 17/3267* (2013.01); *G07F 17/34* (2013.01); *G07F 17/3262* (2013.01)
USPC ..... 463/20

(58) Field of Classification Search
None
See application file for complete search history.

(56) References Cited

U.S. PATENT DOCUMENTS

| | | | | |
|---|---|---|---|---|
| 6,537,152 | B2 * | 3/2003 | Seelig et al. | 463/30 |
| 6,609,972 | B2 * | 8/2003 | Seelig et al. | 463/16 |
| 6,905,407 | B2 * | 6/2005 | Nordman | 463/20 |
| 7,241,220 | B2 * | 7/2007 | Rothkranz et al. | 463/20 |
| 7,258,609 | B2 * | 8/2007 | Nordman et al. | 463/20 |
| 7,331,858 | B2 * | 2/2008 | McComb et al. | 463/16 |
| 7,338,366 | B2 * | 3/2008 | Rosander et al. | 463/16 |
| 7,438,641 | B2 * | 10/2008 | Hedrick | 463/30 |
| 7,485,038 | B2 * | 2/2009 | Rothkranz et al. | 463/20 |

(Continued)

FOREIGN PATENT DOCUMENTS

JP 2009-165804 7/2009

*Primary Examiner* — Seng H Lim
(74) *Attorney, Agent, or Firm* — Lexyoume IP Meister, PLLC

(57) ABSTRACT

A gaming machine includes a symbol display device, a top box, and a controller. The symbol display device is capable of variably displaying and then rearranging a plurality of symbols. The top box is disposed at an upper part of the symbol display device and has an illumination target disposed on a front face and a plurality of visual recognition targets disposed therein. The controller is programmed to: variably display and then rearrange symbols on the symbol display device to thereby execute a normal game; execute an animation character acquisition game for acquiring a specific animation character from among a plurality of animation characters in accordance with specific symbols being rearranged in the normal game; and move at least one visual recognition target from among the plurality of visual recognition targets, based on a result of the animation character acquisition game. This configuration enables a player to be given notice in a mode of moving a visual recognition target in the top box. Thus, it is possible to impart a sense of expectation or a sense of tension to a player and to pay the player's attention exclusively to a game.

8 Claims, 47 Drawing Sheets

(56) References Cited

U.S. PATENT DOCUMENTS

| | | | | |
|---|---|---|---|---|
| 7,566,269 | B2 * | 7/2009 | B-Jensen et al. | 463/20 |
| 7,572,181 | B2 * | 8/2009 | Seelig et al. | 463/16 |
| 7,614,951 | B2 * | 11/2009 | Flemming et al. | 463/20 |
| 7,614,952 | B2 * | 11/2009 | Elias | 463/20 |
| 7,708,640 | B2 * | 5/2010 | Burak et al. | 463/30 |
| 7,731,580 | B2 * | 6/2010 | Rothkranz | 463/16 |
| 7,736,228 | B2 * | 6/2010 | Seelig et al. | 463/31 |
| 7,862,422 | B2 * | 1/2011 | Garamendi et al. | 463/20 |
| 8,021,223 | B2 * | 9/2011 | Rose | 463/16 |
| 8,087,991 | B2 * | 1/2012 | D'Avanzo | 463/20 |
| 2003/0064806 | A1 * | 4/2003 | Gordon et al. | 463/42 |
| 2003/0176214 | A1 * | 9/2003 | Burak et al. | 463/20 |
| 2004/0053687 | A1 * | 3/2004 | Nordman et al. | 463/30 |
| 2004/0121840 | A1 * | 6/2004 | Rosander et al. | 463/31 |
| 2004/0137979 | A1 * | 7/2004 | Rose | 463/16 |
| 2005/0020348 | A1 * | 1/2005 | Thomas et al. | 463/20 |
| 2005/0037835 | A1 * | 2/2005 | Nordman | 463/20 |
| 2005/0049028 | A1 * | 3/2005 | Gornez et al. | 463/20 |
| 2005/0054422 | A1 * | 3/2005 | Rothkranz et al. | 463/20 |
| 2005/0054424 | A1 * | 3/2005 | Rothkranz et al. | 463/20 |
| 2005/0054428 | A1 * | 3/2005 | Nordman et al. | 463/25 |
| 2005/0101371 | A1 * | 5/2005 | Seelig et al. | 463/20 |
| 2006/0019733 | A1 * | 1/2006 | D'Avanzo | 463/16 |
| 2006/0030406 | A1 * | 2/2006 | Seeling et al. | 463/31 |
| 2006/0073875 | A1 * | 4/2006 | Hedrick | 463/20 |
| 2008/0146331 | A1 * | 6/2008 | Nordman et al. | 463/31 |
| 2009/0111567 | A1 * | 4/2009 | Park | 463/20 |
| 2009/0239630 | A1 * | 9/2009 | Yoshizawa | 463/20 |
| 2010/0144420 | A1 * | 6/2010 | Fiore | 463/20 |
| 2011/0059788 | A1 * | 3/2011 | Itagaki et al. | 463/20 |

* cited by examiner

FIG. 7

| | 1ST COLUMN | 2ND COLUMN | 3RD COLUMN | 4TH COLUMN | 5TH COLUMN |
|---|---|---|---|---|---|
| CODE NO. | SYMBOLS | SYMBOLS | SYMBOLS | SYMBOLS | SYMBOLS |
| 00 | FREE GAME | STRAW | GRANDMOTHER | TURNIP | BRICKS |
| 01 | GRANDMOTHER | APPLE | BRICKS | APPLE | CHIMNEY |
| 02 | BONUS | GRANDMOTHER | TURNIP | BARREL | TURNIP |
| 03 | SOUP | WOODEN PLATE | WOODEN PLATE | CHIMNEY | BRICKS |
| 04 | SOUP | STRAW | APPLE | GRANDMOTHER | TURNIP |
| 05 | BRICKS | CHIMNEY | BONUS | TURNIP | GRANDMOTHER |
| 06 | CHIMNEY | STRAW | TURNIP | APPLE | BRICKS |
| 07 | APPLE | APPLE | BARREL | CHIMNEY | APPLE |
| 08 | BARREL | BRICKS | BRICKS | TURNIP | SOUP |
| 09 | WOODEN PLATE | BARREL | BARREL | STRAW | GRANDMOTHER |
| 10 | STRAW | CHIMNEY | WOODEN PLATE | WOODEN PLATE | BARREL |
| 11 | SOUP | BRICKS | SOUP | BARREL | BARREL |
| 12 | WOODEN PLATE | STRAW | APPLE | BRICKS | STRAW |
| 13 | TURNIP | SOUP | FREE GAME | WOODEN PLATE | BONUS |
| 14 | CHIMNEY | BRICKS | TURNIP | SOUP | WOODEN PLATE |
| 15 | BRICKS | BARREL | STRAW | WOODEN PLATE | PLUM |
| 16 | STRAW | SOUP | APPLE | STRAW | WILD |
| 17 | GRANDMOTHER | GRANDMOTHER | TURNIP | WILD | STRAW |
| 18 | WILD | TURNIP | WILD | BRICKS | BRICKS |
| 19 | SOUP | STRAW | CHIMNEY | SOUP | SOUP |
| 20 | BRICKS | TURNIP | APPLE | WOODEN PLATE | GRANDMOTHER |
| 21 | APPLE | WILD | SOUP | SOUP | FREE GAME |

GAMING MACHINE CAPABLE OF MOVING AT LEAST ONE VISUAL RECOGNITION TARGET IN A TOP BOX

CROSS-REFERENCE TO RELATED APPLICATIONS

This application is based on and claims a priority from the prior Japanese patent Application No. 2009-260356 filed on Nov. 13, 2009, the entire contents of which are incorporated herein by reference.

BACKGROUND OF THE INVENTION

1. Field of the Invention

The present invention relates to a gaming machine provided with a top box having a light source such as an LED.

2. Description of the Related Art

Conventionally, display panels for conducting games are provided at gaming machines. The display panels that conduct games are for displaying images such as video reels so that players conduct games. Further, there is a gaming machine at which a display panel is provided on a top box as well as the display panel for conducting a game. The display panel provided on the top box has been the one for displaying an effect image or an image indicating an introduction of the contents of games or an explanation of game rules, for example. This display panel has also been the one for providing a player with information for mainly assisting the play of a game (see Japanese Patent Application Laid-open No. 2009-165804).

As described above, the display panel provided on the top box has been the one for providing a player with information for mainly assisting the play of a game. The display panel having printed thereon an animation character appearing at that gaming machine, types of symbols employed in the gaming machine, or game rules and the like is disposed on a front face of the top box. The display panel has been lit up by a lamp provided inside of the top box. Therefore, in the top box of the conventional gaming machine, there has been merely provided a predetermined mode which never temporally varies irrespective of the progress of a game.

The present invention has been made in view of the above-described circumstance. It is an object of the present invention to provide a gaming machine which is capable of providing a changeful effect in the top box provided at the gaming machine to be able to impart a sense of expectation or a sense of tension to a player.

SUMMARY OF THE INVENTION

One aspect of the present invention is directed to a gaming machine, comprising:

a symbol display device which is capable of variably displaying and then rearranging a plurality of symbols;

a top box disposed at an upper part of the symbol display device and having an illumination target disposed on a front face and a plurality of visual recognition targets disposed therein; and a controller being programmed to execute processing of:

(A) variably displaying and then rearranging the symbols on the symbol display device to thereby execute a normal game;

(B) executing an animation character acquisition game for acquiring a specific animation character from among a plurality of animation characters in accordance with specific symbols being rearranged in the normal game; and (C) moving at least one visual recognition target from among the plurality of visual recognition targets, based on a result of the animation character acquisition game.

This configuration enables a player to be given notice in according with a mode of moving a visual recognition target in a top box, based on a result of a character acquisition game. Thus, it is possible to impart a sense of expectation or a sense of tension to a player and to pay the player's attention exclusively to a game. In the top box disposed at an upper part of a gaming machine, a visual recognition target can be moved. A mode of the movement of the visual recognition target can be thus visually recognized even at a position distant from the gaming machine, making it possible to attract other persons around the gaming machine as well as a player while enhancing their interest for the gaming machine.

Another aspect of the present invention is directed to the gaming machine, wherein: the plurality of visual recognition targets include an animation character visual recognition target formed so as to indicate the animation character;

the top box has a drive device for moving the animation character visual recognition target; and the processing of (C) includes processing of (D) sending to the drive device a control signal which is based on the result of the animation character acquisition game and then executing a predetermined action to the animation character visual recognition target.

This configuration causes an "animation character visual recognition target" to be moved so that an effect due to an animation character appearing in an animation character acquisition game can be provided in a top box as well. An effect in the top box as well as in the animation character acquisition game attracts a player, thereby making it possible to enhance a sense of expectation. In the top box disposed at the upper part of a gaming machine, a conspicuous effect of movement of the "animation character visual recognition target" is provided, making it possible to attract interest of the persons around the gaming machine as well.

A further aspect of the present invention is directed to the gaming machine, wherein: the plurality of visual recognition targets include an object visual recognition target formed so as to indicate an object which is different from the animation character; and the processing of (C) includes processing of (E) executing the processing of (D) and then displaying the object visual recognition target in a visually recognizable mode.

This configuration causes an object visual recognition target to be changed from a visually unrecognizable state to a visually recognizable state. A changeful effect is thus provided in the top box, making it possible to further impart a sense of expectation or a sense of tension to a player and to attract the player more significantly.

A gaming machine can be provided allowing a changeful effect to be provided in a top box, thus imparting a sense of expectation or a sense of tension to a player.

BRIEF DESCRIPTION OF THE DRAWINGS

FIG. 7 is a view showing a symbol table for normal game, according to the first embodiment;

DESCRIPTION OF THE PREFERRED EMBODIMENTS

Hereinafter, embodiments (first to third embodiments) of the present invention will be described with reference to the drawings.

The first embodiment describes a first aspect to a seventh aspect. The second embodiment describes an eighth aspect and a ninth aspect. The third embodiment describes a tenth aspect.

A gaming machine according to the first embodiment is directed to a gaming machine 10, and a top box 12*a* is provided at the gaming machine according to the first embodiment. At the gaming machine 10 according to the first embodiment, pictures or members indicating animation characters and tools or the like associated with "Snow White" are employed in the top box 12*a*. A gaming machine according to the second embodiment is directed to a gaming machine 10'. A top box 12*b* is provided at the gaming machine 10' according to the second embodiment. Pictures or members indicating animation characters and tools or the like associated with "Three Piglets" are employed in the top box 12*b*. A gaming machine according to the third embodiment is directed to a gaming machine 10". A top box 12*c* is provided at the gaming machine 10" according to the third embodiment. Pictures or members indicating animation characters and tools or the like associated with "Beauty and the Beast" are employed in the top box 12*c*.

EMBODIMENTS OF THE PRESENT INVENTION

Figure 1:
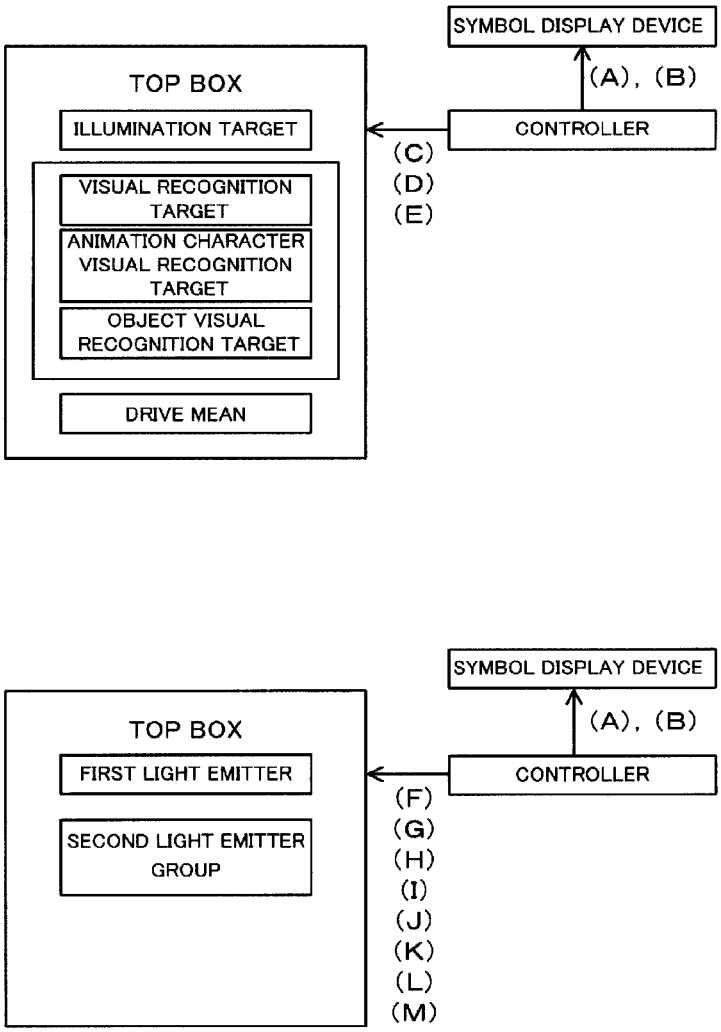
FIG. 1 is a view showing an outline of a configuration of a gaming machine according to an embodiment of the present invention.

FIG. 1 is a view showing an outline of a configuration of gaming machines 10, 10', and 10" according to the embodiments of the present invention.

A first aspect according to the embodiment of the present invention is directed to a gaming machine, comprising:

a symbol display device which is capable of variably displaying and then rearranging a plurality of symbols;

a top box disposed at an upper part of the symbol display device and having an illumination target disposed on a front face and a plurality of visual recognition targets disposed therein; and a controller being programmed to execute processing of:

(A) variably displaying and then rearranging the symbols on the symbol display device to thereby execute a normal game;

(B) executing an animation character acquisition game for acquiring a specific animation character from among a plurality of animation characters in accordance with specific symbols being rearranged in the normal game; and (C) moving at least one visual recognition target from among the plurality of visual recognition targets, based on a result of the animation character acquisition game.

A gaming machine has a symbol display device, a top box, and a controller.

The symbol display device may be the one which is capable of variably displaying and then rearranging a plurality of symbols. Specifically, a plurality of symbols are variably displayed on the symbol display device and then the plurality of these symbols are stop-displayed. The plurality of symbols are stop-displayed, whereby the plurality of symbols are rearranged. A payment of gaming media is predetermined in association with a predetermined symbol combination comprised of the rearranged plurality of symbols. Therefore, when the stop-displayed symbols or a combination of the symbols correspond(s) to the predetermined payment, gaming media of which amount corresponds to the predetermined payment is paid out or credit is awarded.

The top box is disposed at an upper part of the symbol display device. Further, an illumination target is disposed on a front face of the top box. A plurality of visual recognition targets are disposed inside of the top box. The illumination target is lit up by means of a light source or a light emitter which emits light. There are multiple visual recognition targets and these targets are members or objects configured so as to be visually recognizable by a player.

The controller executes processing of (A) to (C) below.

The processing of (A) is processing of executing a normal game. The normal game is a game played by variably displaying and then rearranging symbols on the symbol display device.

The processing of (B) is processing of executing an animation character acquisition game. The animation character acquisition game is executed in the wake of the fact that specific symbols are rearranged in a normal game. In the animation character acquisition game, an image indicating a plurality of animation characters is displayed on a display device such as a symbol display device; and a desired animation character is selected from among a plurality of animation characters by a player's operation. It is then determined whether or not the animation character selected by the player is a predetermined specific animation character. When the selected animation character is the specific animation character, it is treated as a game in which the specific animation character could be acquired. The number or types of specific animation characters are not limitative in particular.

The processing of (C) is processing of moving a visual recognition target disposed inside of a top box. The visual recognition target is moved based on a result of an animation character acquisition game. Therefore, the visual recognition target may or may not be moved according to the result of the animation character game. There are a plurality of visual recognition targets disposed inside of the top box, at least one of which may be moved.

This configuration enables a player to be given notice in accordance with a mode of moving a visual recognition target in the top box, based upon a result of an animation character acquisition game. Thus, it is possible to impart a sense of expectation or a sense of tension to the player and then attract the player to a game by utilizing the top box. In addition, a visual recognition target is moved in the top box disposed at the upper part of a gaming machine, so that: a mode of the movement of the visual recognition target can be visually recognized even at a position distant from the gaming machine; and not only a player but other persons around the gaming machine can enhance and attract their interest to the gaming machine.

A second aspect according to the embodiment of the present invention is directed to the gaming machine, wherein:

the plurality of visual recognition targets include an animation character visual recognition target formed so as to indicate the animation character;

the top box has a drive device for moving the animation character visual recognition target; and the processing of (C) includes processing of (D) sending to the drive device a control signal which is based on the result of the animation character acquisition game and then executing a predetermined action to the animation character visual recognition target.

The plurality of visual recognition targets include an animation character visual recognition target. The animation character visual recognition target is a member or an object formed so that a player can visually recognize indicating animation characters appearing in an animation character acquisition game.

A top box has a drive device. The drive device is for moving an animation character visual recognition target.

The above-described processing of (C) includes processing of (D). The processing of (D) is the processing of:

first issue a control signal which is based on a result of an animation character game from a controller to a drive device; and then, causing the drive device receiving the control signal to take a predetermined action for the animation character visual recognition target in response to the control signal.

For example, the "animation character visual recognition targets" include "Snow White" and "Prince" or "Piglets" and the like. The "predetermined operation" includes an operation of a mode of causing "Snow White" and "Prince" to move so as to approach each other and kiss, for example.

With this configuration, since the "animation character visual recognition target" is moved, an effect caused by an animation character appearing in an animation character acquisition game is provided in a top box also, making it possible to attract a player and enhance a sense of expectation by the effect in the top box as well as the animation character acquisition game. In the top box disposed at the upper part of the gaming machine, a conspicuous effect of movement of the "animation character visual recognition target" is provided, thus making it possible to attract interest of the persons around the gaming machines as well.

A third aspect according to the embodiment of the present invention is directed to the gaming machine, wherein:

the plurality of visual recognition targets include an object visual recognition target formed so as to indicate an object which is different from the animation character; and the processing of (C) includes processing of (E), subsequent to executing the processing of (D), displaying the object visual recognition target in a visually recognizable mode.

A plurality of visual recognition targets includes an object visual recognition target. The object visual recognition target is a member or an object formed so that a player can visually recognize indicating an object which is different from the animation character. It is preferable that the object which is different from the animation character is the one that a player can visually recognize simultaneously to movement of the animation character, such as an object around or near the animation character visual recognition target; an object adorning the animation character visual recognition target; or the object associated with an animation character visual recognition target. By doing this, as long as a player pays attention to the animation character visual recognition target, the player can visually recognize an operation of an object which is different from the animation character, thus making it possible to reduce a burden on the player.

The "object visual recognition target" is a "heart-shaped roulette" in the case of "Snow White" or a "Window" of a house made by piglets in the case of "Three Piglets".

The above-described processing of (C) is processing of executing the processing of (D) and then executing processing of (E) displaying an object visual recognition target in a visually recognizable mode.

The processing of "displaying in a visually recognizable mode" includes i) moving an object visual recognition target from a visually unrecognizable position to a visually recognizable position so as to be thereby visually recognizable; or ii) illuminating an object visual recognition target so as to be thereby visually recognizable.

An object visual recognition target is changed from a visually unrecognizable state to a visually recognizable state, so that a changeful effect is provided in a top box to be able to further impart a sense to expectation or a sense of tension to a player and to attract the player more significantly.

A fourth aspect according to the embodiment of the present invention is directed to the gaming machine, comprising an input device which is capable of inputting an instruction related to a game by a player's operation, wherein:

the processing of (B) includes processing of (a), selecting at least one specific animation character from the plurality of animation characters by a player operating the input device; and the processing of (D) includes processing of (b), when the specific animation character is selected from among the plurality of animation characters in the processing of (a), sending to the drive device a control signal indicating that the specific animation character is selected and then causing a character visual recognition target corresponding to the specific animation character to take a predetermined action.

A gaming machine has an input device. The input device can input an instruction related to a game by a player's operation. The instruction related to a game may be an instruction for advancing a game or setting a game environment.

The processing of (B) includes processing of (a). The processing of (a) is processing of a player operating an input device to thereby select at least one animation character from among a plurality of animation characters. The processing of (a) is processing in an animation character acquisition game. As described above, the animation character game is a game in which: an image indicating a plurality of characters is displayed on a display device such as a symbol display device; at least one animation character is selected from among a plurality of animation characters by a player's operation; it is determined whether or not the animation character selected by the player is a predetermined specific animation character; and when the selected animation character is the predetermined specific animation character, the specific animation character can be acquired. The processing of (a) is processing for selecting one or more from the plurality of animation characters by the player's operation. The number of animation characters which can be selected by the player's operation may be one or multiple.

The processing of (D) includes processing of (b). The processing of (b) is processing of: when a specific animation character is selected from among a plurality of animation characters in the processing of (a), sending from a controller to a drive device a control signal indicating the specific animation character is selected; and then, executing a predetermined action to an animation character visual recognition target corresponding to the specific animation character.

This configuration can cause an animation character visual recognition target to take a predetermined action in a top box, based on a result of an animation character acquisition game, so that an effect related to the animation character acquisition game is provided in the top box to be able to attract a player and enhance a sense of expectation. This configuration can also cause an animation character visual recognition target to take a predetermined action, thereby making it possible for a player to enhance a sense of expectation that a result different from usual can be obtained.

A fifth aspect according to the present invention is directed to the gaming machine, wherein:

the processing of (D) includes processing of (c), when the specific animation character is not selected from among the plurality of animation characters in the processing of (a), sending to the drive device a control signal indicating that a winning prize is awarded in lottery processing and then executing a predetermined action to an animation character visual recognition target corresponding to the specific animation character.

The processing of (D) includes processing of (c). The processing of (c) is processing of: in a case where a winning prize is awarded as a result of lottery processing, sending from a controller to a drive device a control signal indicating that the winning prize is awarded; and then the drive device executing a predetermined action to an animation character visual recognition target corresponding to a specific animation character in response to the received control signal.

With this configuration, even when a specific animation character cannot be acquired in an animation character acquisition game, an animation character visual recognition target may be caused to take a predetermined action. Thus, it is possible to impart a sense of expectation to a player again and to impart a further sense of tension to the player so as to attract the player.

A sixth aspect according to the embodiment of the present invention is directed to the gaming machine, wherein:

the top box has a coupling device for movably coupling a plurality of animation character visual recognition target with the drive device; and the processing of (D) includes processing of (d), when the control signal is sent to the drive device, moving each of the plurality of animation character visual recognition targets via the coupling device.

A top box has a coupling device. The coupling device movably couples a plurality of animation character visual recognition targets to a drive device. Doing this causes a motion of the drive device to be transmitted to the plurality of animation character visual recognition target via the coupling device, making it possible to move the plurality of animation character visual recognition targets.

The processing of (D) includes processing of (d). The processing of (d) is processing of, when a control signal from a controller is sent to a drive device, moving each of a plurality of animation character visual recognition targets via a coupling device.

This configuration causes a plurality of animation character visual recognition targets to be movably coupled with each other by means of a coupling device. Thus, it is possible to move the plurality of animation character recognition targets all together and to efficiently and simply provide an effect in a top box.

A seventh aspect of the embodiment of the present invention is directed to the gaming machine, wherein:

the coupling device has an annular coupling element;

the plurality of animation character visual recognition targets are provided at the coupling element; and the processing of (d) includes processing of (e) simultaneously moving the plurality of animation character visual recognition targets by means of the coupling device.

The coupling device has an annular coupling element. In the coupling device, the plurality of animation character visual recognition targets are provided at the coupling element.

The processing of (d) includes processing of (e). The processing of (e) is processing of simultaneously moving a plurality of animation character visual recognition targets by means of a coupling device.

This configuration causes a plurality of animation character visual recognition targets to be movably coupled with each other by means of a coupling device. Thus, it is possible to move the plurality of animation character visual targets all together and to efficiently and simply provide an effect in a top box.

An eighth aspect of the embodiment of the present invention is directed to the gaming machine, wherein:

the plurality of visual recognition targets include an object visual recognition target formed so as to indicate an object which is different from the animation character;

the top box has a drive device for moving the object visual recognition target; and the processing of (C) includes processing of (f) sending to the drive device a control signal which is based on a result of the animation character acquisition game and then moving the object visual recognition target.

A plurality of visual recognition targets includes an object visual recognition target. The object visual recognition target is a member or an object formed so that a player can visually recognize indicating an object which is different from an animation character.

A top box includes a drive device. The drive device moves an object visual recognition target.

The processing of (C) includes processing of (f). The processing of (f) is processing of sending from a controller to a drive device a control signal which is based on a result of an animation character acquisition game and then moving an object visual recognition target.

This configuration causes an effect to be provided in a mode of moving even an object which is different from an animation character. Thus, it is possible to attract a player and impart to the player a sense of expectation that something different from usual will happen. It is preferable that the object which is different from the animation character is that which a player can visually recognize simultaneously to movement of the animation character, such as an object around or near the animation character visual recognition target; an object adorning the animation character visual recognition target; or the object associated with an animation character visual recognition target. By doing this, as long as a player pays attention exclusively to the animation character visual recognition target, the player can visually recognize an operation of an object which is different from the animation character, thus making it possible to reduce a burden on the player.

A ninth aspect according to the embodiment is directed to the gaming machine, wherein:

the processing of (d) includes processing of (g) rotating the object visual recognition target around an axis taken along a vertical direction by means of the coupling device.

With this configuration, an object visual recognition target is moved in a frontward direction or in a backward direction of a top box to be thus able to make movement in the top box conspicuous and to attract attention of a player.

A tenth aspect according to the embodiment of the present invention is directed to a gaming machine, comprising:

a symbol display device which is capable of variably displaying and then rearranging a plurality of symbols;

a top box disposed at an upper part of the symbol display device; and a controller, wherein:

the top box having:

a first light emitter emitting light of one color selected from among a plurality of colors; and a plurality of second light emitter groups, each of which is associated with each of the plurality of colors, the plurality of second light emitter groups having a predetermined payment defined for each of a plurality of light emitters configuring the second light emitter group, the controller being programmed to execute processing of:

(F) variably displaying and then rearranging the symbols on the symbol display device to thereby execute a normal game;

(G) executing an animation character acquisition game for acquiring a specific animation character from among a plurality of animation characters in response to a specific symbols being rearranged in the normal game;

(H) sequentially repeating lighting up and lighting out of each of the plurality of second light emitter groups, based on a result of the character acquisition game;

(I) lighting up the first light emitter with a color associated with the second light emitter groups lit up in the processing of (H);

(J) lighting up one second light emitter group from among the plurality of second light emitter groups and then lighting up the first light emitter with the color associated with said one second light emitter group in accordance with a result of first lottery processing which is based on the result of the animation character acquisition game;

(K) sequentially repeating lighting up and lighting out of each of a plurality of light emitters configuring said one second light emitter group;

(L) lighting up one light emitter of a plurality of light emitters configuring said one second light emitter group in accordance with a result of second lottery processing which is based on the result of the animation character acquisition game; and (M) paying out a payment corresponding to said one light emitter.

A gaming machine has a symbol display device, a top box, and a controller.

The symbol display device may be the one that is capable of variably displaying and then rearranging a plurality of symbols. Specifically, on the symbol display device, a plurality of symbols are variably displayed and the plurality of these symbols are stop-displayed. The plurality of symbols are rearranged by stop-displaying them. A payment of gaming media is predetermined in association with the predetermined rearranged symbols or a predetermined symbol combination comprised of the plurality of rearranged symbols. Therefore, when the stop-displayed symbols and a symbol combination is the predetermined one, gaming media of which amount corresponds to the predetermined payment are paid out or credit is awarded.

A top box is disposed at an upper part of the symbol display device. The top box also has a first light emitter and a plurality of second light emitter groups.

The first light emitter emits light of one color selected from among a predetermined plurality of colors. For example, if the predetermined plurality of colors are blue, pink, pale blue, green, white, and red, one of these colors is selected and then the light of that color is emitted from the first light emitter.

Each of a plurality of second light emitter groups is associated so as to emit light of one of a plurality of colors. It is preferable that each of the plurality of second light emitter groups emits light of one of the plurality of colors which are different from each other. For example, the plurality of second light emitter groups are made of: a first light emitter group; a second light emitter group; a third light emitter group; a fourth light emitter group; a fifth light emitter group; and a sixth light emitter group. If a plurality of colors are blue, pink, light blue, green, white, and red, the first light emitter group is configured to emit blue light; the second light emitter group is configured to pink light; the third light emitter group is configured to emit pale blue light; the fourth light emitter group is configured to emit green light; the fifth light emitter group is configured to emit white light; and the sixth light emitter group is configured to emit red light, respectively.

Each of the plurality of second light emitter groups is comprised of a plurality of light emitters. If the plurality of second light emitter groups are a first light emitter group, a second light emitter group, a third light emitter group, a fourth light emitter group, a fifth light emitter group, and a sixth light emitter group, each of the first to sixth light emitter groups is comprised of five light emitter groups. In the embodiment, a light emitter is not always comprised of only one lamp such as one LED (light emitting diode). Even if a light emitter is comprised of a plurality of lamps, it is sufficient if the light emitter can function as a single light source. For example, if a plurality of lamps are grouped by means of a partition such as a light shielding plate, they can function as a single light source. Thus, the plurality of lamps serve as one light emitter in the present invention.

Payments to be awarded are predetermined for each of a plurality of light emitters configuring each of the plurality of second light emitter groups described above. The payments defined herein indicate gaming media to be paid out to players or the number of credits to be awarded to players. Among the plurality of light emitters configuring each of the plurality of second light emitter groups, a payment corresponding to one light emitter that is finally lit up is awarded to a player.

A controller executes processing of (F) to (M).

The processing of (F) is processing of executing a normal game. The normal game is a game to be played by variably displaying and then rearranging symbols on a symbol display device.

The processing of (G) is processing of executing an animation character acquisition game. The animation character acquisition game is executed in the wake of the fact that specific symbols are rearranged in a normal game. In the animation character acquisition game, an image indicating a plurality of animation characters is displayed on a display device such as a symbol display device. A desired animation character is then selected from among a plurality of animation characters by a player's operation. Afterwards, it is determined whether or not the animation character selected by the player is a predetermined specific animation character. When the selected animation character is the specific animation character, it is treated as a game in which the specific animation character could be acquired. The number or types of specific animation characters are not limitative in particular.

The processing of (H) is processing of sequentially repeating lighting up and lighting out of each of a plurality of second light emitter groups, based on a result of an animation character acquisition game. For example, if the plurality of second light emitter groups are made of a first light emitter group, a second light emitter group, a third light emitter group, a fourth light emitter group, a fifth light emitter group, and a sixth light emitter group, action of repeating lighting up and lighting out of the first, second, third, fourth, fifth, and sixth light emitter groups is repeated.

The processing of (I) is processing of lighting up the first light emitter with a color associated with a second light emitter group lit in the processing of (H). For example, let us assume that a plurality of second light emitter groups are made of a first light emitter group, a second light emitter group, a third light emitter group, a fourth light emitter group, a fifth light emitter group, a fifth light emitter group, and a sixth light emitter. Also, let us assume that the first light emitter group is configured to emit blue light; the second light emitter group is configured to emit pink light; the third light emitter group is configured to emit pale blue light; the fourth light emitter group is configured to emit green light; the fifth light emitter group is configured to emit white light; and the sixth light emitter group is configured to emit red light. In this case, when the first light emitter group is lit up, blue light is emitted from a first light emitter; when the second light emitter group is lit up, pink light is emitted from a first light emitter; when the third light emitter group is lit up, pale blue light is emitted from a first light emitter; when the fourth light emitter group is lit up, green light is emitted from a first light emitter; when the fifth light emitter group is lit up, white light is emitted from a first light emitter; and when the sixth light emitter group is lit up, red light is emitted from a first light emitter.

The processing of (J) is processing of lighting up one of the plurality of second light emitter groups and then lighting up a first light emitter with a color associated with such one of the second light emitter groups in accordance with a result of first lottery processing which is based on a result of an animation character acquisition game. For example, when a third light emitter group of the plurality of second light emitter groups is selected, the third light emitter group is lit to emit pale blue light and to emit pale blue light from a first light emitter as well.

The processing of (K) is processing of sequentially repeating lighting up and lighting out of each of a plurality of light emitters configuring one of the second light emitter groups. As described above, each of the plurality of second light emitters is comprised of a plurality of light emitters. Lighting up and lighting out of each of a plurality of light emitters which configure one of the second light emitter groups is sequentially repeated. If a plurality of light emitters which configure one of the second light emitter groups are made of first, second, third, fourth, fifth, and sixth light emitters, for example, action of lighting up and lighting out the first, second, third, fourth, fifth, and sixth light emitters is repeated.

The processing of (L) is processing of lighting up one of a plurality of light emitters configuring such one of the second light emitting groups in accordance with a result of second lottery processing which is based on a result of the animation character acquisition game. For example, if a fourth light emitter is selected from among a plurality of light emitters configuring one of the second light emitter groups, the fourth light emitter is lit up.

The processing of (M) is processing of paying out a payment corresponding to such one light emitter. A payment corresponding to one light emitter finally selected is paid out.

An effect of gradually narrowing a range of a target payment can be provided by sequentially repeating lighting up and lighting out of each of a plurality of second light emitter groups and then sequentially repeating lighting up and lighting out of each of a plurality of light emitters configuring one of the second light emitter groups. A sense of expectation or a sense of tension of a player is gradually enhanced, thereby making it possible to attract the player more significantly.

Functional Flow of Gaming Machine

First Embodiment

Figure 2A:
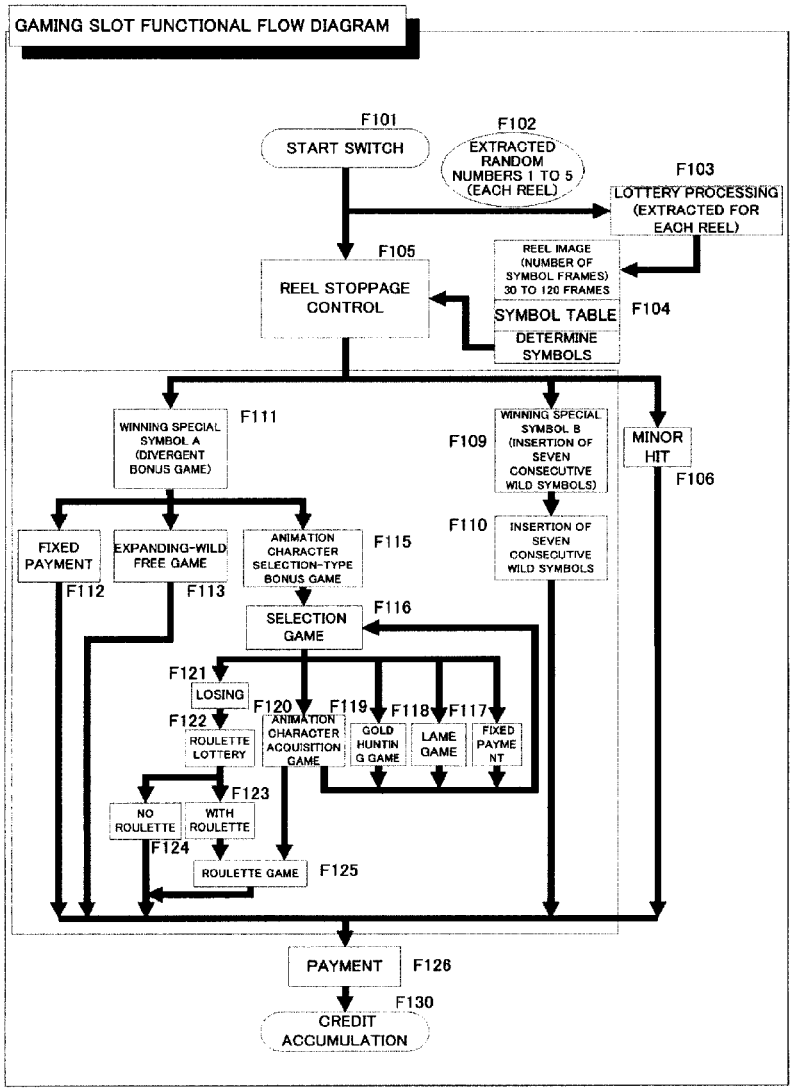
FIG. 2A is a view showing a functional flow of a gaming machine according to a first embodiment of the present invention.

FIG. 2A is a view showing a functional flow of a gaming machine 10 according to a first embodiment of the present invention.

(Start Switch)

First, a gaming machine executes start switch processing (F101). In F101, the gaming machine checks whether or not a player presses a BET button and subsequently checks whether or not a player presses a start, button 46.

(Symbol Determination)

When a player presses the start button 46, the gaming machine then extracts random number values for symbol determination (F102, F103). The gaming machine refers to a symbol table to determine symbols to be displayed for a player when scrolls of symbol arrays are stopped according to a respective one of a plurality of video reels displayed on a display device while spinning video reel images are displayed on the display device (F104).

(Symbol Stoppage Control)

Next, the gaming machine executes reel stoppage control to stop scrolls of video reels so that the symbols determined in processing of F104 are displayed for the player (F105).

(Determination of Winning Prize)

The gaming machine then determines whether or not a combination of symbols displayed for the player corresponds to a winning prize after scroll of the symbol array of each video reel has been stopped.

(Payout)

When the combination of symbols displayed for the player is associated with a winning prize, the gaming machine awards a winning prize according to a type of the symbol combination to the player.

In a case where a symbol combination is established as a "minor hit" (F106) for example, a payment based on a type of the "minor hit" is determined. Where the stopped symbols include a winning prize special symbol B and a player has won seven consecutive WILD free games (F109), the player is awarded a game in which seven consecutive WILD symbols are inserted into video reels (F110). Where the stopped symbols include a winning prize special symbol A and a player has won a divergent bonus game (F111), the player is further awarded the divergent bonus game, enabling the player to select a selection button.

(Divergent Bonus Game)

Next, the gaming machine determines which of the selection buttons "fixed payment", "expanding-WILD free game", and "animation character selection-type bonus game" is selected by a player. Where "fixed payment" is selected (F112), a payment based on a type of "fixed payment" is determined. If "expanding-WILD free game" is selected (F113), the player is awarded a free game in which a WILD symbol is expanded on a video reel.

In a case where "character selection-type bonus game" is selected (F115), a plurality of options are displayed on the display device, allowing a player to select a desired one from these options (F116).

The "options" used here include "fixed payment", "race game", "gold hunting game", "animation character acquisition game", and "loss".

In a case where "fixed payment" is selected (F117), the player is awarded a payment based on a type of "fixed payment" and then the routine reverts to F116. Where "race game" is selected (F118), a game in which a plurality of animation characters take part in a race is played. The player is awarded a payment based on a result of the game and the routine reverts to F116. Where "gold hunting game" is selected (F119), a game in which an animation character hunts gold is played. The player is awarded a payment based on a result of the game and then the routine reverts to F116.

In a case where "character acquisition game" is selected (F120) an animation character acquisition game is played. If all of the animation characters could not be acquired, the routine reverts to F116. In addition, if all of the animation characters could not be acquired, a roulette game is played (F125).

In a case where "losing" is selected (F121), lottery processing is conducted as to whether or not to play a roulette game (F122). In the case of a roulette game playable, the roulette game is played (F125). In the case of no roulette game playable, "character selection-type bonus game" completes. The "roulette game" defined herein is a roulette game to be played on a top box 12*a*.

(Awarding Payment)

A payment determined in F106, F110, F112, F113, F117, F118, and F119 is awarded (F125).

In response to payout of the payment in the above-described payment (F125), credit is additively accumulated in a credit counter (F126).

Functional Flow of Gaming Machine

Second Embodiment

Figure 2B:
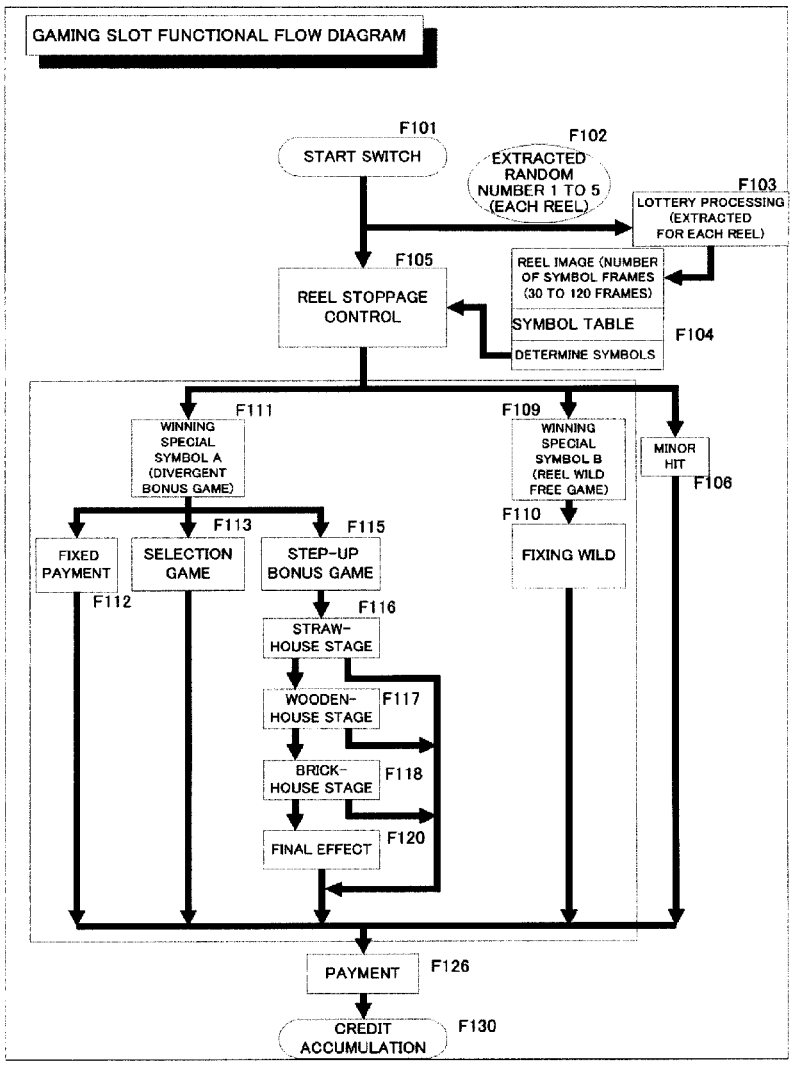
FIG. 2B is a view showing a functional flow of a gaming machine according to a second embodiment of the present invention.

FIG. 2B is a view showing a functional flow of a gaming machine 10' according to a second embodiment of the present invention.

(Start Switch)

First, a gaming machine executes start switch processing (F101). In the processing of F101, the gaming machine checks whether or not a player presses a BET button and subsequently checks whether or not a player presses a start button 46.

(Symbol Determination)

When the player press the start button 46, the gaming machine then extracts random number values for symbol determination (F102, F103). The gaming machine refers to a symbol table to determine symbols to be displayed for a player when scrolls of symbol arrays are stopped according to a respective one of a plurality of video reels displayed on a display device while spinning video reel images are displayed on the display device (F104).

(Symbol Stoppage Control)

Next, the gaming machine executes reel stoppage control to stop scrolls of video reels so that the symbols determined in the processing of F104 are displayed for a player (F105).

(Determination of Winning Prize)

The gaming machine then determines whether or not a combination of symbols displayed for the player corresponds to a winning prize when scroll of the symbol array of each video reel is stopped.

(Payout)

When the combination of symbols displayed for the player corresponds to a winning prize, the gaming machine then awards to the player a winning prize according to a type of the symbol combination.

When a symbol combination is established as a "minor hit" (F106), for example, a payment which is based on a type of such "minor hit" is determined. If the stopped symbols include a winning prize special symbol B and a player has won seven consecutive WILD free games (F109), the player is awarded a game in which seven consecutive WILD symbols are inserted into video reels (F110). If the stopped symbols include a winning prize special symbol A and a player has won a divergent bonus game (F111), the player is further awarded the divergent bonus game, allowing a player to select a selection button.

(Divergent Bonus Game)

Next, the gaming machine determines whether the player selects any of selection buttons from among "fixed payment", "optional game", and "step-up bonus game". If "fixed payment" is selected (F112), a payment based on a type of "fixed payment" is determined. If "optional game" is selected (F113), a free game in which predetermined types of animation characters are to be selected is awarded.

Where "step-up bonus game" is selected (F115) "straw house stage" is first conducted. If a predetermined condition is not met, "step-up bonus game" is completed. Where the predetermined condition is met, "wooden house stage" is conducted. If a predetermined condition is not met, "step-up bonus game" is completed. Where a predetermined condition is met, "brick house stage" is conducted. If a predetermined condition is not met, "step-up bonus game" is completed. Where a predetermined condition is met, "final effect" is conducted and then "step-up bonus game" is completed. The "final effect" is a roulette game to be conducted in a top box 12*b*.

(Awarding Payments)

Payments determined in F106, F110, F112, F113, F116, F117, F118, and F120 are awarded (F125).

In response to payout of the payment in the above-described payment (F125), credit is additively accumulated by a credit counter (F126).

Functional Flow of Gaming Machine

Third Embodiment

Figure 2C:
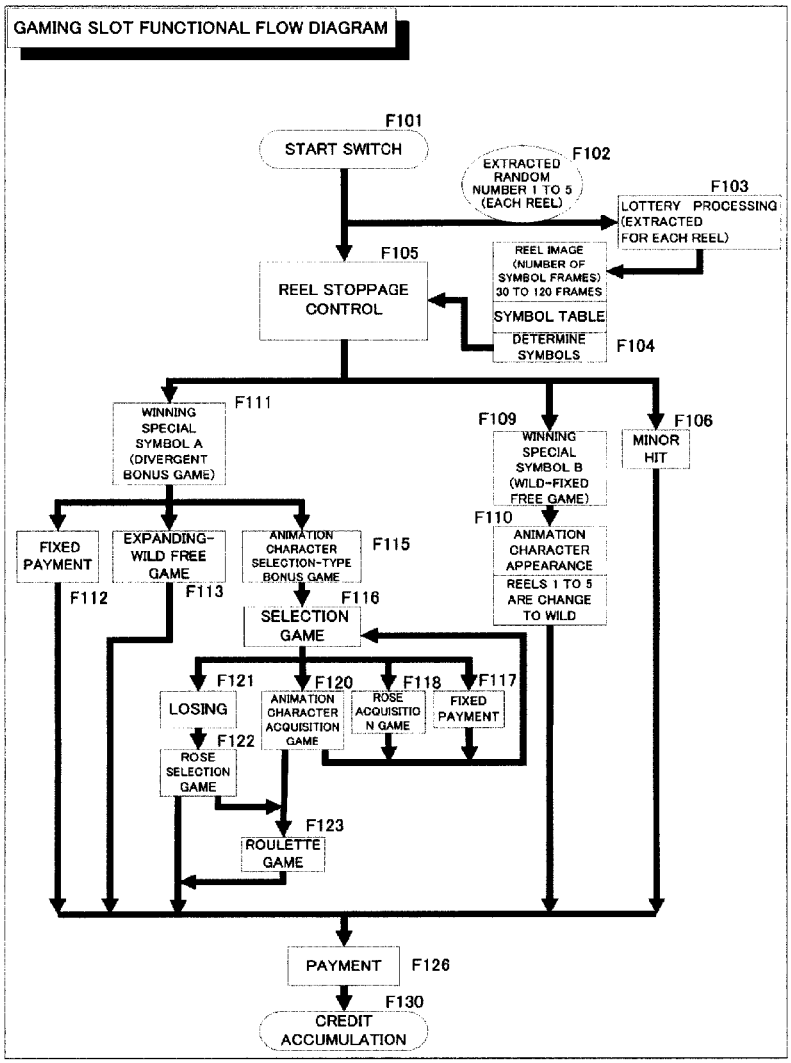
FIG. 2C is a view showing a functional flow of a gaming machine according to a third embodiment of the present invention.

FIG. 2C is a view showing a functional flow of a gaming machine 10" according to a third embodiment of the present invention.

(Start Switch)

First, a gaming machine executes start switch processing (F101). In the processing of F101, the gaming machine checks whether or not a player presses a BET button and subsequently checks whether or not a player presses a start button 46.

(Symbol Determination)

When the player press the start button 46, the gaming machine then extracts random number values for symbol determination (F102, F103). The gaming machine refers to a symbol table to determine symbols to be displayed for a player when scrolls of symbol arrays are stopped according to a respective one of a plurality of video reels displayed on a display device while spinning video reel images are displayed on the display device (F104).

(Symbol Stoppage Control)

Next, the gaming machine executes reel stoppage control to stop scrolls of video reels so that the symbols determined in the processing of F104 are displayed for a player (F105).

(Determination of Winning Prize)

The gaming machine then determines whether or not a combination of symbols displayed for the player corresponds to a winning prize when scroll of the symbol array of each video reel is stopped.

(Payout)

When the combination of symbols displayed for the player corresponds to a winning prize, the gaming machine then awards a winning prize according to a type of the symbol combination to the player.

In a case where a symbol combination is established as a "minor hit" (F106), for example, a payment based on a type of the "minor hit" is determined. Where the stopped symbols include a winning prize special symbol B and a player has won seven consecutive WILD free games (F109), the player is awarded a game in which seven consecutive WILD symbols are inserted into video reels (F110). If the stopped symbols include a winning prize special symbol A and a player has won a divergent bonus game (F111), the player is further awarded the divergent bonus game, enabling the player to select a selection button.

(Divergent Bonus Game)

Next, the gaming machine determines which of the selection buttons "fixed payment", "expanding-WILD free game", and "animation character selection-type bonus game" is selected by a player. Where "fixed payment" is selected (F112), a payment based on a type of "fixed payment" is determined. Where "expanding-WILD free game" is selected (F113), the player is awarded a free game in which a WILD symbol is expanded on a video reel.

In a case where "character selection-type bonus game" is selected (F115), a plurality of options are displayed on the display device, enabling a player to select a desired one from these options (F116).

The "options" defined herein include "fixed payment", "rose acquisition game", "animation character acquisition game", and "losing".

In a case where "fixed payment" is selected (F117), a payment based on a type of "fixed payment" is awarded and then the routine reverts to F116. Where "rose acquisition game" is selected (F118), a game for a player to select a plurality of roses is played. A payment based on a result of the game is awarded and then the routine reverts to F116.

In a case where "animation character game" is selected (F120), a game for a player to select an animation character is played. If all of the animation characters could not acquired, the routine reverts to F116. In addition, if all of the animation characters could not be acquired, a roulette game is played (F125).

If "losing" is selected (F121), lottery processing is conducted as to whether or not to play a roulette game (F122). In the case of a roulette game playable, the roulette game is played (F125). In the case of no roulette game playable, "character selection-type bonus game" completes. The "roulette game" defined herein is a roulette game played on a top box 12*c*.

(Awarding Payments)

Payments determined in F106, F110, F112, F113, F117, F118, and F120 are awarded (F125).

In response to payout of a payment from among the above-described payments (F125), credit is additively accumulated by a credit counter (F126).

First Embodiment of the Present Invention

FIG. 3 to FIG. 30 are the drawings of the first embodiment of the present invention.

[Entire Game System]

Figure 3:
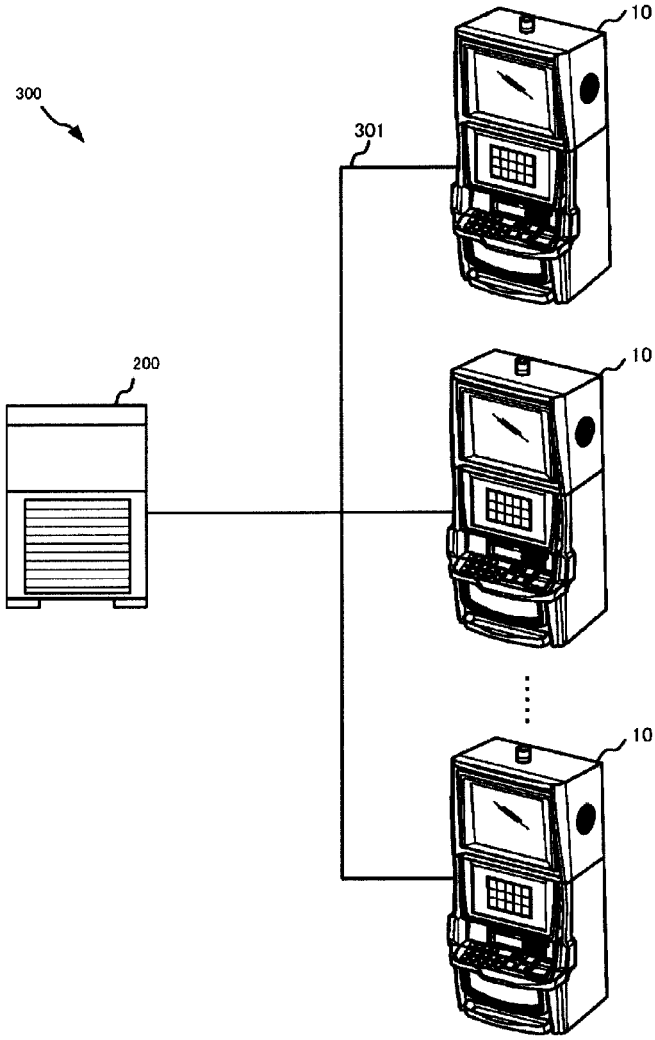
FIG. 3 is a view showing a game system 300 including gaming machines 10 according to the first embodiment of the present invention.

Next, with reference to FIG. 3, a game system 300 including gaming machines 10 will be described. FIG. 3 is a view showing the game system including the gaming machines 10 according to the first embodiment of the present invention. The game system 300 shown in FIG. 3 is similar to a gaming machine 10' according to a second embodiment of the present invention or a gaming machine 10" according to a third embodiment.

A game system 300 includes the plurality of gaming machines 10, and an external control device 200 that is connected to each of the gaming machines 10 through a communication line 301.

The external control device 200 is for controlling the plurality of gaming machines 10. In the present embodiment, the external control device 200 is a so-called hall server which is installed in a game facility having the plurality of gaming machines 1. Each of the gaming machines 10 is provided with a unique identification number, and the external control device 200 identifies transmission sources of data transmitted from the respective gaming machines 1 by using the identification numbers. Also in the case where the external control device 200 transmits data to a gaming machine 1, the identification numbers are used for specifying the transmission destination. The external control device 200 conducts progressive bonus accumulation on the basis of the number of gaming media betted in each of the gaming machines 10.

It is to be noted that the game system 300 may be constructed within a single game facility where various games can be conducted, such as a casino, or may be constructed among a plurality of game facilities. Further, when the game system 300 is constructed in a single game facility, the game system 300 may be constructed in each floor or section of the game facility. The communication line 301 may be a wired or wireless line, and can adopt a dedicated line, an exchange line or the like.

[Overall Configuration of Gaming Machine]

Figure 4:
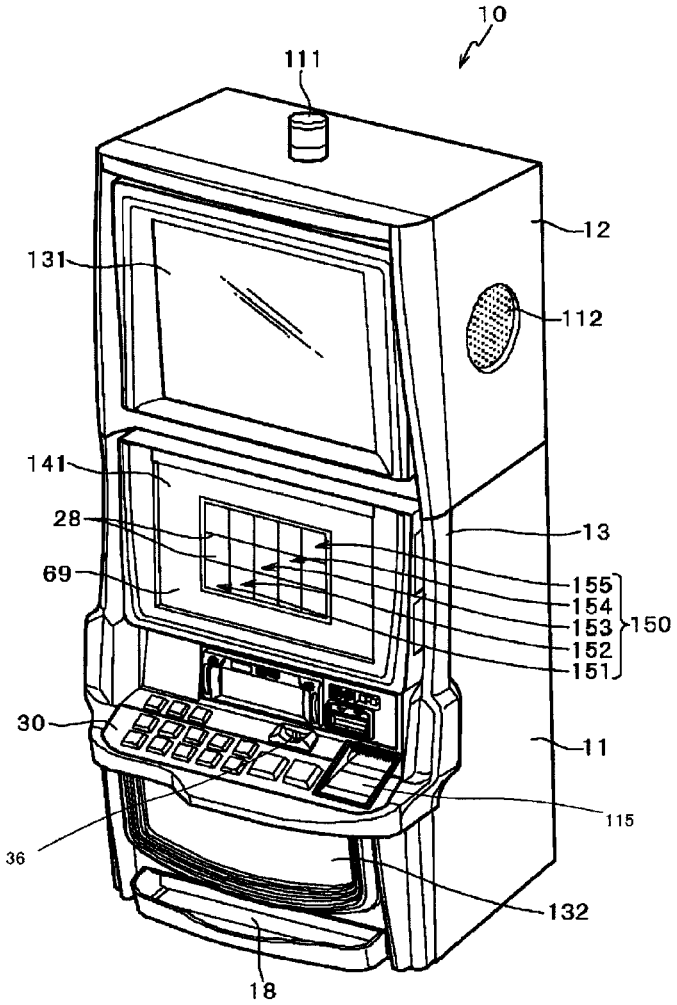
FIG. 4 is a view showing an entire configuration of the gaming machine 10 according to the first embodiment of the present invention.
Figure 5:
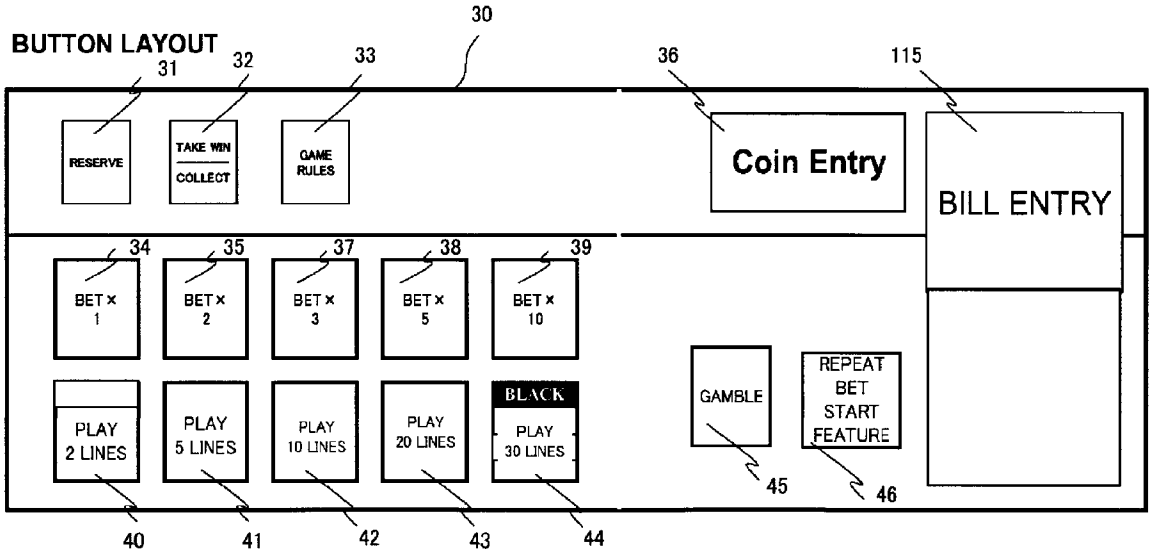
FIG. 5 is a view showing a control panel 30 of the gaming machine 10 according to the first embodiment of the present invention.

Next, with reference to FIG. 4 and FIG. 5, an overall configuration of the gaming machine 10 is described. FIG. 4 is a view illustrating the overall configuration of the gaming machine 10 according to the embodiment of the present invention. FIG. 5 is a view showing a control panel of the gaming machine 10 according to the first embodiment of the present invention. The overall configuration shown in FIG. 4 and the control panel 30 shown in FIG. 5 are similar to the gaming machine 10' according to the second embodiment of the present invention or the gaming machine 10" according to the third embodiment as well.

A coin, a bill, or electrically valuable information corresponding to these is used as a game medium in the gaming machine 10. Further, in the present embodiment, a later-described ticket with a barcode is also used. It is to be noted that the game medium is not limited to these, and for example a medal, a token, electric money or the like can be adopted.

The gaming machine 10 includes a cabinet 11, a top box 12 installed on the upper side of the cabinet 11, and a main door 13 provided at the front face of the cabinet 11.

A lower image display panel 141 is provided at the center of the main door 13. The lower image display panel 141 is formed of a transparent liquid crystal touch panel. A display window 150 is provided on a screen which the lower image display panel 141 displays. The display window 150 is comprised of 15 display blocks 28 of 5 columns and 3 lines. Three display blocks 28 of each column form video reels 151 to 155. On each of the video reels 151 to 155, the three display blocks movably displayed in a downward direction while a velocity is entirely varied, thereby making it possible to rearrange the symbols displayed in each of the display blocks 28 to be stopped after being spun in a longitudinal direction. In the present embodiment, a video reel depicts through videos the rotational and stop motions of a mechanical reel having a plurality of symbols drawn on the peripheral surface thereof.

To each of the video reels 151 to 155, a symbol array comprised of a previously determined plurality of symbols is assigned.

In the display window 150, the symbol arrays assigned to the respective video reels 151 to 155 are separately scrolled, and are stopped after predetermined time has elapsed. As a result, a part (four consecutive symbols in the present embodiment) of each of the symbol arrays is displayed for the player. In the display window 150, the symbol display region 4 has four regions, namely an upper region, an upper central region, a lower central region, and a lower region, for each of the video reels 151 to 155, and a single symbol is to be displayed to each region. That is, a total of 15 symbols (=5 columns×3 lines) are to be displayed in the display window 150.

In the present embodiment, a line formed by selecting one of the aforementioned three regions for each of the video reels 151 to 155 and connecting the respective regions is referred to as a pay line (hereinafter also referred to as a "winning line"). It is to be noted that any desired shape of the winning line can be adopted, and examples of the shape of the winning line may include a straight line formed by connecting the upper central regions for the respective video reels 151 to 155, a V-shaped line, and a bent line. While the number of pay lines is 30, it can be arbitrarily employed in the embodiment.

The lower image display panel 141 displays: a number-of credit display portion 201; a number-of BETs display portion 202; a number-of-payouts display portion 203; a help display button 204; a pay table display button 205; a denomination display portion 206; and pay line generating portions 65 or the like. A pay line generating portion 65L and a pay line generating portion 65R are formed in pair, thereby generating a pay line. symbol display device of the present invention.

The lower image display panel 141 has a built-in touch panel 114. The player can input various commands by touching the lower image display panel 141.

As shown in FIG. 4 and FIG. 5, a coin entry 36 for accepting coins in a cabinet 11 and a bill entry 115 as well as various buttons arranged in a control panel 30 are provided on the lower side of the lower image display panel 141.

A reserve button 31 is an operational button employed when a player leaves a gaming machine seat or when a player ask clerk in a gaming facility for money exchange. A collect button 32 is an operational button employed when the coins reserved inside of a gaming machine 10 is paid out to a coin tray 18. A game rule button 33 is a button depressed if a game operation method or the like is unclear. Depressing the game rule button 33 displays various items of help information on the upper image display panel 131 or the lower image display panel 141.

A 1-BET button 34 is a button in which credits currently owned by a player are betted on a one-by-one credit basis on each active pay line every time the button is depressed. A 2-BET button 35 is a button for starting a game by 2 bets on each active pay line. A 3-BET button 37 is a button for starting a game by 3 bets on each active pay line. A 5-BET button 38 is a button for starting a game by 5 bets on each active pay line. A 10-BET button 39 is a button for starting a game by 10 bets on each active pay line. Therefore, pressing any one of the 1-BET button 34, the 2-BET button 35, the 3-BET button 37, the 5-BET button 38, and the 10-BET button 39 determines the number of BETs placed on a one-by-one line basis of the active payline.

A play 2LINES button 40 is a button for activating pay lines by pressing it. The number of activated pay lines is 2. A play 5LINES button 41 is a button for activating pay lines by pressing it. The number of activated pay lines is 5. A play 10LINES button 42 is a button for activating pay lines by pressing it. The number of activated pay lines is 10. A play 20LINES button 43 is a button for activating pay lines by pressing it. The number of activated pay lines is 20. Further, a play 30LINES button 44 is a button for activating pay lines by pressing it. The number of activated pay lines is 30 at maximum.

In the embodiment, pressing the play 30LINES button 44 produced a game targeted for rescue. That is, if a game is played when the number of activated pay lines is "30" at maximum, a game targeted for rescue is produced.

A gamble button 45 is an operational button employed when a current game is caused to migrate to a gamble game after a free game has completed, for example. The gamble game used here is a game to be played using acquired credit.

A start button 46 is a button employed when symbol scrolling is started. This start button 46 also functions as a button for starting a free game or adding a payment acquired in a free game to credit.

A coin entry 36 is adapted to accept coins in the cabinet 11. The bill entry 115 is adapted to validate whether or not a bill is legitimate and to accept a legitimate bill in the cabinet 11. A belly glass 132 having an animation character or the like of a gaming machine 10 and a coin tray 18 for accepting coins paid out from the inside of the cabinet 11 are provided on a lower front face of a main door 13, i.e., downward of a control panel 30.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The gaming machine 10 produces effects by displaying images, outputting sounds, and outputting the light. The upper image display panel 131 also displays a current amount of "progressive bonus".

As described above, the top box of the gaming machine 10 according to the first embodiment is a top box 12*a*. This top box 12*a* employs pictures or members indicating animation characters or tools associated with "Snow White". The top box of the gaming machine 10' according to the second embodiment is a top box 12*b*. This top box 12*b* employs pictures or members indicating animation characters or tools associated with "Three Piglets". Further, the top box of the gaming machine 10" according to the third embodiment is a top box 12*c*. This top box 12*c* employs pictures or members indicating animation characters and tools or the like associated with "Beauty and the beast".

[Symbol Array]

Next, with reference to FIG. 7, a configuration of symbol arrays included in video reels 151 to 155 of a gaming machine 10 will be described. FIG. 7 is a view showing a symbol table for normal game, according to the first embodiment. Symbol arrays whose types or pictures are different from those in the symbol table for normal game, according to the first embodiment, are employed in a symbol table for normal game (not shown) according to the second embodiment or a symbol table for normal game (not shown) according to the third embodiment).

The symbol table for normal game shows the arrangements of symbols drawn on the peripheral surfaces of the reels. A first video reel 151, a second video reel 152, a third video reel 153, a fourth video reel 154, and a fifth video reel 155 each is assigned with a symbol array consisting of 22 symbols that correspond to respective code numbers from "00" to "21".

Types of the symbols to be employed are: a symbol associated with "Snow White" in the first embodiment; a symbol associated with "Three Piglets" in the second embodiment; and a symbol associated with "Beauty and the beast" in the third embodiment, for example.

[Configuration of Circuit Included in Gaming Machine]

Figure 6:
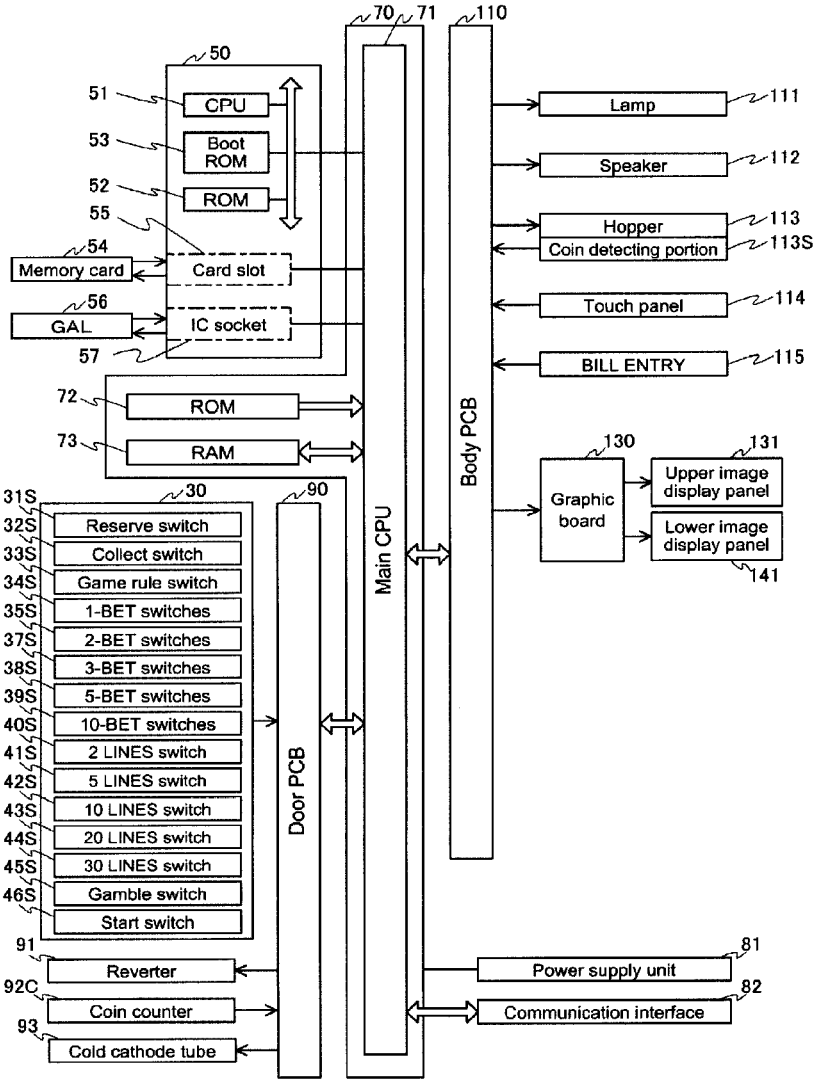
FIG. 6 is a block diagram depicting an internal configuration of the gaming machine 10 according to the first embodiment of the present invention.

Next, with reference to FIG. 6, a configuration of a circuit included in the gaming machine 10 is described. FIG. 6 is a block diagram illustrating an internal configuration of the gaming machine 10 according to the first embodiment of the present invention. The internal configuration of the gaming machine 10 shown in FIG. 6 is similar to that of the gaming machine 10' according to the second embodiment of the present invention or the gaming machine 10" according to the third embodiment.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a game system program. The game program includes a program related to game progression, a lottery program, and a program for producing effects by images and sounds. Further, the aforementioned game program includes data (see FIG. 7) specifying the configuration of the symbol array assigned to each of the video reels 151 to 155.

The lottery program is a program for determining to-be stopped symbol of each of the video reels 151 to 155 by lottery. The to-be stopped symbol is data for determining four symbols to be displayed by the display window 150 out of the 22 symbols forming each symbol array. The gaming machine 10 of the present embodiment determines as the to-be stopped symbol the symbol to be displayed in a predetermined region (the upper region, for example) out of the three regions provided for each of the video reels 151 to 155 of the display window 150.

The aforementioned lottery program includes symbol determination data. The symbol determination data is data that specifies random values so that each of the 22 symbols forming the symbol array is determined at an equal probability, for each of the video reels 151 to 155. The probabilities of the respective 22 symbols being determined are basically equal. However, the numbers of the respective types of symbols included in the 22 symbols vary, and thus the probabilities of the respective types of symbols being determined vary (i.e. different weights on the probabilities are generated).

It is to be noted that, although the data specifies that the equal numbers of symbols be provided to form the symbol arrays of the respective video reels 151 to 155 in the present embodiment, different numbers of symbols may form the respective video reels 151 to 155. For example, the symbol array of the first video reel 151 may consist of 22 symbols, whereas the symbol array of the second video reel 152 may consist of 30 symbols. Such a configuration increases the degree of freedom in setting the probabilities of the respective types of symbols being determined for each of the video reels 151 to 155.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the gaming machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 70 is provided with a main CPU 71, a ROM 72, a RAM 73, and a communication interface 82. The motherboard 70 corresponds to the controller of the present invention. While, in the embodiment, the controller is comprised of one CPU referred to as a main CPU 71, the controller of the present invention may be comprised of a plurality of CPUs.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted; further, through the gaming board 50, processing of loading the game program and the game system program stored in the memory card 54 is started.

The RAM 73 stores data and programs which is/are used in operation of the main CPU 71. For example, when the processing of loading the aforementioned game program, game system program or authentication program is conducted, the RAM 73 can store the program. The RAM 73 is provided with working areas used for operations in execution of these programs. Examples of the areas include: an area that stores a counter for managing the number of games, the number of BETs, the number of payouts, the number of credits and the like; and an area that stores symbols (code numbers) determined by lottery. That is, the RAM 73 functions as a number-of-games-for-rescue counter for counting the number of games as a trigger for conducting payout by rescue. The RAM 73 also stores various types of effect sounds used in the gaming machine 10.

The communication interface 82 is for communicating with the external control device 200 such as a server, through the communication line 301. Further, the motherboard 70 is connected with a later-described door PCB (Printed Circuit Board) 90 and a body PCB 110 by respective USBs.

The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices, the operations of which are controlled by the main CPU 71. The door PCB 70 is connected with a control panel 30, a reverter 91, a coin counter 92C and a cold cathode tube 93.

The control panel 30 is provided with a reserve switch 31S, a collect switch 32S, a game rule switch 33S, a 1-BET switch 34S, a 2-BET switch 35S, a 3-BET switch 37S, a 5-BET switch 38S, a 10-BET switch 39S, a play 2LINES switch 40S, a play 5LINES switch 41S, a play 10LINES switch 42S, a play 20LINES switch 43S, a play 30LINES switch 44S, a gamble switch 45S, and a start switch 46S. Each of the switches outputs a signal to the main CPU 71 upon detection of press of the button corresponding thereto by the player.

A reverter 91 and a coin counter 92C are provided inside of a coin entry 36. The reverter 91 validates whether or not a coin inserted into the coin entry 36 is legitimate, and those other than legitimate coin is discharged to a coin tray 18. The coin counter 92C detects an accepted legitimate coin and then counts the number of the accepted legitimate coins.

The cold cathode tube 93 functions as a backlight installed on the rear face sides of the upper image display panel 131 and the lower image display panel 141, and lights up based on a control signal outputted from the main CPU 71.

The body PCB 110 is connected with the lamp 111, the speaker 112, the hopper 113, a coin detecting portion 113S, the touch panel 114, the bill entry 115, and a graphic board 130. Further, the ticket printer 171, the card reader 172, a key switch 173S and the data display 174 may be connected to the main body PCB 111.

The lamp 111 lights up based on a control signal outputted from the main CPU 71. The speaker 112 outputs sounds such as BGM, based on a control signal outputted from the main CPU 71.

The hopper 113 operates based on a control signal outputted from the main CPU 71, and pays out coins of the specified number of payouts to the coin tray 18. The coin detecting portion 113S outputs a signal to the main CPU 71 upon detection of coins paid out by the hopper 113.

The touch panel 114 detects a place on the lower image display panel touched by the player's finger or the like, and outputs to the main CPU 71*a* signal corresponding to the detected place. Upon acceptance of a valid bill, the bill entry 115 outputs to the main CPU 71*a* signal corresponding to the face amount of the bill.

The graphic board 130 controls display of images conducted by the respective upper image display panel 131 and lower image display panel 141, based on a control signal outputted from the main CPU 71. The display window 150 of the lower image display panel 141 displays the five video reels 151 to 155 by which the scrolling and stop motions of the symbol arrays included in the respective video reels 151 to 155 are displayed. The graphic board 130 is provided with a VDP generating image data, a video RAM temporarily storing the image data generated by the VDP, and the like. A number-of-credits 201 of the lower image display panel 141 displays the number of credits stored in the RAM 73. A number-of-payouts display portion 203 of the lower image display panel 141 displays the payout number of coins.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

[Pay Lines]

Next, a description of pay lines will be given.

Fifteen pay line generating portions 65L (65La, 65Lb, 65Lc, 65Ld, 65Le, 65Lf, 65Lg, 65Lh, 65Li, 65Lj, 65Lk, 65Ll, 65Lm, 65Ln, 65Lo) are displayed at the left side of the lower image display panel 141. Similarly, fifteenth pay line generating portions 65R (65Ra, 65Rb, 65Rc, 65Rd, 65Re, 65Rf, 65Rg, 65Rh, 65Ri, 65Rj, 65Rk, 65Rl, 65Rm, 65Rn, 65Ro) are displayed at the right side of the lower image display panel 141.

Each of the pay line generating portions 65L is formed to be paired with any one of the pay line generating portions 65R. A pay line (pay line L) is defined in advance as a line from each of the pay line generating portions 65L toward any one of the pay line generating portions 65R having a paired relationship with any one of the pay line generating portions 65L. In the embodiment, 30 pay lines are defined.

In a case where three or more symbols of at least one type are rearranged from among "straw", "wooden plate", "brick", "turnip", "soup", "apple", "barrel", "grandmother", and "chimney", for example, it is determined to be a winning prize. In a normal game, a "WILD" symbol 182 is a symbol (wild symbol) which can be substituted for another symbol. That is, in a case where two "straw" symbols and one "WILD" symbol 182 are displayed on one pay line, it is assumed that three "straw" symbols are displayed along the pay line and then it is determined to be a winning prize.

If three "FREE GAME" symbols which are trigger symbols for free game are displayed on the display window 150, for example, a "free game" is awarded. If three "BONUS" symbols which are trigger symbols for animation character bonus game are displayed on the display window 150, an "animation character bonus game" is awarded.

It is also shown that the lower image display panel 141 displays: a number-of-credits display portion 201; a number of BETs display portion 202; a number-of-payouts display portion 203; a help display button 204; a pay table display button 205; a denomination display portion 206; and a pay line generating portion 65.

[Contents of Programs]

Next, with reference to FIG. 8 to FIG. 17, programs to be executed by a gaming machine 10 will be described.

<Main Control Processing>

Figure 8:
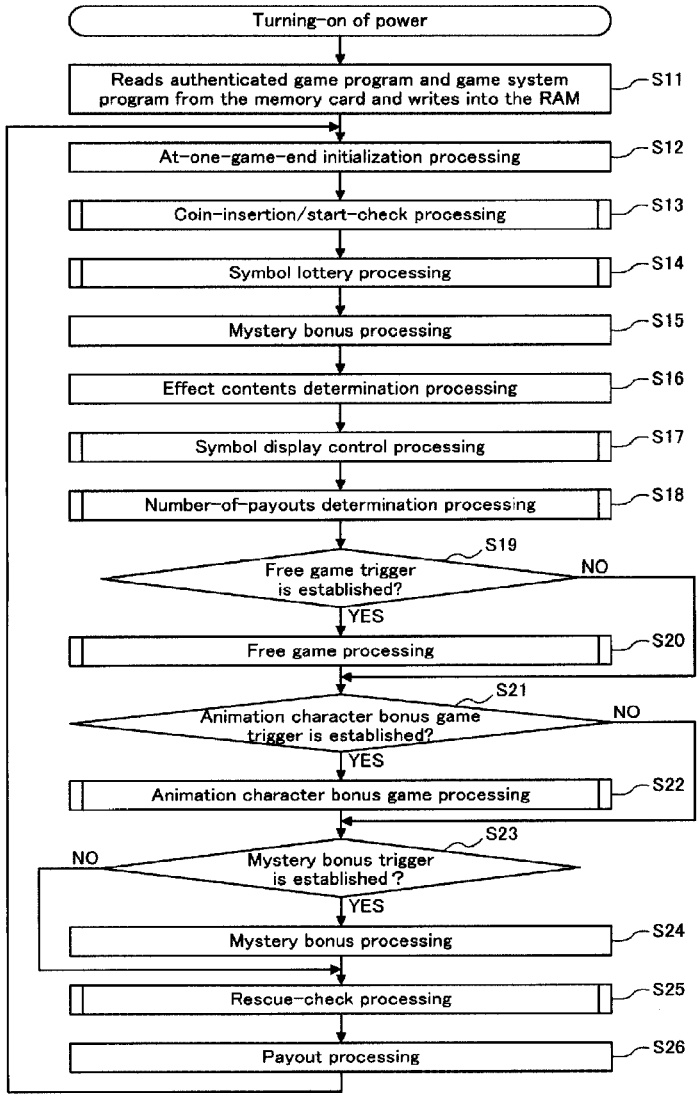
FIG. 8 is a view showing a flowchart of main control processing of the gaming machine 10 according to the first embodiment of the present invention.

First, with reference to FIG. 8, main control processing is described. FIG. 8 is a view illustrating a flowchart of the main control processing for the gaming machine 10 according to the first embodiment of the present invention.

First, when the power is supplied to the gaming machine 10, the main CPU 71 reads the authenticated game program and game system program from the memory card 54 through the gaming board 50, and writes the programs into the RAM 73 (step S11).

Next, the main CPU 71 conducts at-one-game-end initialization processing (step S12). For example, data that becomes unnecessary after each game in the working areas of the RAM 73, such as the number of BETs and the symbols determined by lottery, is cleared.

The main CPU 71 conducts coin-insertion/start-check processing which is described later with reference to FIG. 9 (step S13). In the processing, input from the BET switch and the spin switch is checked.

The main CPU 71 then conducts symbol lottery processing which is described later with reference to FIG. 12 (step S14).

In the processing, to-be stopped symbols are determined based on the random values for symbol determination.

Next, the main CPU 71 conducts mystery bonus lottery processing (step S15). In the processing, lottery determining whether or not to establish a mystery bonus trigger is held. For example, the main CPU 71 extracts a random value for mystery bonus from the numbers in a range of "0 to 99", and establishes the mystery bonus trigger when the extracted random value is "0".

The main CPU 71 conducts effect contents determination processing (step S16). The main CPU 31 extracts a random value for effect, and determines any of the effect contents from the preset plurality of effect contents by lottery.

The main CPU 71 then conducts symbol display control processing which is described later with reference to FIG. 13 (step S17). In the processing, scrolling of the symbol array of each of the video reels 151 to 155 is started, and the to-be stopped symbol determined in the symbol lottery processing of step S14 is stopped at a predetermined position (e.g. the upper region in the display window 150). That is, three symbols including the to-be stopped symbol are displayed in the display window 150. For example, when the to-be stopped symbol is the symbol associated with the code number of "10" and it is to be displayed to the upper region, the symbols associated with the respective code numbers of "11" and "12" are to be displayed to the respective central region and lower region in the display window 150.

Next, the main CPU 71 conducts number-of-payouts determination processing which is described later with reference to FIG. 16 (step S18). In the processing, the number of payouts is determined based on the combination of symbols displayed along a pay line, and is stored into a number-of-payouts counter provided in the RAM 73.

The main CPU 71 then determines whether or not a free game trigger is established (step S19). For example, a trigger for an animation character free game in the embodiment mean that three "FREE GAME" symbols 230 stop in the display window 150. When the main CPU 71 determines that the free game trigger is established, the main CPU 71 conducts animation character free game processing to be described later with reference to FIG. 17 (step S20).

Next, the main CPU 71 determines whether or not an animation character bonus game is established (step S21). For example, a trigger for the animation character bonus game in the embodiment means that three "BONUS" symbols 250 stop in the display window 150. When determining that the animation bonus game trigger is established, the main CPU 71 conducts animation character bonus game processing to be described later with reference to FIG. 18 (step S22).

After the processing of step S22 or when determining in step S21 that the animation character bonus game trigger has not been established, the main CPU determines whether or not a mystery bonus trigger is established (step S23). When determining that the mystery bonus trigger is established, the main CPU 71 conducts mystery bonus processing (step S24). In the processing, the number of payouts set for the mystery bonus (300, for example) is stored in the number-of-payouts storage region provided in the RAM 73.

After the processing of step S24 or when determining in step S23 that a mystery bonus trigger is not established, the main CPU 71 conducts rescue check processing to be described later with reference to FIG. 15 (step S25). In the processing, it is checked whether or not to conduct payout due to rescue.

The main CPU 71 conducts payout processing (step S26). The main CPU 71 adds the value stored in the number-of-payouts storage area to the value stored in a number-of-credits counter provided in the RAM 73. It is to be noted that operations of the hopper 113 may be controlled based on input from the collect switch 32S, and coins of the number corresponding to the value stored in the number-of-payouts counter may be discharged to the coin tray 18. After the processing has been conducted, the processing is shifted to step S12.

The game executed in accordance with the processing of step S12 to step S18 of the above main control processing is equivalent to a normal game in the present invention.

<Coin-Insertion/Start-Check Processing>

Figure 9:
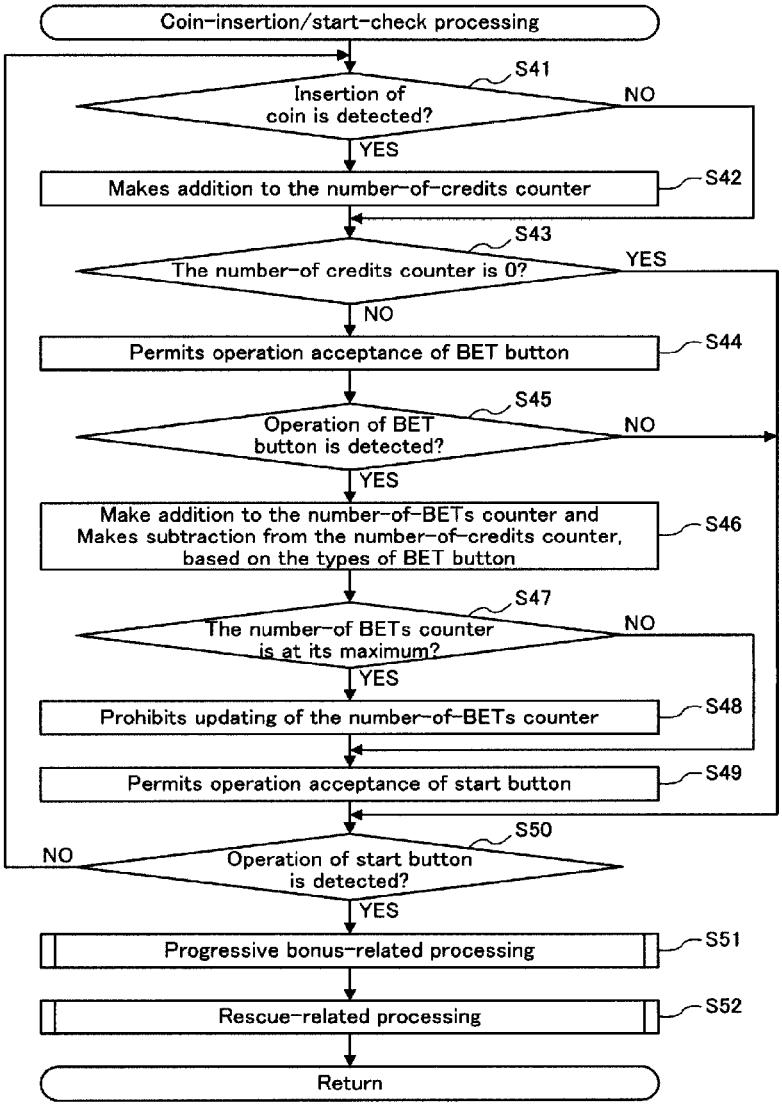
FIG. 9 is a view showing a flowchart of coin insertion/start check processing of the gaming machine 10 according to the first embodiment of the present invention.

Next, with reference to FIG. 9, coin-insertion/start-check processing is described. FIG. 9 is a view illustrating a flowchart of the coin-insertion/start-check processing for the gaming machine 10 according to the first embodiment of the present invention. The coin insertion/start-check processing shown in FIG. 9 is executed similarly in a gaming machine 10' according to the second embodiment of the present invention or a gaming machine 10" according to the third embodiment.

First, the main CPU 71 determines whether or not insertion of a coin has been detected by the coin counter 92C (step S41). When determining that the insertion of a coin has been detected, the main CPU 71 makes an addition to the number-of-credits counter (step S42). It is to be noted that, in addition to the insertion of a coin, the main CPU 71 may determine whether or not insertion of a bill has been detected by the bill entry 115, and when determining that the insertion of a bill has been detected, the main CPU 71 may add a value according to the bill to the number-of-credits counter.

After step S42 or when determining in step S41 that the insertion of a coin has not been detected, the main CPU 71 determines whether or not the number-of-credits counter is zero (step S43). When the main CPU 71 determines that the number-of-credits counter is not zero, the main CPU 71 permits operation acceptance of the BET buttons (step S44).

Next, the main CPU 71 determines whether or not operation of any of the BET buttons (1-BET button 34, 2-BET button 35, 3-BET button 37, 5-BET button 38, 10-BET button 39) has been detected (step S45). When the main CPU 71 determines that the BET switch (1-BET switch 34S, 2-BET switch 35S, 3-BET switch 37S, 5-BET switch 38S, 10-BET switch 39S) has detected press of the BET button by the player, the main CPU 71 makes an addition to a number-of-BETs counter provided in the RAM 73 and makes a subtraction from the number-of-credits counter, based on the type of the BET button (step S46).

The main CPU 71 then determines whether or not the number-of-BETs counter is at its maximum (step S47). When the main CPU 71 determines that the number-of-BETs counter is at its maximum, the main CPU 71 prohibits updating of the number-of-BETs counter (step S48). After step S48 or when determining in step S47 that the number-of-BETs counter is not at its maximum, the main CPU 71 permits operation acceptance of the start button 46 (step S49).

After step S49 or when determining in step S45 that the operation of any of the BET buttons has not been detected, or when determining in step S43 that the number-of-credits counter is zero, the main CPU 71 determines whether or not operation of the start button 46 has been detected (step S50). When the main CPU 71 determines that the operation of the start button 46 has not been detected, the processing is shifted to step S41.

When the main CPU 71 determines that the operation of the start button 46 has been detected, the main CPU 71 conducts progressive bonus-related processing which is described later with reference to FIG. 12 (step S51). In the processing, the amount to be accumulated to the amount of progressive bonus is calculated, and the amount is transmitted to the external control device 200.

Next, the main CPU 71 conducts rescue-related processing which is described later with reference to FIG. 11 (step S52). In the processing, counting of the number of games is conducted which triggers a payout by the rescue. After the processing has been conducted, the coin-insertion/start-check processing is completed.

<Progressive Bonus-Related Processing>

Figure 10:
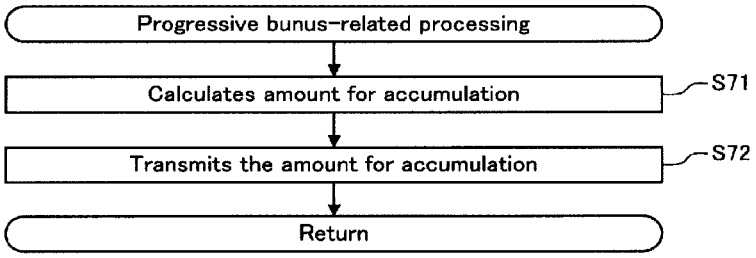
FIG. 10 is a view showing a flowchart of progressive-bonus related processing of the gaming machine 10 according to the first embodiment of the present invention.

Now, with reference to FIG. 10, the progressive-bonus-related processing is described. FIG. 10 is a view illustrating a flowchart of the progressive bonus-related processing for the gaming machine 10 according to the first embodiment of the present invention. The progressive bonus-related processing shown in FIG. 10 is executed similarly in the gaming machine 10' according to the second embodiment of the present invention or the gaming machine 10" according to the third embodiment.

First, the main CPU 71 calculates the amount for accumulation (step S71). The main CPU 71 obtains the product of the value of the number-of-BETs counter and a preset accumulation ratio, so that the amount for accumulation to the amount of progressive bonus is calculated.

Next, the main CPU 71 transmits the calculated amount for accumulation to the external control device 200 (step S72). Upon reception of the amount for accumulation, the external control device 200 updates the amount of progressive bonus. After the processing has been conducted, the progressive bonus-related processing is completed.

<Rescue-Related Processing>

Figure 11:
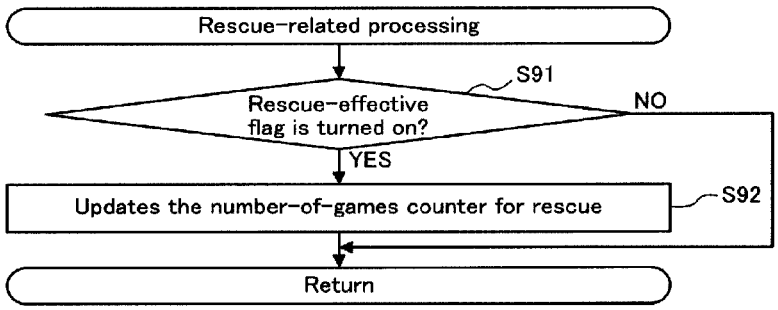
FIG. 11 is a view showing a flowchart of rescue-related processing of the gaming machine 10 according to the first embodiment of the present invention.

Next, with reference to FIG. 11, the rescue-related processing is described. FIG. 11 is a view illustrating a flowchart of the rescue-related processing for the gaming machine 10 according to the embodiment of the present invention. The rescue-related processing shown in FIG. 11 is executed similarly in the gaming machine 10' according to the second embodiment of the present invention or the gaming machine 10" according to the third embodiment.

First, the main CPU 71 determines whether or not a rescue-effective flag is turned on (step S91). The rescue-effective flag is turned on when a command to make the insurance effective is inputted by the player in the rescue selection processing which is described later with reference to FIG. 16. Specifically, a player presses a play 30LINES button 44 to thereby produce a rescue-target game. That is, where a game is played when the number of activated pay lines is "30" at maximum, the rescue-effective flag is set to ON.

When the main CPU 71 determines that the rescue-effective flag is not turned on, the main CPU 71 completes the rescue-related processing. On the other hand, when the main CPU 71 determines that the rescue-effective flag is turned on, the main CPU 71 updates a number-of-games counter for rescue, the counter being provided in the RAM 73 (step S92). The number-of-games counter for rescue is a counter for managing the number of games up to the time of the payout by the rescue. In the processing of step S92, the main CPU 71 adds one to the number-of-games counter for rescue. After the processing has been conducted, the rescue-related processing is completed.

<Symbol Lottery Processing>

Figure 12:
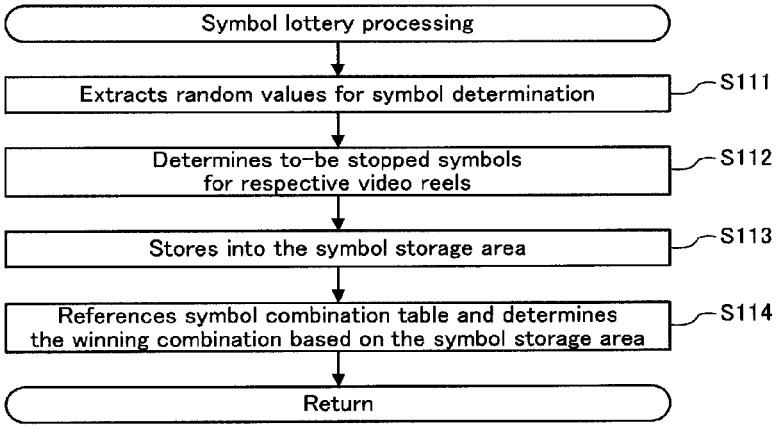
FIG. 12 is a view showing a flowchart of symbol lottery processing of the gaming machine 10 according to the first embodiment of the present invention.

Next, with reference to FIG. 12, the symbol lottery processing is described. FIG. 12 is a view illustrating a flowchart of the symbol lottery processing for the gaming machine according to the first embodiment of the present invention. The symbol lottery processing shown in FIG. 12 is executed similarly in the gaming machine 10' according to the second embodiment of the present invention or the gaming machine 10" according to the third embodiment.

First, the main CPU 71 extracts random values for symbol determination (step S111). The main CPU 71 then determines to-be stopped symbols for the respective video reels 151 to 155 by lottery (step S112). Symbol arrays comprised of a plurality of symbols associated with code numbers are assigned to the respective video reels 151 to 155 (first video reel 151, second video reel 152, third video reel 153, fourth video reel 154, and fifth video reel 155), as shown in FIG. 7. A table data indicated to relate of each of the video reels and symbol arrays are stored in the ROM72. The main CPU 71 holds a lottery for each of the video reels 151 to 155, and determines any one of the plurality of symbols as a to-be stopped symbol. At this time, a respective one of the plurality of symbols is determined at an equal probability.

The main CPU 71 then stores the determined to-be stopped symbols for the respective video reels 151 to 155 into a symbol storage area provided in the RAM 73 (step S113). Next, the main CPU 71 references the symbol combination table and determines a winning combination based on the symbol storage area (step S114). The symbol combination table specifies a combination of any kind of symbols according to a winning prize and the number of payouts. A winning prize is established in a case where scrolling of symbol arrays of the respective video reels 151 to 155 are stopped and then a combination of symbols displayed along a pay line is coincident with a combination of symbols specified in accordance with the symbol combination table. If the combination of symbols displayed along the pay line is not coincident with any combination of symbols displayed along a pay line, no winning prize (so called losing) is established. In step S114, the main CPU 71 determines the winning combination based on the combination of symbols to be displayed along the pay line by the respective video reels 151 to 155 and the number-of-payouts determination table. After the processing has been conducted, the symbol lottery processing is completed.

In the embodiment, if it is determined in symbol lottery processing that trigger symbols for animation character bonus game is stop-displayed, it is determined as to which privilege (fixed payment or bonus game) is to be associated with such trigger symbols. This determination is made based on a data table indicating to-be-stopped positions of trigger symbols and privileges (fixed payment or bonus game). This data table is prestored in the ROM 72. For example, if three "BONUS" symbols 250 are determined to be stop-displayed, it is determined as to which privilege (fixed payment or bonus game) is to be associated with each of the "BONUS" symbols 250.

<Symbol Display Control Processing>

Figure 13:
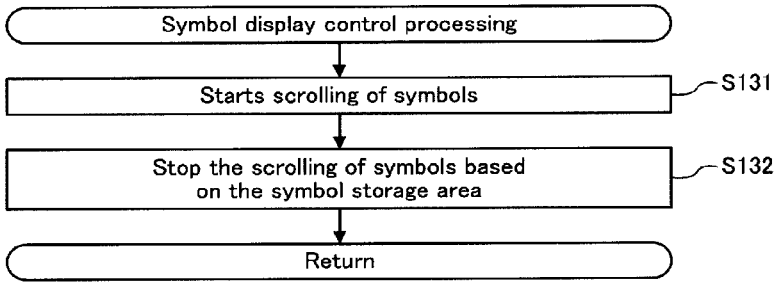
FIG. 13 is a view showing a flowchart of symbol display control of the gaming machine 10 according to the first embodiment of the present invention.

Next, with reference to FIG. 13, the symbol display control processing is described. FIG. 13 is a view illustrating a flowchart of the symbol display control processing for the gaming machine according to the first embodiment of the present invention. The symbol display control processing shown in FIG. 13 is executed similarly in the gaming machine 10' according to the second embodiment of the present invention or the gaming machine 10" according to the third embodiment.

First, the main CPU 71 starts scrolling of the symbol arrays of the respective video reels 151 to 155 that are displayed to the display window 150 of the lower image display panel 141 (step S131). The main CPU 71 then stops the scrolling of the symbol arrays of the respective video reels 151 to 155, based on the aforementioned symbol storage area (step S132). After the processing has been conducted, the symbol display control processing is completed.

While the embodiment describes a case in which respective symbols form a symbol array and then are longitudinally scrolled, a mode of variable display of symbols in the present invention is not limited thereto. For example, these symbols may be scrolled in a horizontal direction or individual symbols may be displayed to move separately in a display region.

In the above-described normal game, where the first stopped symbol array includes both of a "BONUS" symbol 250 for animation character bonus game and a "FREE GAME" symbol 230 for a free game trigger, an effect sound for special stoppage is read and reproduced from among a variety of effect sounds stored in the RAM 73. Where the first stopped symbol array fail to include both of a "BONUS" symbol 250 for animation character bonus game and a "FREE GAME" symbol 230 for a free game trigger, an effect sound for normal stoppage is read and reproduced from among a variety of effect sounds stored in the RAM 73. In the embodiment, the symbol array to be first stopped is a video reel 151 of a first column, and the code numbers "00", "01", "02", i.e., "FREE GAME", "GRANDMOTHER", and "BONUS" symbols are stopped in the display window 150, the effect sound for special stoppage is reproduced and outputted from the speaker 112. In other cases, the effect sound for normal stoppage is reproduced and outputted from the speaker 112.

In this manner, a player can be aware of the fact that an animation character game allowing a special privilege or payment to be awarded or a free game can be awarded. Therefore, it is possible to cause the player to hold a great sense of expectation by notifying a state in which an animation character bonus game or a free game can be awarded by way of an effect sound for special stoppage.

<Number-of-Payouts Determination Processing>

Figure 14:
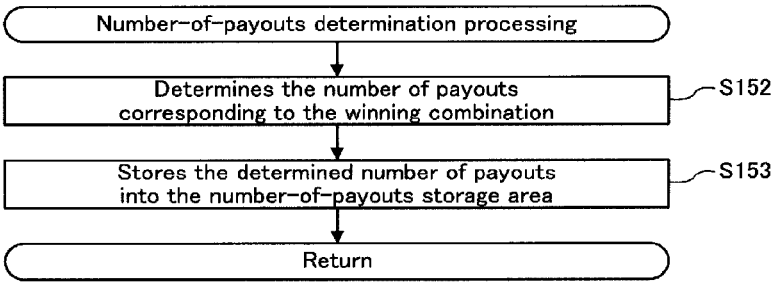
FIG. 14 is a view showing a flowchart of number-of-payout determination processing of the gaming machine 10 according to the first embodiment of the present invention.

Next, with reference to FIG. 14, the number-of-payouts determination processing is described. FIG. 14 is a view illustrating a flowchart of the number-of-payouts determination processing for the gaming machine 10 according to the first embodiment of the present invention. The number-of-payouts determination processing shown in FIG. 14 is executed similarly in the gaming machine 10' according to the second embodiment of the present invention or the gaming machine 1" according to the third embodiment.

The main CPU 71 first determines the number of payouts corresponding to the winning combination (step S152). It is to be noted that the main CPU 71 determines "0" as the number of payouts in the case where the game is lost. Next, the main CPU 71 stores the determined number of payouts into the number-of-payouts counter (step S153). After the processing has been conducted, the number-of-payouts determination processing is completed.

<Rescue-Check Processing>

Figure 15:
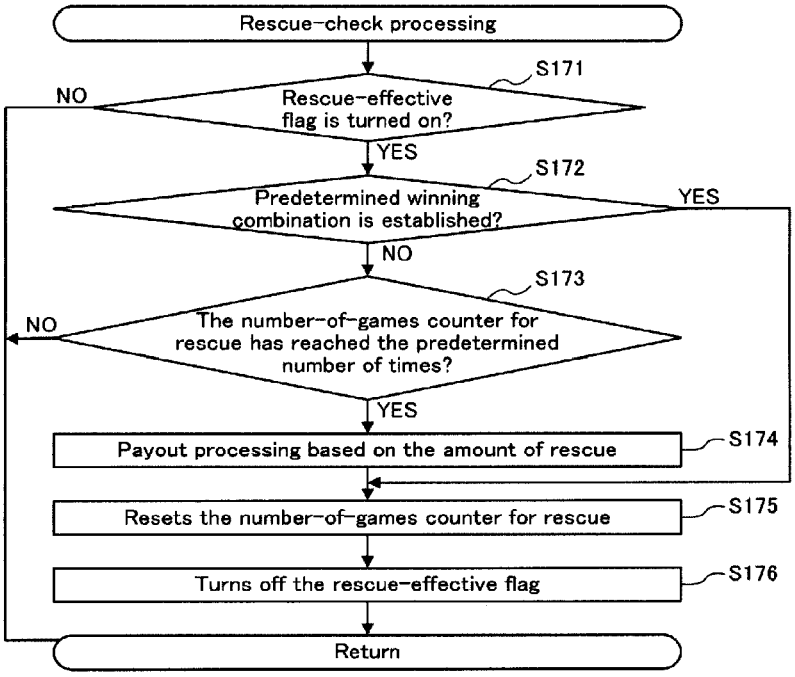
FIG. 15 is a view showing a flowchart of rescue check processing of the gaming machine 10 according to the first embodiment of the present invention.

Next, with reference to FIG. 15, the rescue-check processing is described. FIG. 15 is a view illustrating a flowchart of the rescue-check processing 10 for the gaming machine according to the first embodiment of the present invention. The rescue-check processing shown in FIG. 15 is executed similarly in the gaming machine 10' according to the second embodiment of the present invention or the gaming machine 10" according to the third embodiment.

First, the main CPU 71 determines whether or not the rescue-effective flag is turned on (step S171). When the main CPU 71 determines that the rescue-effective flag is not turned on, the main CPU 71 completes the rescue-check processing. When the main CPU 71 determines that the rescue-effective flag is turned on, the main CPU 71 determines whether or not a predetermined winning combination has been established (step S172). In the present embodiment, "free game trigger", "animation character bonus game trigger", "mystery bonus", and "progressive bonus" are subjects of the predetermined winning combination.

When the main CPU 71 determines that the predetermined winning combination has not been established, the main CPU 71 determines whether or not the number-of-games counter for rescue has reached a predetermined number of times (e.g. 300) (step S173). When the main CPU 71 determines that the number-of-games counter for rescue has not reached the predetermined number of times, the main CPU 71 completes the insurance-check processing.

After step S174 or when determining in step S172 that the predetermined winning combination has been established, the main CPU 71 resets the number-of-games counter for rescue (step S175). Next, the main CPU 71 turns the rescue-effective flag off (step S176). After the processing has been conducted, the insurance-check processing is completed.

<Rescue Selection Processing>

Figure 16:
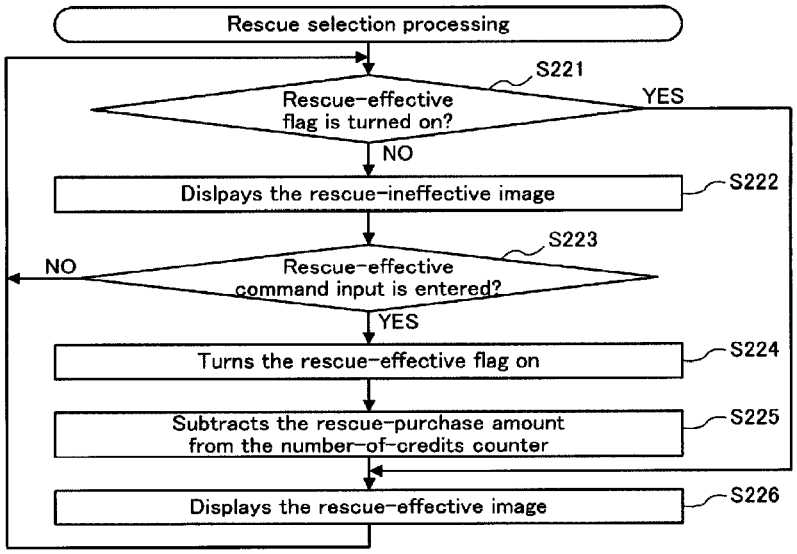
FIG. 16 is a view showing a flowchart of rescue selection processing of the gaming machine 10 according to the first embodiment of the present invention.

Next, with reference to FIG. 16, the insurance selection processing is described. FIG. 16 is a view illustrating a flowchart of the rescue selection processing for the gaming machine 10 according to the first embodiment of the present invention. The rescue selection processing shown in FIG. 16 is executed similarly in the gaming machine 10' according to the second embodiment of the present invention or the gaming machine 10" according to the third embodiment.

First, the main CPU 71 determines whether or not the rescue-effective flag is turned on (step S221). When the main CPU 71 determines that the rescue-effective flag is not turned on, the main CPU 71 displays a rescue-ineffective image (step S222). The main CPU 71 transmits a command to display the rescue-ineffective image to the graphic board 130. Based on the command, the graphic board 130 generates the rescue-ineffective image and displays the image to the lower image display panel 141. As the rescue-ineffective image, for example, an image showing "RESCUE BET $1.00 TOUCH TO BET" is displayed. This image is an image for prompting the player to select whether or not to make the rescue effective, and notifying the player of the amount required for making the rescue effective. The player can input a command to make the rescue effective by touching a predetermined place on the touch panel 114.

Subsequently, the main CPU 71 determines whether or not a rescue-effective command input has been entered (step S223). When the main CPU 71 determines that the rescue-effective command input has not been entered, the main CPU 71 shifts the processing to step S221 with the rescue-effective flag turned off. On the other hand, when the main CPU 71 determines that the rescue-effective command input has been entered, the main CPU 71 turns the rescue-effective flag on (step S224).

Next, the main CPU 71 subtracts the rescue-purchase amount from the number-of-credits counter (step S225). In the present embodiment, an amount corresponding to, for example, one dollar is subtracted from the number-of-credits counter. After step S225 or when determining in step S221 that the rescue-effective flag is turned on, the main CPU 71 displays the rescue-effective image (step S226). As the rescue-effective image, for example, an image showing "RESCUE CONTINUED WIN 200 CREDIT" is displayed. This image is an image informing the player that the rescue is effective, and that the value of "200" is to be added to the number-of-credits counter when the rescue condition is satisfied. After the processing has been conducted, the processing is shifted to step S221.

<Free Game Processing>

Figure 17:
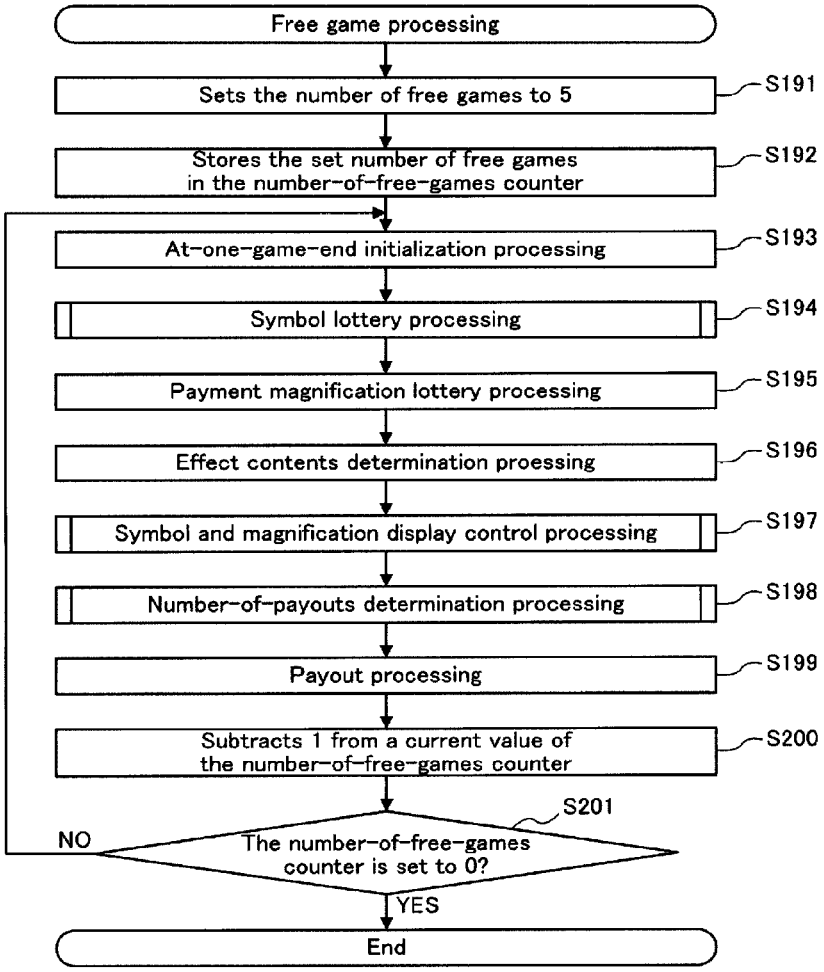
FIG. 17 is a view showing a flowchart of free game processing of the gaming machine 10 according to the first embodiment of the present invention.

Next, with reference to FIG. 17, free game processing will be described. FIG. 17 is a view showing a flowchart of free game processing of a gaming machine 10 according to the first embodiment of the present invention. The free game processing shown in FIG. 17 is executed similarly in the gaming machine 10' according to the second embodiment of the present invention or the gaming machine 10" according to the third embodiment.

The free game in the first embodiment is a game executed in response to the fact that three "FREE GAME" symbols 230 are stop-displayed in the display window 150 of the lower image display panel 141 in a normal game. Similarly, the free game in the second embodiment or the third embodiment is a game executed in response to the fact that a predetermined given symbols are stop-displayed in the display window 150 in a normal game.

First, the main CPU 71 sets the number of free games to 5 (step S191). Next, the main CPU 71 stored the set number of free games in the number-of-free-games counter provided in the RAM 73 (S192).

Next, like the processing of step S12 described with reference to FIG. 8, the main CPU 71 conducts at-one-game-end initialization processing (S193). The main CPU 71 then conducts symbol lottery processing described with reference to FIG. 12 (S194). The main CPU 71 then conducts payment magnification lottery processing (S195). This processing is the one of determining a magnification of payment by lottery in a case where it is determined that a payment is awarded after a winning prize is established in the symbol lottery processing. Like the processing of S16 described with reference to FIG. 8, the CPU 71 then conducts effect contents determination processing (step S196). The main CPU 71 then conducts symbol and magnification display control processing (step S197).

Next, the main CPU 71 conducts number-of-payouts determination processing described with reference to FIG. 14 (step S198). The main CPU 71 then conducts payout processing (step S199). In this payout processing, the main CPU 71 adds a value of the number-of-payouts counter, stored in the number-of-payouts determination processing of S198 described previously, to a current value of the number-of-payouts counter for free game. The number-of-payouts counter for free game is for managing a total number of payouts determined in a free game. Coins may be discharged from the coin tray 18.

Next, the main CPU 71 subtracts 1 from a current value of the number-of-free-games counter (step S200). The main CPU 71 then determines whether or not the number-of-free-games counter is set to 0 (step S201). When the main CPU 71 determines that the number-of-free-games counter is not set to 0, the routine migrates to step S193. When the main CPU 71 determines the number-of-free-games counter is set to 0, free game processing is completed. After the free game has been completed, the routine migrates to step S21 described with reference to FIG. 8.

With the above-described configuration, in response to the fact that symbols for generating a free game ("FREE GAME" symbols 230) are stop-displayed in a normal game, a player can execute a free game. Where it is determined that a winning prize is established in this free game and then a predetermined amount of payment is awarded, lottery is further executed for determining a magnification of the predetermined amount of payment. In this manner, the player can receive the amount of payment obtained by multiplying a magnification determined by lottery for the awarded predetermined amount of payment. In addition, establishing a state in which such magnification of payment increases can cause the player to hold a great sense of expectation.

<<Animation Character Bonus Game Processing>>

Figure 18:
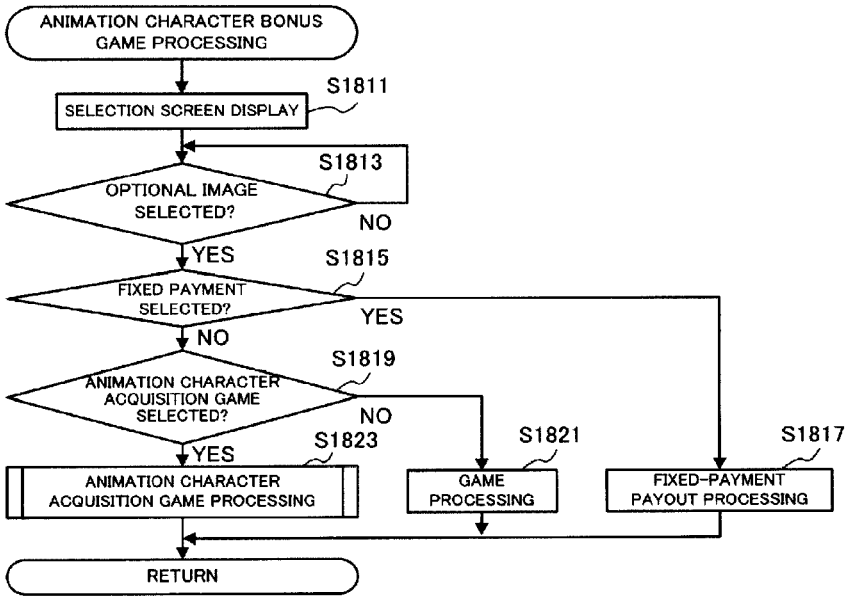
FIG. 18 is a flowchart showing a subroutine of animation character bonus game processing to be executed by means of a main CPU 71 mounted on a motherboard 70 of the gaming machine 10 according to the first embodiment of the present invention.

FIG. 18 is a flowchart showing a subroutine of animation character bonus game processing to be executed by the main CPU 71 mounted on the motherboard 70 of a gaming machine. The free game processing shown in FIG. 18 is executed similarly in the gaming machine 10' according to the second embodiment of the present invention or in the gaming machine 10" according to the third embodiment.

First, the main CPU 71 displays a selection screen on the lower image display panel 141 (step S1811). This selection screen is a screen for causing a player to select one optional image from among a plurality of optional images displayed on the lower image display panel 141. On this optional image, a function of the optional image is hidden before one of the optional images is selected. When a player selects one optional image, the selected optional image is turned to thereby allow the player to visually recognize its related function.

Displaying a plurality of images indicating bonus symbols as optional images forms a selection screen, for example. A player selects an image indicating one bonus symbol from the plurality of images indicating the plurality of bonus symbol displayed, whereby a function corresponding to such one bonus symbol is displayed. There are plural types of functions of this optional image related to a benefit awarded to a player. The functions of the optional images are assigned to a plurality of optional images, respectively, when an animation character bonus game is started. It is preferable that the functions of the optional images are assigned to a plurality of optional images so that each of the functions is selected at a predetermined probability. Doing this enables a player to select each of the functions at a predetermined probability, thus enabling benefits awarded to players to be well balanced.

Next, the main CPU 71 determines whether or not a player selects one optional image (step S1813). When the main CPU 71 determines that the player fails to select one optional image (NO), the routine is reverted to step S1813.

When determining that the player selects one optional image (YES), the main CPU 71 determines whether or not the function of one optional image selected by the player is a fixed payment (step S1815). The fixed payment defined herein is a function of paying out a predetermined payment to be awarded to a player when the optional image is selected.

When determining that the function of one optional image selected by the player is a fixed payment in the determination processing of step S1815 (YES), the main CPU 71 executes processing of paying out the fixed payment (step S1817). After that, the main CPU 71 completes this subroutine.

When, in the determination processing of step S1815, it is determined that the function of one optional image selected by the player is not a fixed payment (NO), the main CPU 71 determines whether or not the function of one optional image selected by the player is execution of an animation character acquisition game (step S1819).

When the function of one optional image selected by the player is not execution of the character acquisition game (NO), the main CPU 71 executes a variety of mini-games (step S1821). After that, the main CPU 71 completes this subroutine. According to a result of this mini-game, a variety of benefits such as a payment can be awarded to players.

The mini-games to be executed in the processing of step S1821 include a game to be played while a plurality of video reels are displayed, for example. In this game, a player can start scrolling symbol arrays of the respective video reels and then stop it so that determined symbols are displayed for the player. In particular, it is preferable that WILD symbols are included as part of the symbols forming this symbol arrays. The WILD symbol is a kind of universal symbol or a kind of all-mighty symbol which can be treated as any kind of ordinary symbol, and is handled as a symbol which is advantageous for payment from among plural kinds of symbols. Further, in this mini-game, it is preferable that the WILD symbol becomes an expanding WILD symbol which expands along a scroll direction. This mini-game completes after being played a predetermined number of times. The expanding WILD symbol is a symbol expanding along the scroll direction, so that this symbol is more advantageous for payment. Executing such mini-game can increase a possibility that more payments are awarded to players.

Further, the mini-game may be a game adapted to cause a player to try and see a predetermined animation character right. This is a game in which a plurality of barrel images are displayed for the player to try and see a barrel in which an animation character, i.e., piglet, is hidden. In this game, a payment is assigned to a piglet and then the player enjoys trying and seeing a piglet of which payment is high in addition to trying and seeing the barrel where the piglet exists. When an animation character hidden in the barrel is a wolf, the mini-game is completed.

Furthermore, as a mini-game, there is a game in which a plurality of video reels are displayed. This is a game in which the numerals displayed on a plurality of stopped video reels are obtained as a payment which a player can acquire. This is also a game which can be played until a predetermined animation character is displayed on each of the plurality of the stopped video reels. The numerals displayed on the plurality of stopped video reels are added until the predetermined animation character is displayed and then an additive value at a time point of completion is treated as a payment which could be finally acquired.

When, in the determination processing of step S1819, it is determined that the function of one optional image selected by a player is execution of an animation character acquisition game (YES), the main CPU 71 invokes and executes a subroutine of the animation character game processing shown in FIG. 19 to be described later (step S1823). After that, the main CPU 71 completes this subroutine.

Executing the above-described animation character bonus game processing causes a player to select an optional image to thereby execute a fixed payment, a mini-game, or an animation character game, enabling a benefit such as a predetermined payment to be awarded to the player.

<<Animation Character Game Processing>>

Figure 19:
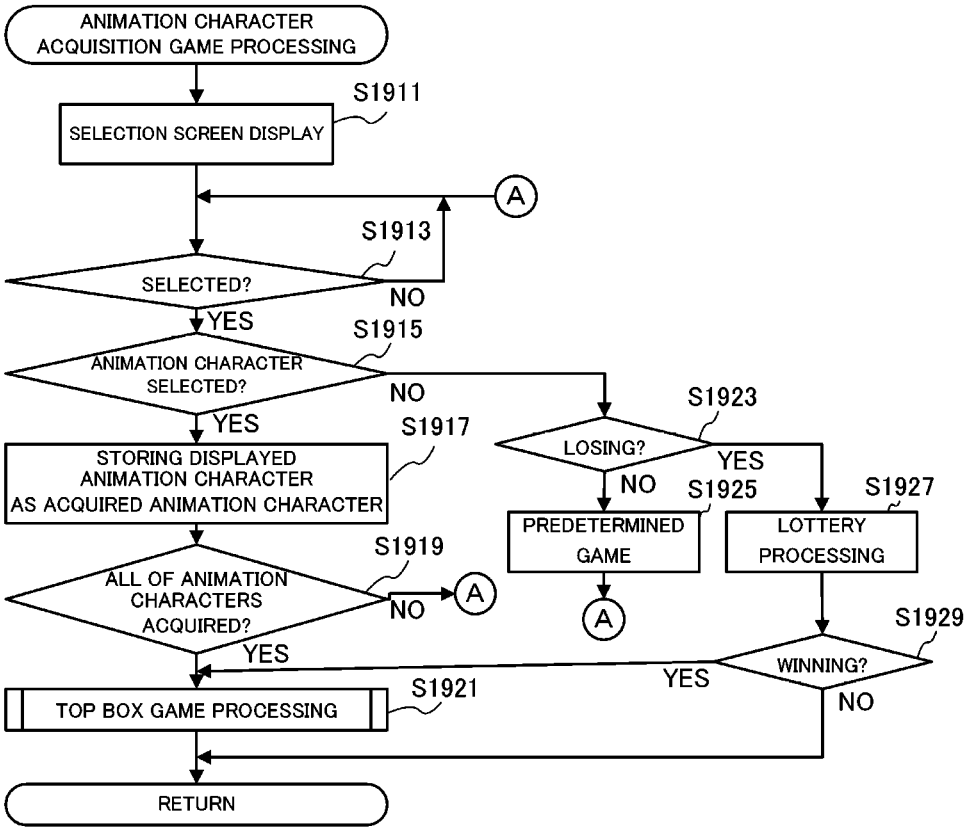
FIG. 19 is a flowchart showing a subroutine of animation character acquisition game processing to be executed by means of the main CPU 71 mounted on the motherboard 70 of the gaming machine 10 according to the first embodiment of the present invention.

FIG. 19 is a flowchart showing a subroutine of animation character acquisition game processing to be executed by means of the main CPU 71 mounted on the motherboard 70 of a gaming machine. This subroutine is invoked and executed by the processing of step S1823 of FIG. 18 described above. The free game processing shown in FIG. 19 is executed similarly in the gaming machine 10' according to the second embodiment of the present invention or in the gaming machine 10" of the third embodiment.

First, the main CPU 71 displays a selection screen on the lower image display panel 141 (step S1911). Like the step S1811 described above, this selection screen is a screen for causing a player to select one optional image from among a plurality of optional images displayed on the lower image display panel 141. This optional image functions as a card on which a predetermined picture is displayed. A function of the optional image is hidden before the player selects one optional image. When the player selects one optional image, such one optional image is turned and then the player can visually recognize its related function.

In the first embodiment, for example, displaying a plurality of images indicating apples as optional images forms a selection screen. A player selects an image indicating one apple from among the plurality of the displayed images indicating a plurality of apples to thereby able to play a game corresponding to such one apple.

In the second embodiment, displaying a plurality of images indicating piglet's noses as optional images forms a selection screen. A player selects an image indicating one piglet nose from the plurality of the displayed images indicating a plurality of piglets' noses to thereby able to play a game corresponding to such one piglet's nose.

Further, in the third embodiment, displaying a plurality of images indicating roses as optional images forms a selection screen. A player selects an image indicating one rose from among the plurality of the displayed images indicating a plurality of roses to be thereby able to play a game corresponding to such one rose.

The images to be displayed as optional images may be those other than apple, piglets' noses, or roses. In any case, these images may be displayed in such a manner that a player can recognize images indicating options.

Next, the main CPU 71 determines whether or not a player selects one optional image (step S1913). When the main CPU 71 determines that the player selects one optional image (NO), the routine is reverted to step S1913.

When determining that the player selects one optional image (YES), the main CPU 71 determines whether or not one optional image selected by the player is one of predetermined kinds of animation characters (step S1915). The predetermined kinds of animation characters include a prince and a prince, predetermined kinds of piglets, or a beauty and a beast and the like.

When, in determination processing of step S1915, it is determined that a player selects a predetermined kind of animation character (YES), the main CPU 71 causes the RAM 73 of the motherboard 70 to store the selected animation character as an acquired animation character (step S1917).

Next, the main CPU 71 determines whether or not all of the predetermined kinds of animation characters are acquired (step S1919). When the main CPU 71 determines that all of the predetermined kinds of animation characters are not acquired (NO), this routine is reverted to step S1911 described above.

When the main CPU 71 determines that all of the predetermined kinds of animation characters are acquired (YES), the main CPU 71 executes a top box game to be described later (step S1921). After that, the main CPU 71 completes this subroutine.

When determining that a player fails to select a predetermined kind of animation character in determination processing of step S1915 (NO), the main CPU 71 determines whether or not one optional image selected by the player indicating "losing" (step S1923).

When determining that one optional image selected by the player does not indicate "losing" in determination processing of step S1923 (NO), the main CPU 71 executes a predetermined game (step S1925) and then causes the routine to revert to step S1911 described above. The predetermined games include a game completing whether or not a player tries and sees a fixed payment or a game competing whether or not an animation character selected by a player has won. In any game, a player is awarded a benefit such as a predetermined payment in accordance with a game result.

When determining that one optional image selected by a player indicates "losing" in determination processing of step S1923 (YES), the main CPU 71 executes lottery processing (step S1927) and then determines whether or not a result of the lottery processing is "winning" (step S1929). When the main CPU 71 determines that the result of the lottery processing is "winning" (YES), the main CPU 71 causes the routine to revert to step S1921 described above. When determining that the result of the lottery processing is not "winning", the main CPU 71 completes this subroutine immediately.

By doing this, even if all of the predetermined kinds of animation characters could not be acquired, when the result of the lottery processing is "winning", a player can execute a top box game by employing animation characters that have been successfully acquired so far, making it possible to maintain or enhance the player's sense of expectation.

When the result of the lottery processing is determined to be "winning" in determination processing of step S1929 described above, it may be determined as to whether or not at least one animation character is acquired. By doing this, in a case where at least one animation character is acquired, a top box game can be executed or in a case where no animation character is acquired, no top box game can be executed. Doing this enables a game in a top box to be dealt as a game to be played based on an acquired animation character. This animation character acquisition game enables a player to hold a sense of tension or a sense of expectation in an attempt to acquire more animation characters.

In top box game processing executed in the processing of step S1921 described above, a subroutine of top box game processing 1, 2, or 3 to be described later is invoked and executed. Top box game processing 1 is a top box game employing a top box 12*a* of the first embodiment of the present invention. Top box game processing 2 is a top box game employing a top box 12*b* of the second embodiment of the present invention. Top box game processing 3 is a top box game employing a top box 12*c* of the third embodiment of the present invention.

In the first embodiment, "princess", "prince", and "seven dwarfs" animation characters can be acquired by the above-mentioned animation character acquisition game. In the second embodiment, animation characters indicating a piglet living in a straw house, a piglet living a wooden house, and a piglet living in a brick house can be acquired by the above-mentioned animation character acquisition game. Further, in the third embodiment, "bell (princess)", "beast (prince)", and "palace" animation characters can be acquired by the above-mentioned animation character acquisition game. These animation characters appear in an effect caused by a top box game employing the top box 12*a*, 12*b*, or 12*c*.

<<Configuration of Top Box of the First Embodiment>>

FIG. 20 to FIG. 30 are views showing a configuration of a top box 12*a* of the first embodiment of the present invention, Animation characters appearing in the effect caused by the top box game employing the top box 12*a* of the first embodiment of the present invention are "princess", "prince", and "seven dwarfs".

Figure 20:
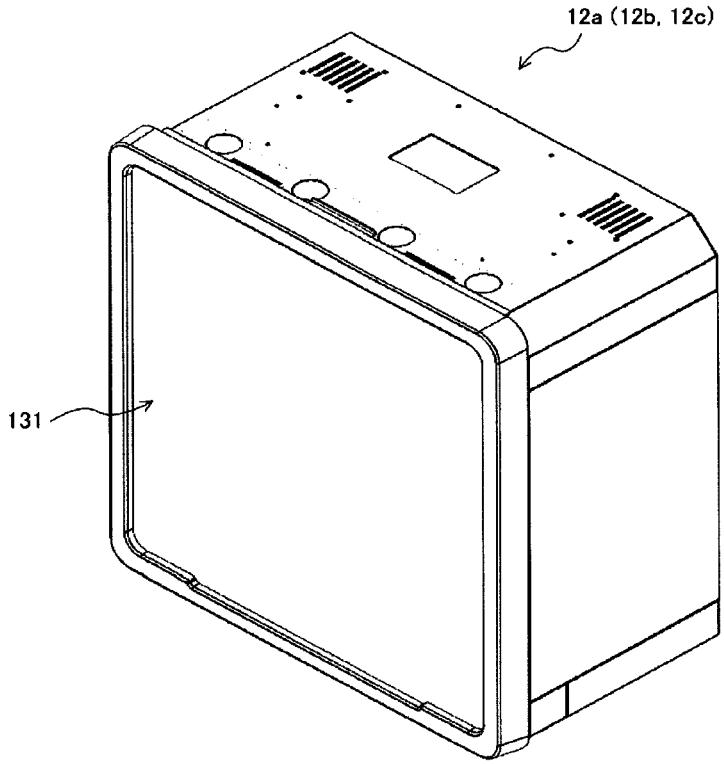
FIG. 20 is a perspective view showing an appearance of a top box 12*a* of the first embodiment of the present invention.
Figure 21:
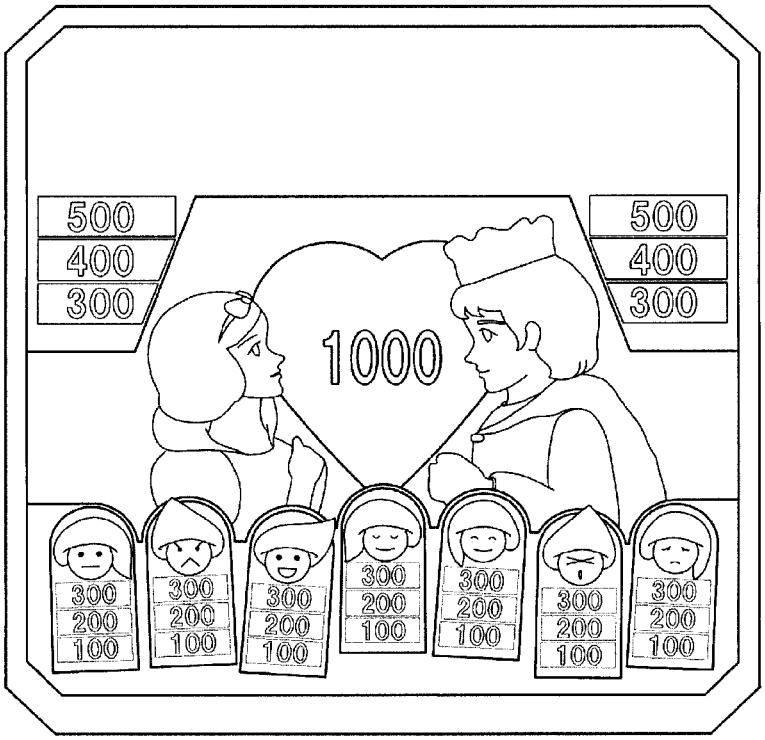
FIG. 21 is a front view showing an outline of a picture assigned to an upper image display panel 131 of the top box 12*a* of the first embodiment of the present invention.
Figure 22:
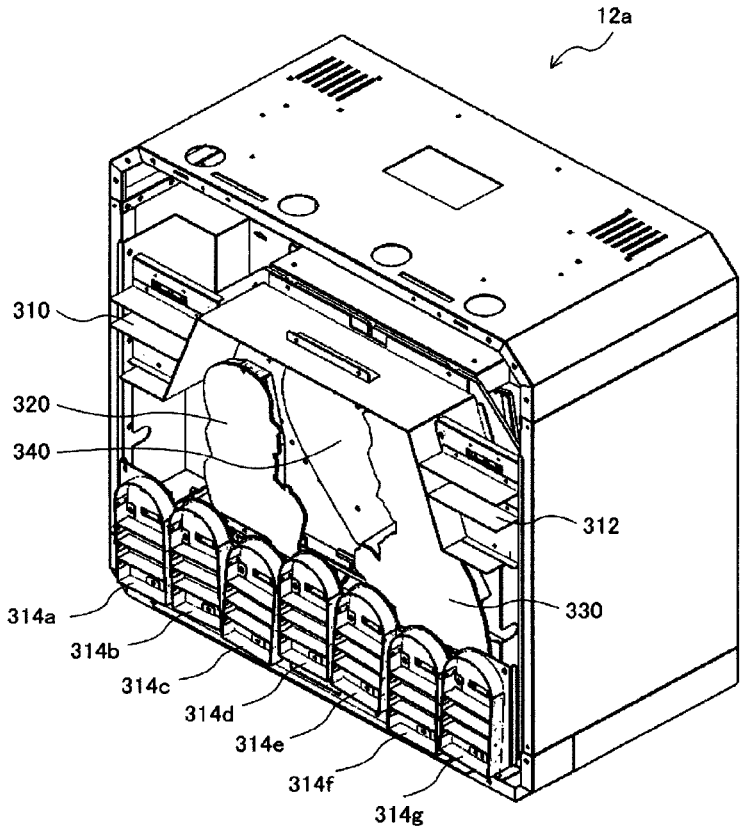
FIG. 22 is a perspective view showing an inside of the top box 12*a* in a state in which an upper image display panel 131 of the top box 12*a* is removed.
Figure 23:
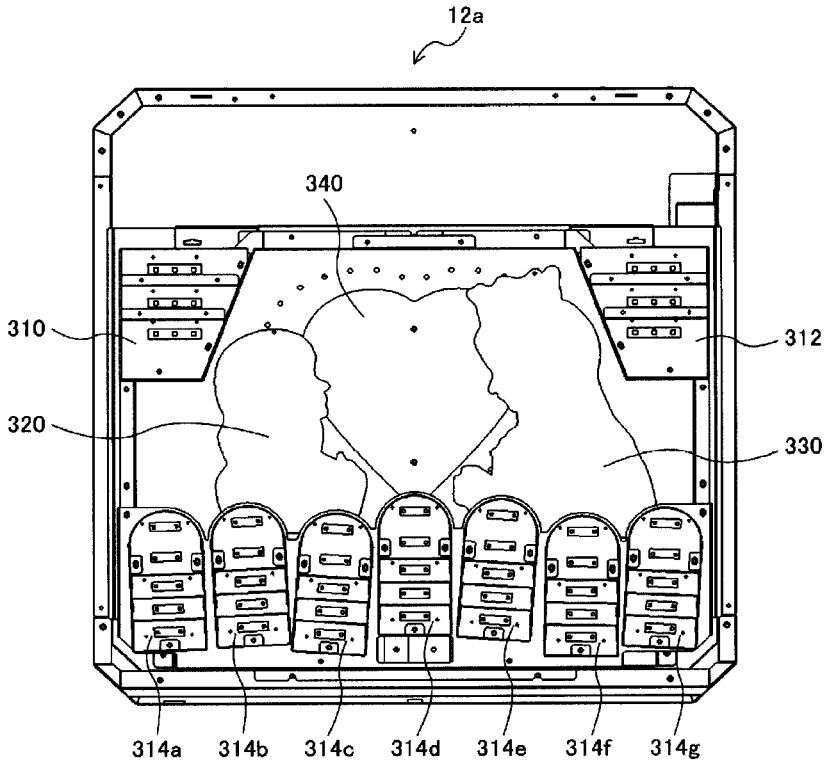
FIG. 23 is a front view showing an inside of the top box 12*a* in a state in which the upper image display panel 131 of the top box 12*a* is removed.

FIG. 20 is a perspective view showing an appearance of the top box 12*a* of the first embodiment of the present invention. FIG. 21 is a perspective view showing an inside of the top box 12*a* in a state in which the upper image display panel 131 of the top box 12*a* is removed. FIG. 23 is a front view showing the inside of the top box 12*a* in a state in which the upper image display panel 131 of the top box 12*a* is removed.

The top boxes 12*b* and 12*c* of the second embodiment of the present invention to be described later also have similar appearances.

<Upper Image Display Panel 131>

As described above, the upper image display panel 131 is provided on a front face of the top box 12*a*. A transparent portion and a nontransparent portion are formed on the upper image display panel 131. The transparent portion of the upper image display panel 131 is a portion for causing a player to visually recognize members inside of the top box 12*a*. Therefore, it is sufficient if the transparent portion of the upper image display panel 131 can cause a player to visually recognize the inside of the top box 12*a*. The transparent portion does not need to be perfectly transparent and may also be assigned with some degree of color.

The transparent portion is formed so as to be able to visually recognize the inside of the top box 12*a*. As described later, animation character members indicating animation characters are disposed inside of the top box 12*a*, enabling a player to visually recognize the animation character members via the transparent portion.

Numerals indicating payments of a roulette employed in a top box game and pictures indicating animation characters or the like are printed or attached onto the nontransparent portion (see FIG. 21). As shown in FIG. 21 and FIG. 23, an LED (Light Emitting Diode) or a lamp, etc., is disposed inside of the top box 12*a* behind this nontransparent portion. The lamp comprised of the LED (Light Emitting Diode) is capable of illuminating and brightly indicating the numerals indicating payments of the nontransparent portion or pictures indicating animation characters, etc., from behind them.

<Lamp Boxes 310, 312, 314*a* to 314*g*>

As shown in FIG. 21 and FIG. 23, a lamp box 310 for playing a princess roulette game, a lamp box 312 for playing a prince roulette game, and lamp boxes 314*a* to 314*g* for playing seven dwarfs roulette game are provided on a rear face of the upper image display panel 131. Each of these lamp boxes 310, 312, 314*a* to 314*g* has three lamps, and the roulette game is played by sequentially repeating lighting up and lighting out of the three lamps play.

Numerals indicating payments are preprinted on the upper image display panel 131 corresponding to each of the three lamps. For example, numeral values "300", "400", and "500" are printed on the upper image display panel 131 corresponding to the lamp box 310 for playing the princess roulette game. By playing the roulette game, one of these numerals "300", "400", and "500" is sequentially brightly illuminated and then the finally brightly illuminated numeric value is determined to be a payment awarded to a player.

Similarly, numeric values "300", "400", and "500" are printed on the upper image display panel 131 corresponding to the lamp box 312 for playing the prince roulette game. Numeral values "100", "200", and "300" are printed on the upper image display panel 131 corresponding to each of the lamp boxes 314*a* to 314*g* for playing a seven-dwarf roulette game. Pictures indicating seven dwarfs are also printed on the upper image display panel 131 corresponding to each of the lamp boxes 314*a* to 314*g* for playing a seven-dwarf roulette game and a lamp for illuminating the pictures indicating these seven dwarfs is also provided on each of the lamp boxes 314*a* to 314*g*.

This configuration enables a roulette game corresponding to an animation character which could be acquired in the above-described animation character acquisition game to be played in a top box game.

<Animation Character Members 320 and 330>

Figure 24:
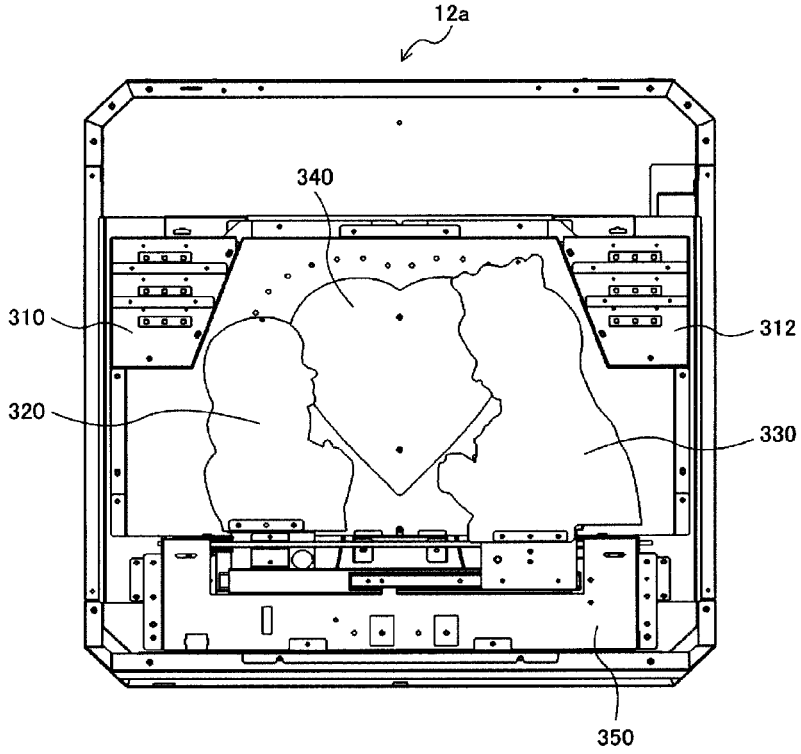
FIG. 24 is a front view showing an inside of the top box 12*a* in a state in which lamp boxes 314*a* to 314*g* for playing a seven-dwarfs roulette game are removed.

FIG. 24 is a front view showing an inside of the top box 12*a* in a state in which lamp boxes 314*a* 314*g* for playing seven dwarfs roulette game is removed. As shown in FIG. 21, FIG. 23, and FIG. 24, an animation character member 320 indicating a princess and an animation character member 340 indicating a prince are disposed inside of the top box 12*a*. The animation character member 320 indicating a princess is disposed at the left side in frontal viewing and the animation character member 330 indicating a prince is disposed at the right side in frontal viewing. A picture for indicating a princess is preprinted on a surface of the animation character member 320. Similarly, a picture for indicating a prince is preprinted on a surface of the animation character member 330.

As described later, the animation character members 320 and 330 are connected to a drive member 350 and is movably configured. The animation character members 320 and 330 ha lamps 322 and 332 (see FIG. 30) comprised of an LED (Light Emitting Diode). Lighting up the lamp 322 can illuminate a picture of a princess printed on the surface of the animation character member 320. Similarly, lighting up the lamp 332 can illuminate a picture of a prince printed on the surface of the animation character member 330.

<Heart-Shaped Member 340>

Figure 25:
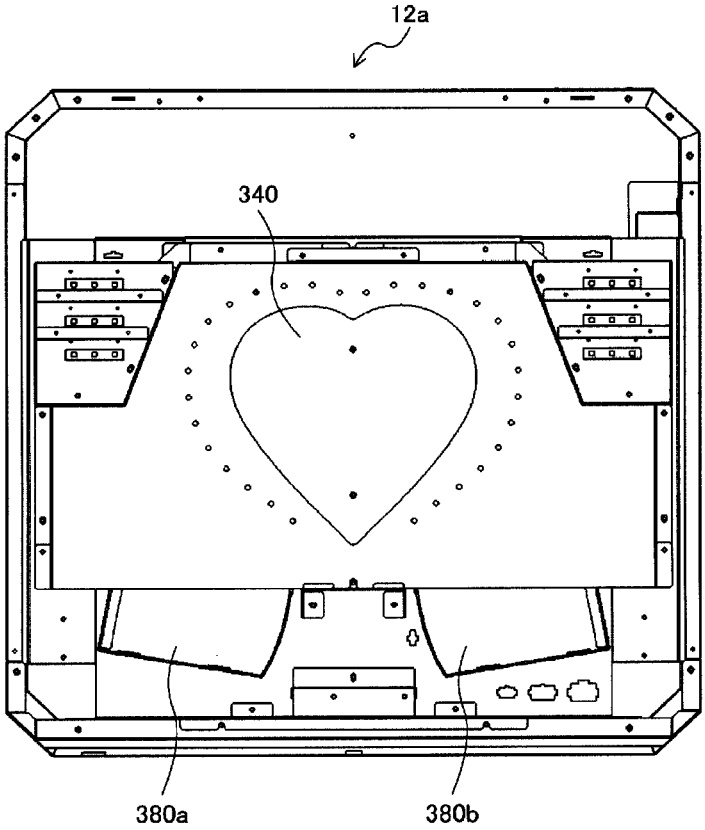
FIG. 25 is a front view showing an inside of the top box 12*a* in a state in which animation character members 320 and 330 and a drive member 350 are removed.

FIG. 25 is a front view showing an inside of the top box 12*a* in a state in which the animation character members 320 and 330 and the drive member 350 are removed. As shown in FIG. 21, FIG. 23, FIG. 24, and FIG. 25, a heart-shaped member 340 is disposed at a substantially central predetermined position, inside of the top box 12*a*. The heart-shaped member 340 has a lamp 342 (see FIG. 26) formed of an LED (light Emitting Diode). A numeric value "1000" indicating a payment of a roulette game is printed on the surface of the heart-shaped member 340 (see FIG. 21). Lighting up the lamp 342 can illuminate the numeric value "1000" printed on the surface of the animation character member 320. When both of a princess and a prince can be acquired in the above-described animation character acquisition game, a roulette game is played in such a manner that the payment "1000" is added to the payments "300", "400", and "500" of the princess roulette game or prince roulette game. Doing this increases a possibility that more payment is awarded to a player if both of the princess and the prince could be acquired in the animation character acquisition game.

As described above, a transparent portion and a nontransparent portion are formed on the upper image display panel 131. The animation character member 320 indicating a princess, the animation character member 330 indicating a prince, and a heart-shaped member 340 are positioned at the transparent portion. Therefore, a player can visually recognize these members via the transparent portion.

<Light Guides 380*a* and 380*b*>

Figure 26:
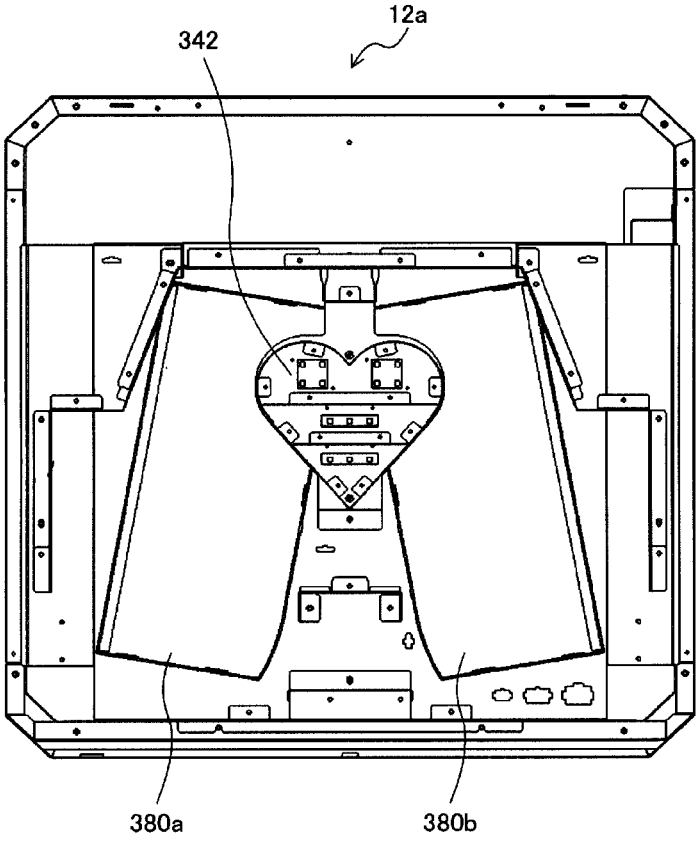
FIG. 26 is a front view showing an inside of the top box 12*a* in a state in which a heart-shaped member 340 is removed.
Figure 27:
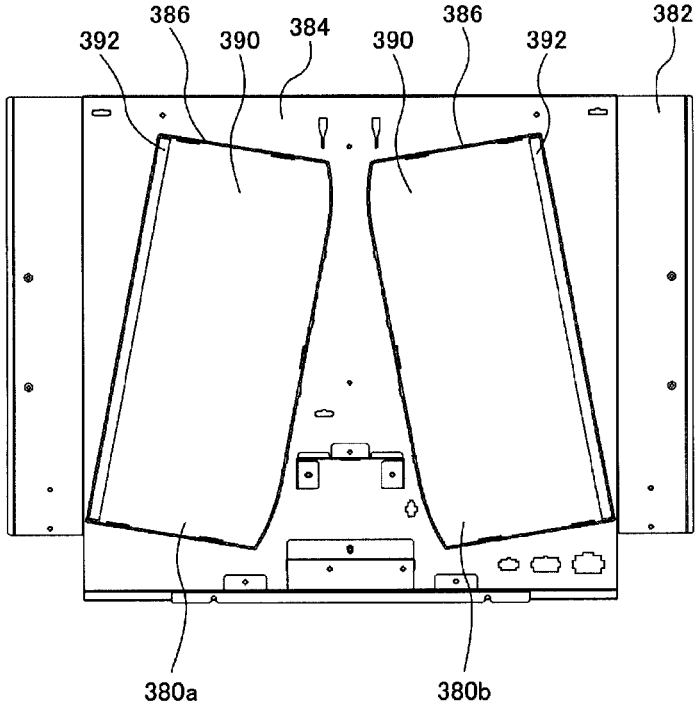
FIG. 27 is a front view showing an inside of the top box 12*a* in a state in which a lamp box of the heart-shaped member 340 is removed.

FIG. 26 is a front view showing an inside of the top box 12*a* in a state in which the heart-shaped member 340 is removed. FIG. 27 is a front view showing an inside of the top box 12*a* in a state in a state in which a lamp box of the heart-shaped member 340 is removed.

Two light guides 380*a* and 380*b* are provided at the left and right inside of the top box 12*a*. The light guide 380*a* is disposed on a rear face so as to correspond to the left side of the nontransparent portion of the upper image display panel 131. The light guide 380*b* is disposed at a rear face so as to correspond to the right side of the nontransparent portion of the upper image display panel 131. As shown in FIG. 27, two light guides 380*a* and 380*b* are provided on a backlight panel 382. The backlight panel 382 is formed in a substantially plate-like shape and a panel face 384 is formed. The panel face 384 of the backlight panel 382 is fixed to the top box 12*a* so as to be opposite to the upper image display panel 131. Two light guides 380*a* and 380*b* are fixed to the panel face 384 so as to substantially parallel to the panel face 384 by means of a predetermined support member (not shown) via a light guide case 386 to be described later.

Two backlights (not shown) are also disposed on the backlight panel 382. The light emitted on one of the back lights is made incident to the light guide 380*a*. The light emitted from the other back light is made incident to the light guide 380*b*.

Each of the two light guides 380*a* and 380*b* is made of a light guide acryl resin 390, a light guide reflector 392, and a light guide case 386. The light guide acryl resin 390 is formed in a plate-like shape. The light guide reflector 392 is attached to an end part of the light guide acrylic 390. The light guide reflector 392 reflects the light emitted from the light guide acrylic 390 up to the end part of the light guide acrylic 390 so that the reflected light can be made incident to the light guide acrylic 390 again. The light guide case 386 is for housing and disposing the light guide acrylic 390 at a predetermined position of the backlight panel 382.

Light is made incident while a predetermined face of this light guide acrylic 390 is employed as a light incident face. The incident light is then emitted from an emission face after reflection has been repeated inside of the light guide acrylic 390. The light thus incident to the light guide acrylic 390 is emitted after being reflected a plurality of times inside of the light guide acrylic 390. The light of which brightness is approximately uniform at every site of an emission face can be emitted from the emission face and then light with non-uniform brightness can be emitted from the emission face. The two light guides 380*a* and 380*b* are disposed so that the emission face of the light guide acrylic 390 (light guides 380*a* and 380*b*) is opposite to the nontransparent portion of the upper image display panel 131. Doing this enables the nontransparent portion of the upper image display panel 131 to be illuminated with approximately uniform brightness, enabling the nontransparent portion to be brightened uniformly.

As described above, light is emitted from the emission face of the light guide acrylic 390 and then illuminates the nontransparent portion of the upper image display panel 131. Therefore, the positions or sizes of two backlights or the number of backlights or the positions or the like of two light guides 380*a* and 380*b* relative to the two backlights may be appropriately defined so as to make light incident to the light guide acrylic 390 so that light can be emitted from the emission face of the light guide acrylic 390.

As described above, the light guide case 386 houses the light guide acrylic 390. As shown in FIG. 27, a retaining wall and a retaining face for retaining the light guide acrylic 390 are formed along the periphery of the light guide case 386. An opening (not shown) for making the light emitted from the backlights incident to the light guide acrylic 390 is formed on the retention face or the retaining face. The backlights are disposed so as to correspond to this opening. The light emitted from the backlights via this opening can be made incident to the light guide acrylic 390. Further, a reflection member (not shown) is provided inside of the retaining wall and the retaining face. Even if the light made incident to the light guide acrylic 390 is emitted from another face which is different from the emission face, the emitted light is reflected to be thereby able to make incident to the light guide acrylic 390 again and then the light can be efficiently emitted from the emission face.

The emission face of the light guide acrylic 390 is disposed by the backlight panel 382 so as to be spaced from the rear face of the upper image display panel 131 at a predetermined distance, 40 mm or more, for example. The light emitted from the emission face of the light guide acrylic 390 travels in a radial manner so as to broaden at a variety of angles. The emission face of the light guide acrylic 390 is disposed after being spaced from the rear face of the upper image display panel 131. Thus, even if members such as cables are unavoidably disposed between the emission face and the rear face of the upper image display panel 131, they can be caused to reach the rear face of the upper image display panel 131 through a variously angled passageway in accordance with the light traveling in a radial manner from the light guide acrylic 390. Therefore, the nontransparent portion of the upper image display panel 131 can be illuminated without the light being interrupted by the members such as cables.

<Drive Member 350>

Figure 28:
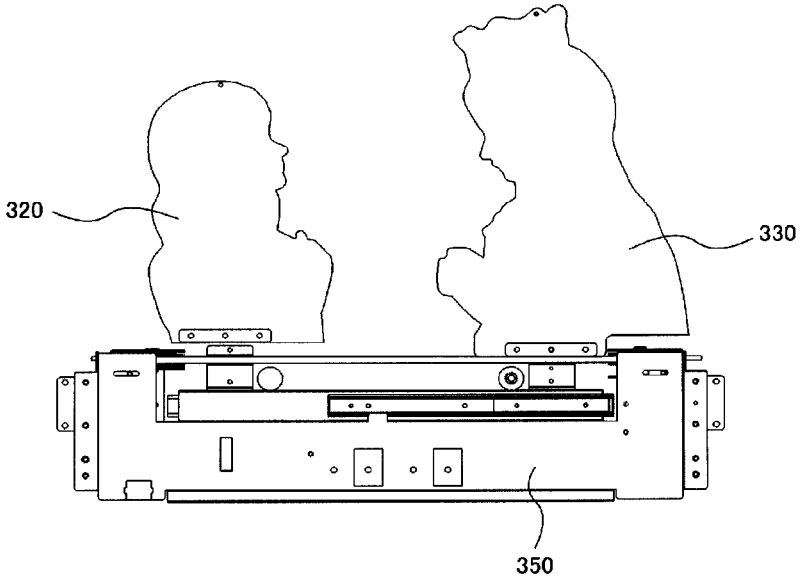
FIG. 28 is a front view showing the animation character members 320 and 330 and the drive member 350.
Figure 29:
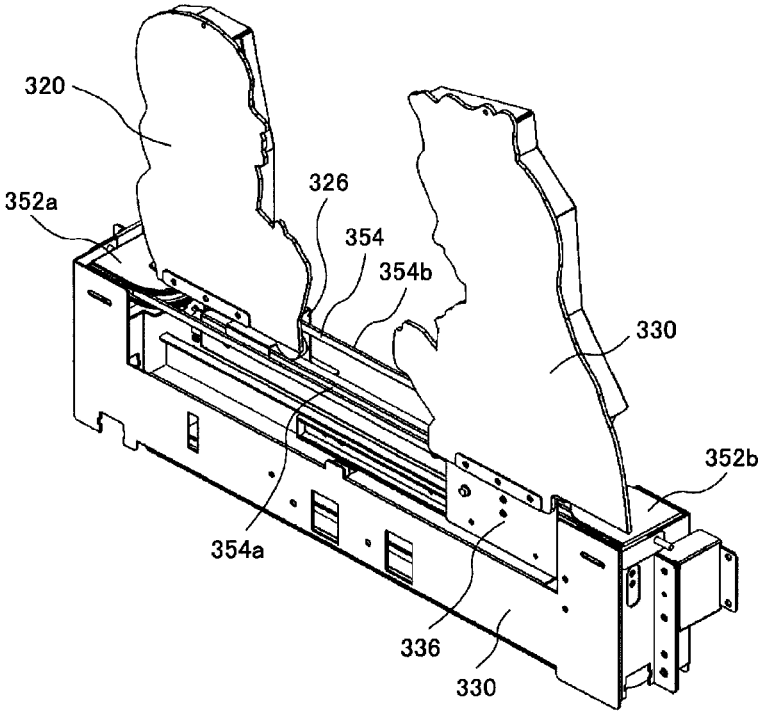
FIG. 29 is a perspective view showing the animation character members 320 and 330 and the drive member 350.
Figure 30:
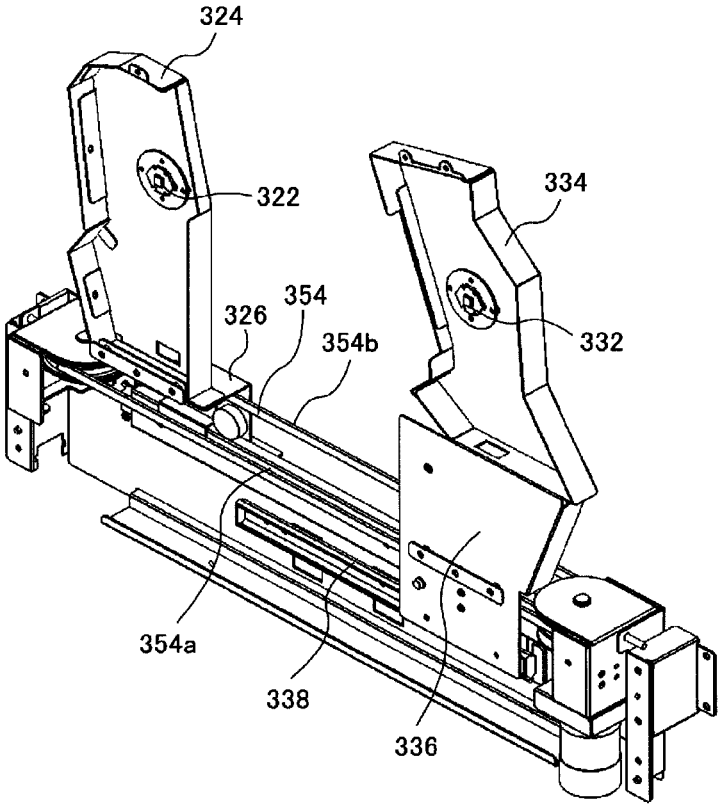
FIG. 30 is a perspective view showing a support member 324 of the animation character member 320; a support member 334 of the animation character member 330; and a drive mechanism of the drive member 350.

FIG. 28 is a front view showing animation character members 320 and 330 and a drive member 350. FIG. 29 is a perspective view showing the animation character members 320 and 330 and the drive member 350. FIG. 30 is a perspective view showing a support member 324 of the animation character member 320, a support member 334 of the animation character member 330, and a drive mechanism of the drive member 350.

The animation character member 320 is provided on the support member 324. The animation character member 330 is provided on the support member 334. A lamp 322 is provided on the support member 324. Lighting up the lamp 322 can illuminate a picture of a princess printed on the surface of the animation character member 320. The lamp 332 is provided on the support member 334. Lighting up the lamp 332 can illuminate a picture of a prince printed on the surface of the animation character member 330.

A pulley 352*a* is rotatably provided at the left side of the drive member 350. A pulley 352*b* is rotatably provided at the right side of the drive member 350. A belt 354 is wound so as to be laid across both of the pulleys 352*a* and 352*b*. The belt 354 is flexible and is formed in an annular shape. An electromotive motor 356 is coupled with the pulley 352*a* and then the electromotive motor 356 rotates, whereby the pulley 352*b* also rotates. A rotational motion of the pulley 352*b* is transmitted to the belt 354 and then the belt 354 moves. The belt 354 moves to thereby rotate the pulley 352*a*.

By doing this, between the pulleys 352*a* and 352*b* the belt 354 is comprised of a belt portion 354*a* positioned at the front side and a belt portion 354*b* positioned at the back side. The belt portions 354*a* and 354*b* are formed in a substantially linear shape. These portions are disposed so as to extend substantially in parallel to each other and horizontally. A fixing member 336 is fixedly provided at the right side of the belt portion 354*a* positioned at the front side. The fixing member 336 is for fixing the support member 334 of the animation character member 330 to the belt portion 354*a*. A fixing member 326 is fixedly provided at the left side of the belt portion 354*b* positioned at the back side. The fixing member 326 is for fixing the support member 324 of the animation character member 320 to the belt portion 354*b*.

A single belt 354 is thus wound so as to be laid across both of the two pulleys 352*a* and 352*n*. The support member 324 for princess animation character is provided at the belt portion 354*a* at the front side. The support member 334 for prince animation character is provided at the belt portion 354*b* at the back side. Driving the electromotive motor 356 can move the support member 324 for princess animation character and the support member 334 for prince animation character simultaneously to be interlocked with each other. Specifically, a movement direction of the belt portion 354*a* at the front side is always opposed to a movement direction of the belt portion 354*b* at the back side, thus by the electromotive motor 356 is driving, enabling the princess and prince animation characters to move so as to approach each other or to be spaced from each other. Thus, it is possible for the single belt 354 to function as a transmission interlock means for transmitting a drive force of the electromotive motor 356 (drive means) to a plurality of animation characters (support members of a plurality of animation characters) to be interlocked with each other.

A protrusive portion (not shown) is formed at the support member 334 for prince animation character. A guide rail 338 is provided so as to be opposite to the protrusive portion of the support member 334. The guide rail 338 is formed in a substantially linear shape and is disposed so as to extend in a horizontal direction. The protrusive portion of the support member 334 engages with the guide rail 338. Doing this enables the support member 334 to be moved along the guide rail 338. The guide rail 338 can move the support member 334 while supporting the member. A weight of the support member 334 is thus hardly put on the belt 354, whereby a burden on the belt 354 can be reduced. Similarly, a protrusive portion (not shown) is formed at the support member 324 for princess animation character and then a guide rail (not shown) is provided so as to be opposite to this protrusive portion. Doing this enables the support member 324 for princess animation character to be also moved while the guide rails supports the member.

The above-described configuration enables the princess animation character and the prince animation character to move in parallel to the upper image display panel 131. Thus, it is possible to make the princess and prince animation characters conspicuous so as to impart a sense of expectation to a player or to cause persons around a gaming machine to hold interest. The animation characters are moved in parallel to the upper image display panel 131 to be thus able to increase a movement distance between the princess animation character and the prince animation character and to make movements of the animation characters more conspicuous.

As shown in FIG. 30, a lamp 322 comprised of an LED or the like is provided at the support member 324 for princess animation character. Similarly, a lamp 332 comprised of an LED or the like is provided at the support member 334 for prince animation character. Lighting up the lamp 322 enables illumination of a picture of a princess printed on the surface of the animation character member 320 provided at the support member 324. Similarly, Lighting up the lamp 332 enables illumination of a picture of a prince printed on the surface of the animation character member 330. In the top box game, brightly illuminating the princess and prince animation characters enables a player to explicitly visually recognize that a princess or prince animation character could be acquired in an animation character acquisition game.

As shown in FIG. 26, a lamp 342 comprised of an LED (Light Emitting Diode) is disposed at the back of the heart-shaped member 340. As described later, when it is determined that both of the princess and prince animation characters are acquired, the lamp 342 is lit up and then a roulette game including the heart-shaped member 340 is played.

<<Top Box Game Processing 1>>

Figure 31:
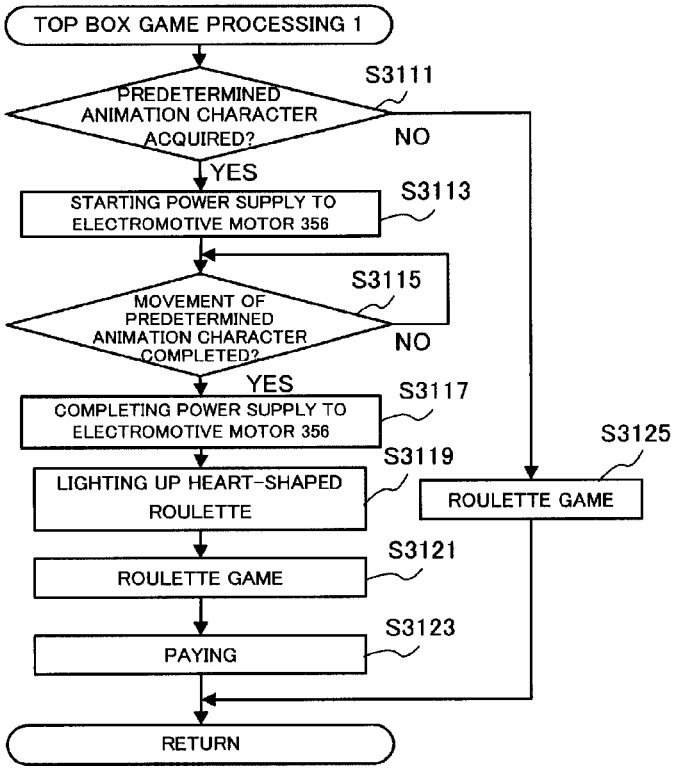
FIG. 31 is a flowchart showing a subroutine of top box game processing 1 employing the top box 12*a* of the first embodiment of the present invention.
Figure 32:
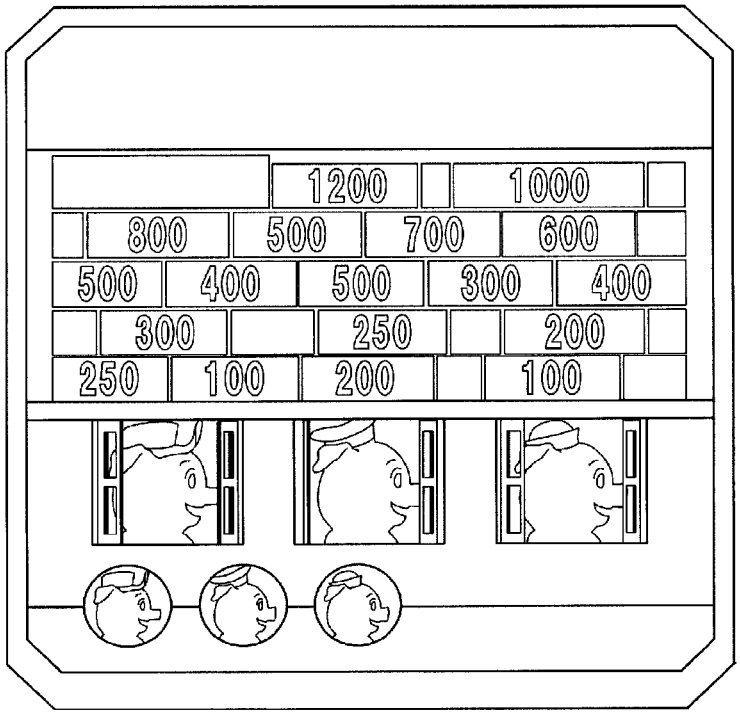
FIG. 32 is a front view showing an outline of a picture assigned to an upper image display panel 131 of a top box 12*b* of a second embodiment of the present invention.

FIG. 31 is a flowchart showing a subroutine of top box processing 1 employing the top box 12*a* of the first embodiment of the present invention. As described above, a subroutine of top box processing 1 is invoked and executed in processing of step S1921 of FIG. 19.

First, the main CPU 71 determines whether or not both of a princess animation character and a prince animation character are acquired in an animation character acquisition game by executing a subroutine of the animation character acquisition game processing shown in FIG. 19 (step S3111).

When the main CPU 71 determines that both of the princess animation character and the prince animation character are acquired in the animation character acquisition game (YES), a current is supplied (fed) to an electromotive motor 356 (step S3113). As described above, the electromotive motor 356 is coupled with a pulley 352*b* and rotational movement of the electromotive motor 356 is transmitted to the belt 354 winding at pulley 352*b* and then is driven. Movement of this belt 354 can cause the princess animation character and the prince animation character to move so as to approach each other or to be spaced from each other.

Next, it is determined whether or not the support member 324 for princess animation character and the support member 334 for prince animation character moves up to a predetermined position (final position) (step S3115). Specifically, while a sensor such as an optical sensor (not shown) is provided near the support member 324 or the support member 334, when the support member 324 or the support member 334 are located at a predetermined position (final position), a presence signal generated from this sensor is detected. The determination processing of step S3115 is processing of determining whether or not the presence signal generated from the sensor is detected.

While the determination processing of step S3115 described above was determination employing the presence signal generated from the sensor, this processing may be determined by time. That is, while time when the processing of step S3113 is executed is defined as a reference time, an elapsed time from the reference time is measured and then whether or not the elapsed time exceeds a predetermined time may be determined. The predetermined time described above is a predetermined time and may be defined according to time required for the support member 324 for princess animation character and the support member 334 for prince animation character to move from a home position (initial position to a predetermined position (final position)).

When, in the determination processing of step S3115 described above, it is determined that the support members 324 and 334 of the princess and prince animation characters fail to move to a predetermined position (final position) (NO), the routine is reverted to step S3115. When it is determined that the support members 324 and 334 of the princess and prince animation characters move to a predetermined position (final position) (YES), a current is supplied (fed) to the electromotive motor 356 (step S3117).

A lamp 342 which is disposed at the back of a heart-shaped member 340 is lit up and then the heart-shaped member 340 is caused to appear in such a manner that a player can visually recognize the heart-shaped member 340 (step S3119). The heart-shaped member 340 is provided at a drive member such as a solenoid or a motor so as to be able to move. Typically, the heart-shaped member 340 is located at a position at which a player cannot visually recognize it and then in the processing of step S3119 the heart-shaped member 340 is moved at a position at which a player can visually recognize it, whereby the heart-shaped member 340 may be caused to appear. In the processing of step S3119 described above, the heart-shaped member 340 may be caused to appear in such a manner that a player can visually recognize it.

Next, a roulette game including the heart-shaped member 340 is played (step S3121). As described above, numeric values "300", "400", and "500" are printed on the upper image display panel 131 corresponding to a lamp box 310 for playing a princess roulette game or a prince roulette game. A numeric value "1000" indicating a payment of a roulette game is printed on a surface of the heart-shaped member 340. When both of the princess and prince animation characters could be acquired in an animation character acquisition game, a roulette game is played for determining any one of the payments "300", "400", "500", and "1000". When both of the princess and prince animation characters could be acquired in an animation character acquisition game, a roulette game including the payment "1000" is played. Therefore, there arises a possibility that a higher payment than the one in the princess or prince roulette game can be obtained, making it possible to impart a sense of tension or a sense of expectation to a player.

The roulette game executed in the step S3121 described above is played by executing the following processing. First, one of "300", "400", "500", and "1000" is determined by lottery processing. A payment determined by the lottery processing is paid to a player in processing of step S3123 to be described later. Next, lighting up and lighting out of a lamp corresponding to "300", "400", "500", or "1000" is sequentially repeated. Afterwards, when a predetermined time has elapsed, only a lamp corresponding to the payment determined by lottery processing is lit up.

Next, a payment of a result of the roulette game played in step S3121 is paid to a player (step S3123) and then the main CPU 71 completes this subroutine. As described above, the payment to be paid in the processing of step S3123 is a payment determined in the above-described lottery processing.

After top box game processing 1 has completed, it is preferable that the support members 324 and 334 for the princess and prince animation characters are moved to a home position (initial position) with a predetermined timing. Specifically, after top box game processing 1 has completed, when a predetermined time, for example, 30 seconds has elapsed, it is preferable that the support members 324 and 334 for the princess and prince animation characters are moved to a home position. The support members are thus moved to the home position, whereby when top box game processing 1 starts next, movements of the support members 324 and 334 for the princess and prince animation characters can be started immediately.

When, in the determination processing of step S3111 described above, it is determined that both of the princess and prince animation characters are not acquired in an animation character acquisition game (NO), a roulette game is played according to a type of the animation character which could be acquired in the animation character acquisition game (step S3125). Afterwards, this subroutine is completed.

In a case where the princess animation character is acquired in the animation character acquisition game, for example, a princess roulette game is played. In this case, one of the payments "300", "400", and "500" is paid out. Similarly, in a case where a prince animation character is acquired in the animation character game, a prince animation character game is played. In this case also, one of the payments "300", "400", and "500" is paid out. Further, if a dwarf is acquired, a dwarf roulette game is played. In this case also, one of the payments "100", "200", and "300" is paid out.

In a case where a plurality of animation characters are acquired in an animation character acquisition game, only a roulette game corresponding to any one animation character, for example, a roulette game including the highest payment may be executed. A roulette game may be played as to all of the animation characters which could be acquired in the animation character acquisition game. Where a roulette game is played as to all of the animation characters which could be acquired, a roulette game can be played a plurality of times and thus a possibility that more payment is paid can be increased.

Second Embodiment of the Present Invention

Configuration of Top Box of the Second Embodiment

FIG. 33 to FIG. 39 are views showing a configuration of a top box 12*b* of the second embodiment of the present invention. The animation characters appearing in effect caused by a top box game employing the top box 12*b* of the second embodiment of the present invention are "a piglet living in a straw house" "a piglet living in a wooden house", and "a piglet living in a brick house".

As described above, an appearance of the top box 12*b* of the second embodiment of the present invention is similar to that of the top box 12*a* of the first embodiment, as shown in FIG. 20.

Figure 33:
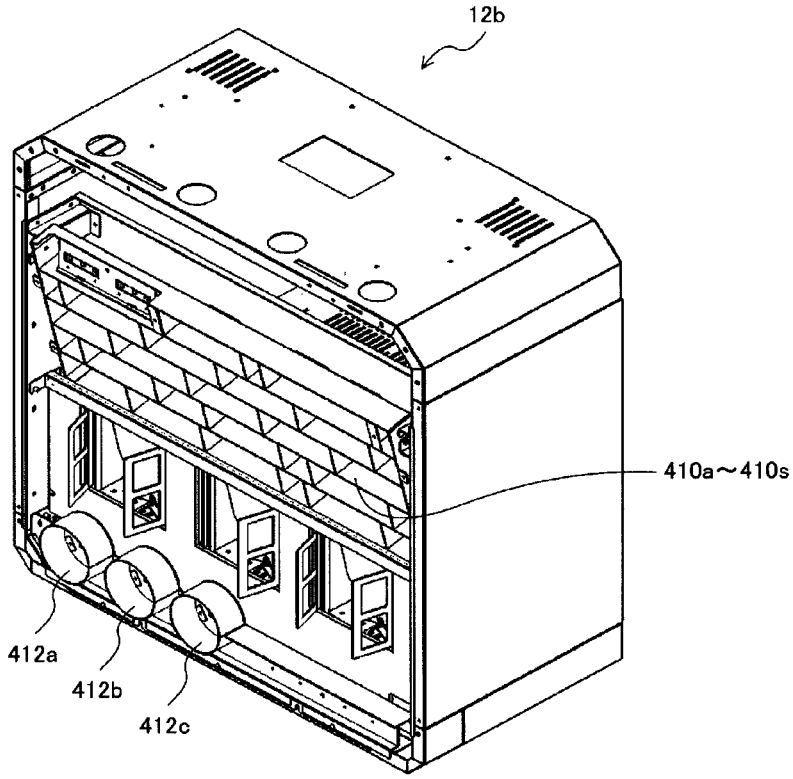
FIG. 33 is a perspective view showing an inside of the top box 12*b* in a state in which the upper image display panel 131 of the top box 12*b* is removed, according to the second embodiment of the present invention.
Figure 34:
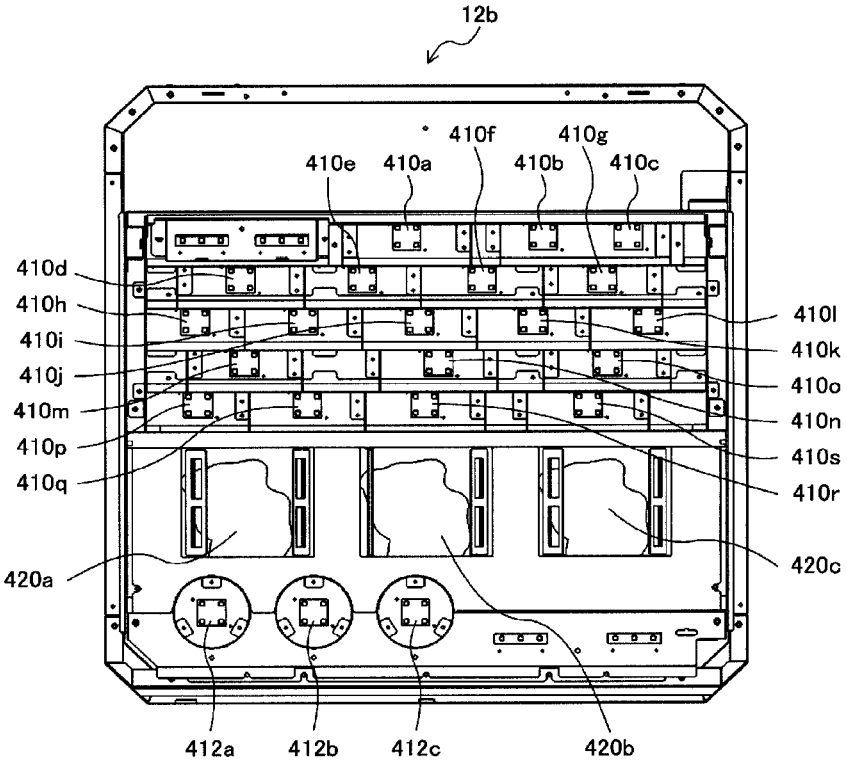
FIG. 34 is a front view showing an inside of the top box 12*b* in which the upper image display panel 131 of the top box 12*b* is removed.

FIG. 33 is a perspective view showing an inside of the top box 12*b* in a state in which the upper image display panel 131 of the top box 12*b* is removed. FIG. 34 is a front view showing an inside of the top box 12*b* in a state in which the upper image display panel 131 of the top box 12*b* is removed.

<Upper Image Display Panel 131>

The upper image display panel 131 is provided on a front face of the top box 12*b* as well. Like the first embodiment, a transparent portion and a nontransparent portion are formed on the upper image display panel 131. The transparent portion of the upper image display panel 131 is a portion for causing a player to visually recognize a member inside of the top box 12*a*. Therefore, it is sufficient if the transparent portion of the upper image display panel 131 can cause a player to visually recognize the inside of the top box 12*a*. The transparent portion does not need to be perfectly transparent and a pale color may be assigned as well.

<Lamp Boxes 410, 412*a* to 412*c*>

As shown in FIG. 33 and FIG. 34, lamp boxes 410*a* to 410*s* for playing a roulette game and lamp boxes 412*a* to 412*c* for indicating an animation character acquired by an animation character game are provided on a rear face of the upper image display panel 131. A roulette game is played by sequentially repeating lighting up and lighting out of a lamp on each of these lamp boxes 410*a* to 410*s*.

In a case where a piglet living in a straw house could be acquired by an animation character acquisition game, the lamp box 412*a* is lit up. Where a piglet living in a wooden house could be acquired by an animation character acquisition game, the lamp box 412*b* is lit up. Where a piglet living in a brick house could be acquired by an animation character acquisition game, the lamp box 412*c* is lit up.

Numerals indicating payments are printed on the upper image display panel 131 corresponding to each of the lamp boxes 410*a* to 410*s* described above. By playing a roulette game, one of the numerals indicating these payments is sequentially brightly illuminated and then the finally brightly illuminated numeric value is obtained as a payment awarded to a player. With this configuration, a roulette game can be played in a top box game.

<Animation Character Members 420*a* to 420*c*>

Figure 35:
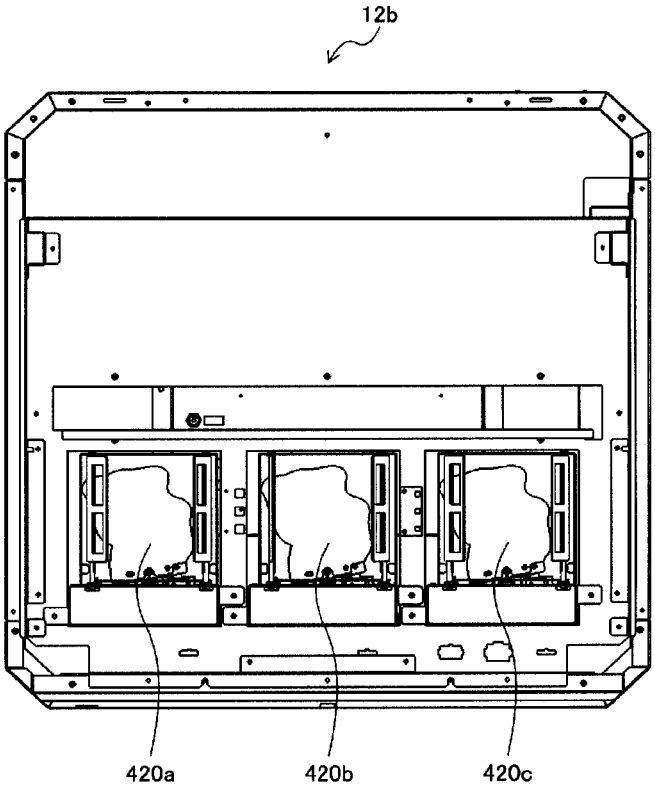
FIG. 35 is a front view showing an inside of the top box 12*b* in a sate in which lamp boxes 410*a* to 410*s* for playing a roulette game are removed.

FIG. 35 is a front view showing an inside of a top box 12*b* in a state in which lamp boxes 410*a* to 410*s* for playing a roulette game are removed. As shown in FIG. 33, FIG. 34, and FIG. 35, an animation character member 420*a* indicating a piglet living in a straw house, an animation character member 420*b* indicating a piglet living in a wooden house, and an animation character member 420*c* indicating a piglet living in a brick house are disposed inside of the top box 12*b*. The animation character member 420*a* indicating a piglet living in a straw house is disposed at the left side in frontal viewing; the animation character member 420*b* indicating a piglet living in a wooden house is disposed at the center in frontal viewing; and the animation character member 420*c* indicating a piglet living in a brick house is disposed at the right side in frontal viewing. A picture for indicating a piglet living in a straw house is preprinted on a surface of the animation character member 420*a*. A picture for indicating a piglet living in a wooden house is preprinted on a surface of the animation character member 420*b*. A picture for indicating a piglet living in a brick house is preprinted on a surface of the animation character member 420*c*.

Figure 36:
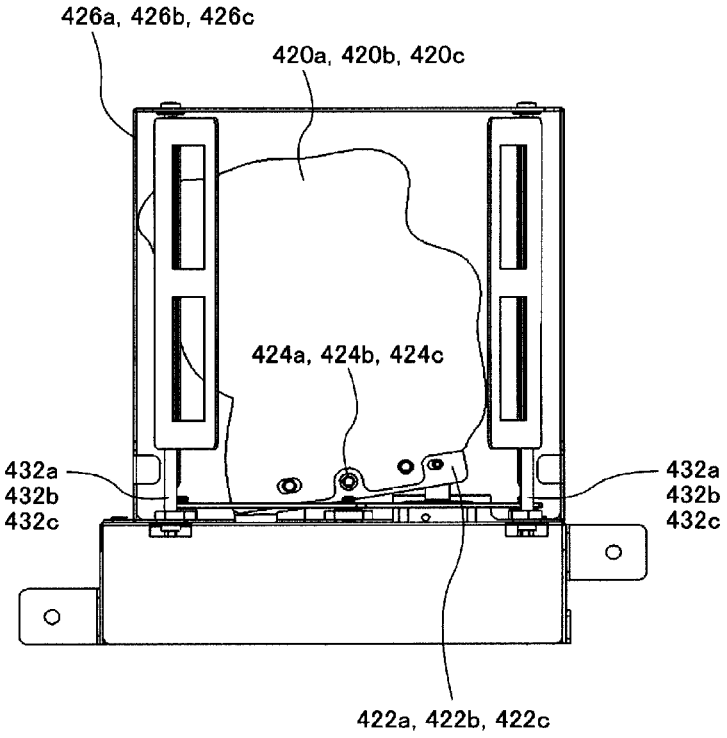
FIG. 36 is a front view showing animation character members 420*a* to 420*c* and window members 430*a* to 430*c;*
Figure 37:
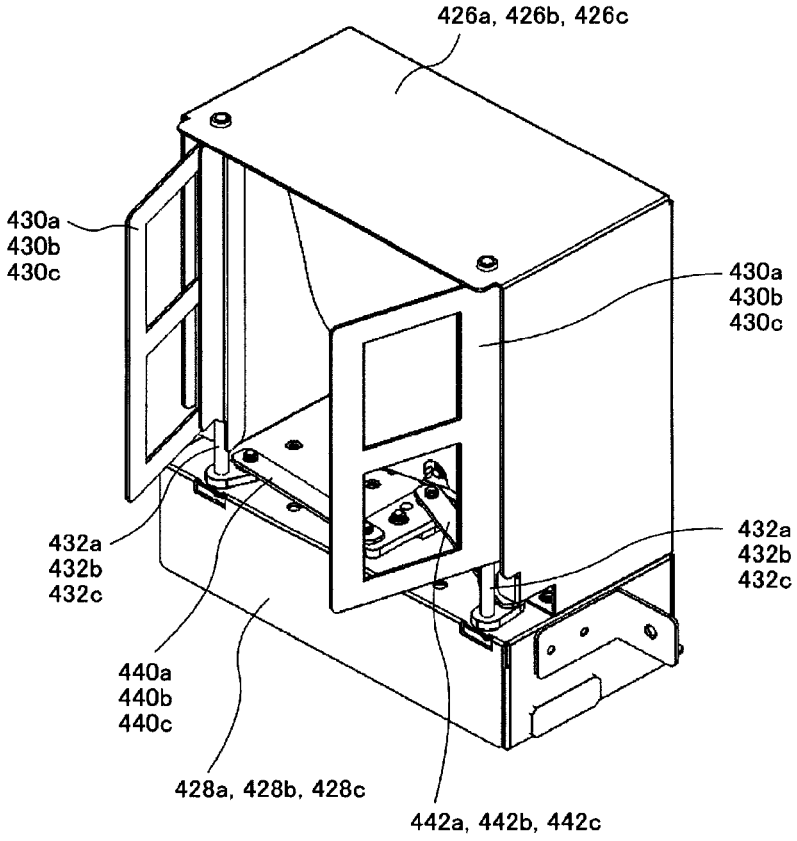
FIG. 37 is a perspective view showing the animation character members 420*a* to 420*c* and the window members 430*a* to 430*c;*
Figure 38:
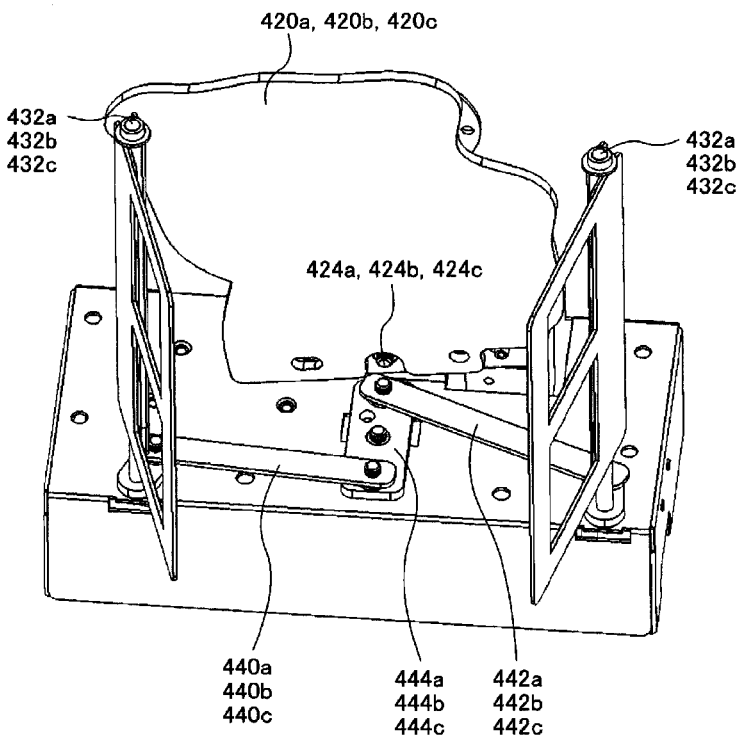
FIG. 38 is a perspective top view showing the animation character members 420*a* to 420*c* and the window members 430*a* to 430*c* in a state in which upper chassis 426*a* to 426*c* are removed.

FIG. 36 is a front view showing animation character members 420*a* to 420*c* and window members 430*a* to 430*c*. FIG. 37 is a perspective view showing animation character members 420*a* to 420*c* and window members 430*a* to 430*c*. FIG. 38 is a perspective top view showing animation character members 420*a* to 420*c* and window members 430*a* to 430*c* in a state in which upper chassis 426*a* to 426*c* are removed.

Figure 39:
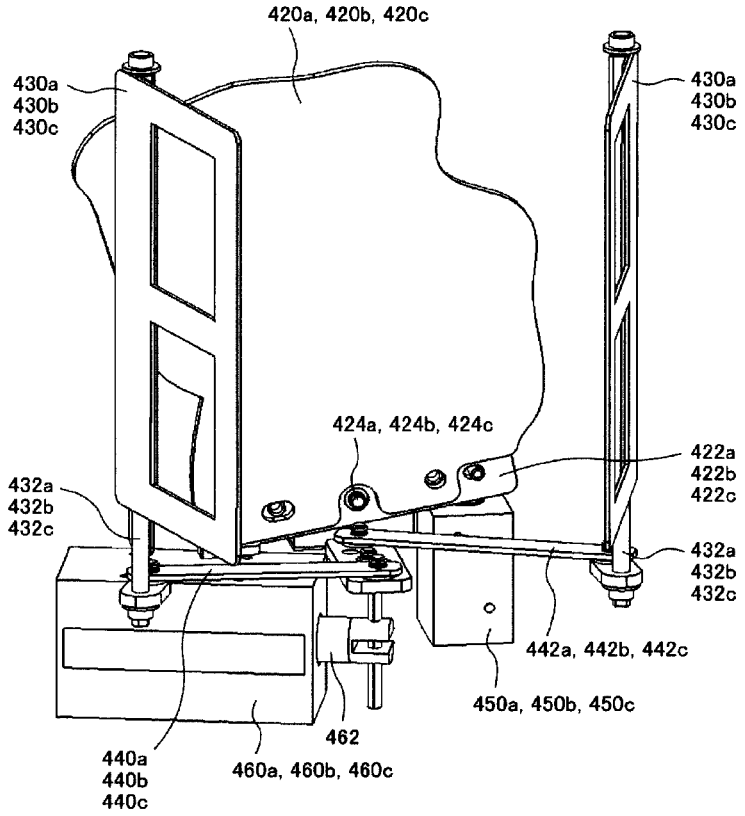
FIG. 39 is a perspective front view showing the animation character members 420*a* to 420*c* and the window members 430*a* to 430*c* in a state in which upper chassis 426*a* to 426*c* are removed.

As shown in FIG. 36, FIG. 38, and FIG. 39, a lower part of each of the animation character members 420*a* to 420*c* is coupled with each of the support members 422*a* to 422*c*. In the support member, rotary shaft parts 424*a* to 424*c* extending in a horizontal direction are provided at a substantial center. The rotary shaft parts 424*a* to 424*c* rotatably support the support members 422*a* to 422*c* in a transverse direction within a predetermined angle range. This configuration enables the animation character members 420*a* to 420*c* to be rotatably supported in a transverse direction within a predetermined angle range, enabling the animation character members 420*a* to 420*c* to be supported so as to swing in a transverse direction.

As shown in FIG. 39, the animation character member 420*a* is coupled with a drive member 450*a*, the animation character member 420*b* is coupled with a drive member 450*b*, and the animation character member 420*c* is coupled with a drive member 450*c*. The drive members 450*a* to 450*c* are formed of solenoids. A solenoid is made of a movable part which is movable in a vertical direction (not shown). An upper end part (not shown) of the movable part of the solenoid is coupled with a lower part at the right side of the support members 422*a* to 422*c* of the animation character members 420*a* to 420*c*. The movable part of the drive members 450*a* to 450*c* moves in a vertical direction at a predetermined distance, whereby the lower part at the right side of the support members 422*a* to 422*c* can be moved in a vertical direction and the animation character members 420*a* to 420*c* can be swung in a transverse direction within a predetermined angle range via the support members 422*a* to 422*c*. With this configuration, by driving the drive members 450*a* to 450*c*, piglets living in a straw house, a wooden house, and a brick house can be moved so as to swing in a transverse direction.

<Window Members 430*a* to 430*c*>

Two window members 430*a* are provided at the left and right of the animation character member 420*a* described above. Two window members 430*b* are provided at the left and right of the animation character member 420*b* described above. Two window members 430*c* are provided at the left and right of the animation character member 420*c* described above. The two window members 430*a* are members indicating a window of a straw house, the two window members 430*b* are members indicating a window of a wooden house, and the two window members 430*c* are members indicating a window of a brick house.

Each of the two window members 430*a* is rotatably supported by a rotary shaft 432*a*. Each of the two window members 430*b* is rotatably supported by a rotary shaft 432*b*. Each of the two window members 430*c* is rotatably supported by a rotary shaft 432*c*. A upper end part of the rotary shaft 432*a* is supported by a upper chassis 426*a*. A lower end part of the rotary shaft 432*a* is supported by a lower chassis 428*a*. An upper end part of the rotary shaft 432*b* is supported by a lower chassis 428*b*. An upper end part of the rotary shaft 432*c* is supported by an upper chassis 426*c*. A lower end part of the rotary shaft 432*c* is supported by a lower chassis 428*c*.

As shown in FIG. 38 and FIG. 39, a first end part of a coupling lever 440*a* is coupled with a lower part of a left-side window member 430*a* of the two window members 430*a*. A first end part of the coupling lever 442*a* is coupled with a lower part of the right-side window member 430*a* of the two window members 430*a*. A first end part of a coupling lever 440*b* is coupled with a lower part of a left-side window member 430*b* of the two window members 430*b*. A first end part of the coupling lever 442*b* is coupled with a lower part of the right-side window member 430*b* of the two window members 430*b*. A first end part of the coupling lever 440*a* is coupled with a lower part of a left-side window member 430*c* of the two window members 430*c*. A first end part of the coupling lever 442*a* is coupled with a lower part of the right-side window member 430*c* of the two window members 430*c*. Each of the coupling levers 440*a* to 440*c* and coupling levers 442*a* to 442*c* is formed in an elongated flat-plate shape.

Each of a second end part of the coupling lever 440*a* and a second end part of the coupling lever 442*a* is coupled with each of two end parts of a drive lever 444*a*. Each of a second end part of the coupling lever 440*b* and a second end part of the coupling lever 442*b* is coupled with each of two end parts of a drive lever 444*b*. Each of a second end part of the coupling lever 440*c* and a second end of the coupling lever 442*c* is coupled with each of two end parts of a drive lever 444*c*. Each of the drive levers 444*a* to 444*c* is formed in an elongated flat-plate shape. A center part of the drive lever 444*a* is rotatably supported by the lower chassis 428*a*. A center part of the drive lever 444*b* is rotatably supported by the lower chassis 428*b*. A center part of the drive lever 444*c* is rotatably supported by the lower chassis 428*c*.

The drive lever 444*a* is coupled with a drive member 460*a* provided at the lower chassis 428*a*, at a position displaced from the center part of the drive lever 444*a*. The drive lever 444*b* is coupled with the drive member 460*a* provided at the lower chassis 428*b*, at a position displaced from the center part of the drove member 444*b*. The drive lever 444*c* is coupled with the drive member 460*c* provided at the lower chassis 428*c*, at a position displaced from the center part of the drove member 444*c*.

As shown in FIG. 39, each of the drive members 460*a* to 460*c* is comprised of a solenoid. The drive member 460*a* has a movable part 462*a* which is movable in a transverse direction by the solenoid. The drive member 460*b* has a movable part 462*b* which is movable in a transverse direction by the solenoid. The drive member 460*c* has a movable part 462*c* which is movable in a transverse direction by the solenoid. The movable part 462*a* is coupled with a lower part of the drive lever 444*a*. The movable part 462*b* is coupled with a lower part of the drive lever 444*b*.

The movable part 462*a* reciprocally moves in a transverse direction by means of the solenoid of the drive member 460*a*, whereby the drive lever 444*a* can rotate in a forward direction and a backward direction within a predetermined angle range. Similarly, the movable part 462*b* reciprocally moves in a transverse direction by means of the solenoid of the drive member 460*b*, whereby the drive lever 444*b* can rotate in a forward direction and a backward direction within a predetermined angle range. The movable part 462*c* reciprocally moves in a transverse direction by means of the solenoid of the drive member 460*c*, whereby the drive lever 444*c* can rotate in a forward direction and a backward direction within a predetermined angle range.

The drive lever 444*a* rotates in a forward direction and a backward direction within a predetermined angle range, whereby the coupling levers 440*a* and 442*a* coupled with the drive lever 444*a* can reciprocally move in a transverse direction. The coupling levers 440*a* and 442*a* move in a direction opposite to each other. That is, when the coupling lever 440*a* moves in a rightward direction, the coupling lever 442*a* can move in a leftward direction. When the coupling lever 440*a* moves in a leftward direction, the coupling lever 442*a* can move in a rightward direction.

The drive lever 444*b* rotates in a forward direction and a backward direction within a predetermined angle range, whereby the coupling levers 440*b* and 442*b* coupled with the drive lever 444*b* can reciprocally move in a transverse direction. The coupling levers 440*b* and 442*b* move in a direction opposite to each other. That is, when the coupling lever 440*b* moves in a rightward direction, the coupling lever 442*b* can move in a leftward direction. When the coupling lever 440*b* moves in a leftward direction, the coupling lever 442*b* can move in a rightward direction.

The drive lever 444*c* rotates in a forward direction and a backward direction within a predetermined angle range, whereby the coupling levers 440*c* and 442*c* coupled with the drive lever 444*c* can reciprocally move in a transverse direction. The coupling levers 440*c* and 442*c* move in a direction opposite to each other. That is, when the coupling lever 440*c* moves in a rightward direction, the coupling lever 442*c* can move in a leftward direction. When the coupling lever 440*c* moves in a leftward direction, the coupling lever 442*c* can move in a rightward direction.

The movable parts 462*a* to 462*c* of the drive members 460*a* to 460*c* thus reciprocally moves in a transverse direction, whereby the coupling levers 440*a* to 440*c* and the coupling levers 442*a* to 442*c* can reciprocally move in a transverse direction to be interlocked with each other. As described above, a lower part of each of the window members 430*a* to 430*c* is coupled with a first end part of each of the coupling members 440*a* to 440*c*. The coupling levers 440*a* to 440*c* and the coupling levers 442*a* to 442*c* are reciprocally moved in a transverse direction to be interlocked with each other to thereby cause the window members 430*a* to 430*c* to rotate in a forward direction or in a backward direction within a predetermined angle range. The window members 430*a* to 430*c* can be thereby driven so as to open or close.

<<Top Box Game Processing 2>>

Figure 40:
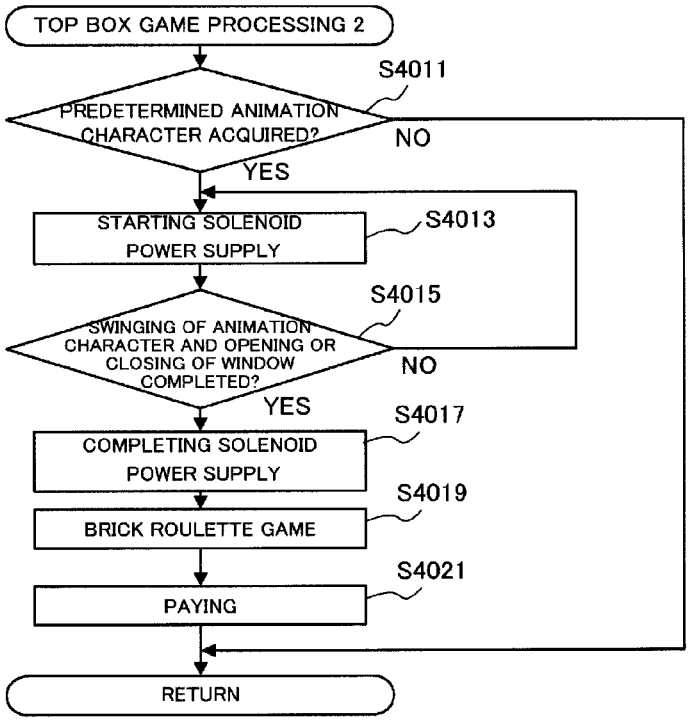
FIG. 40 is a flowchart showing a subroutine of top box game processing 2 employing the top box 12*b* of the second embodiment of the present invention.

FIG. 40 is a flowchart showing a subroutine of top box game processing 2 employing a top box 12*b* of the second embodiment of the present invention. As described above, the subroutine of top box processing 2 is invoked and executed in processing of step S1921 of FIG. 19.

First, the main CPU 71 executes the subroutine of the animation character acquisition game processing shown in FIG. 19 to thereby determine whether or not "a piglet living in a straw house", "a piglet living in a wooden house", and "a piglet living in a brick house" are acquired in an animation character game (step S4011).

When, in an animation character game, it is determined that "a piglet living in a straw house", "a piglet living in a wooden house", and "a piglet living in a brick house" are acquired (YES), a current is supplied (fed) to solenoids of the drive members 450*a* to 450*c* and solenoids of the drive members 460*a* to 460*c* (step S4013).

As described above, animation character members 420*a* to 420*c* are coupled with the solenoids of the drive members 450*a* to 450*c* via the support members 422*a* to 422*c*. A current is supplied to the solenoids of the drive members 450*a* to 450*c*. The animation character members 420*a* to 420*c* can be thereby swung in a transverse direction within a predetermined angle range. The piglets living in a straw house, a wooden house, and a brick house can also be thereby moved so as to swing in a transverse direction.

The window members 430*a* to 430*c* are coupled with the solenoids of the drive members 460*a* to 460*c* via the coupling levers 440*a* to 440*c*, the coupling levers 442*a* to 442*c*, and the drive levers 444*a* to 444*c*. A current is supplied to the solenoids of the drive members 460*a* to 460*c* and the window members 430*a* to 430*c* are rotated in a forward direction or a backward direction within a predetermined angle range. The window members 430*a* to 430*c* can be thereby driven so as to open or close.

Next, it is determined whether or not swinging of the animation character members 420*a* to 420*c* and opening or closing of the window members 430*a* to 430*c* are completed (step S4015). In the determination processing of step S4015, while when processing of step S4013 is executed is defined as a reference time, an elapsed time from the reference time is measured, whereby it may be determined whether or not the elapsed time exceeds a predetermined time.

When, in the determination processing of step S4015 described above, it is determined that swinging of the animation character members 420*a* to 420*c* and opening or closing of the window members 430*a* to 430*c* are not completed (NO), the routine is reverted to step S4015. When it is determined that swinging of the animation character members 420*a* to 420*c* and opening or closing of the window members 430*a* to 430*c* are completed (YES), current supply (feed) to the solenoids of the drive members 450*a* to 450*c* and the solenoids of the drive members 460*a* to 460*c* is completed (step S4017).

Next, a roulette game employing bricks is played (step S4019). As described above, the roulette game employing bricks is played by sequentially repeating lighting up and lighting out of a lamp of each of the lamp boxes 410*a* to 410*s* provided at a rear face of the upper image display panel 131. Numerals indicating payments are preprinted together with a brick picture on the upper image display panel 131 corresponding to each of the lamp boxes 410*a* to 410*s*. Playing a roulette game causes one of the numerals indicating these payments to be sequentially brightly illuminated, causing the finally brightly illuminated numeric value to be obtained as a payment to be awarded to a player. This construction enables a roulette game to be played in a top box game.

The roulette game to be executed in step S4019 described above is played by executing the following processing. First, a payment to be paid out to a player is determined by lottery processing. The payment determined by the lottery processing is paid to a player in processing of step S3121 to be described later. Next, lighting up and lighting out of the lamp boxes 410*a* to 410*s* is sequentially repeated. Afterwards, when a predetermined time has elapsed, only a lamp corresponding to the payment determined by lottery processing is lit up.

Next, a payment of a result of the roulette game played in step S4019 is paid to a player (step S4021) and then this subroutine is completed. As described above, the payment to be paid in the processing of step S3121 is a payment determined by the lottery processing described above.

When, in the determination processing of step S4011 described above, it is determined "a piglet living in a straw house", "a piglet living in a wooden house", and "a piglet in a brick house" are acquired in an animation character acquisition game (NO), this subroutine is completed.

Third Embodiment of the Present Invention

Configuration of Top Box of the Third Embodiment

FIG. 42 to FIG. 45 are views showing a configuration of a top box 12*c* of the third embodiment of the present invention. An animation character appearing in an effect caused by a top box game employing the top box 12*c* of the third embodiment of the present invention is a rose.

As described above, an appearance of the top box 12*c* of the third embodiment of the present invention, as shown in FIG. 20, is similar to that of the top box 12*a* of the first embodiment or the top box 12*b* of the second embodiment.

Figure 42:
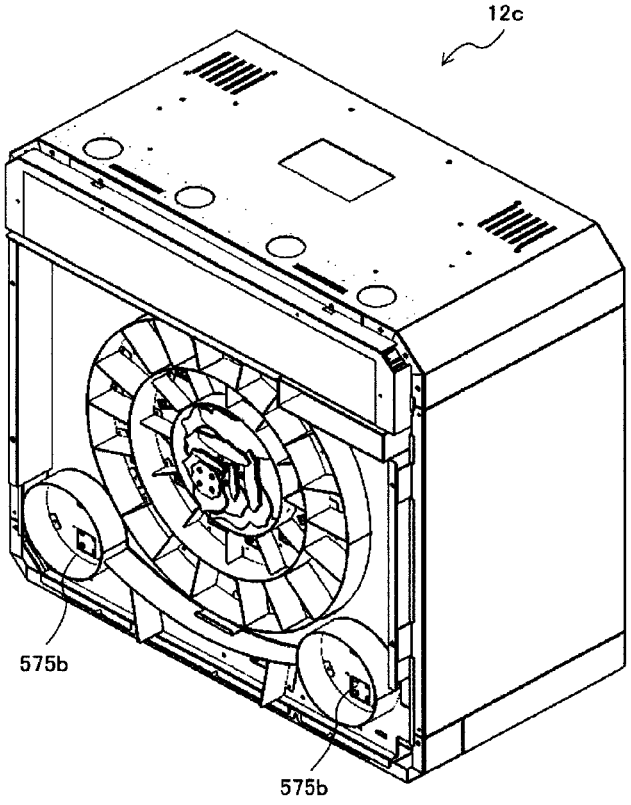
FIG. 42 is a perspective view showing an outline of a picture assigned to the upper image display panel 131 of the top box 12*c* of the third embodiment of the present invention.
Figure 43:
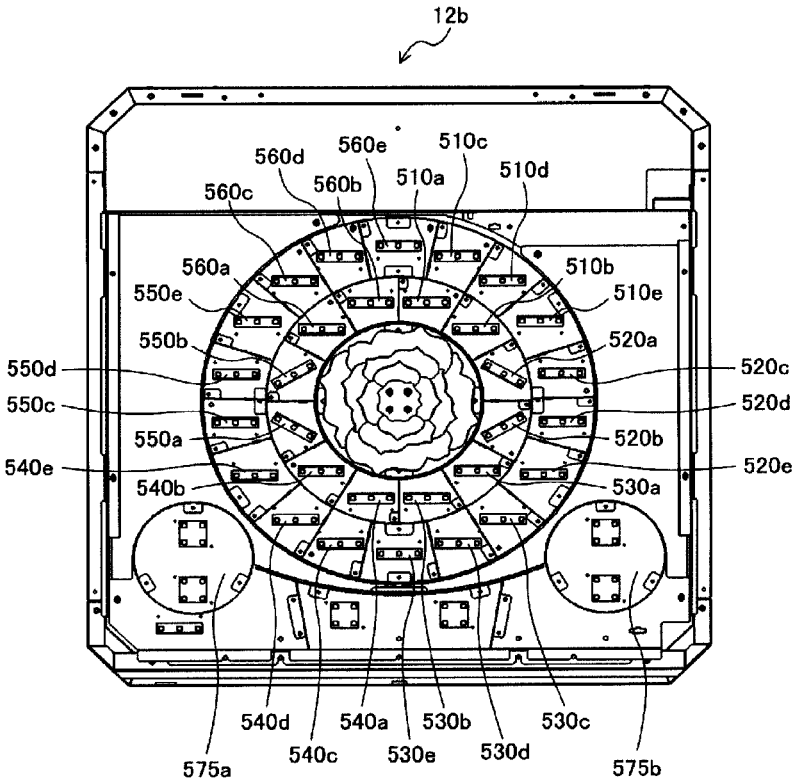
FIG. 43 is a front view showing an inside of the top box 12*c* in a state in which the upper image display panel 131 of the top box 12*c* is removed.
Figure 44:
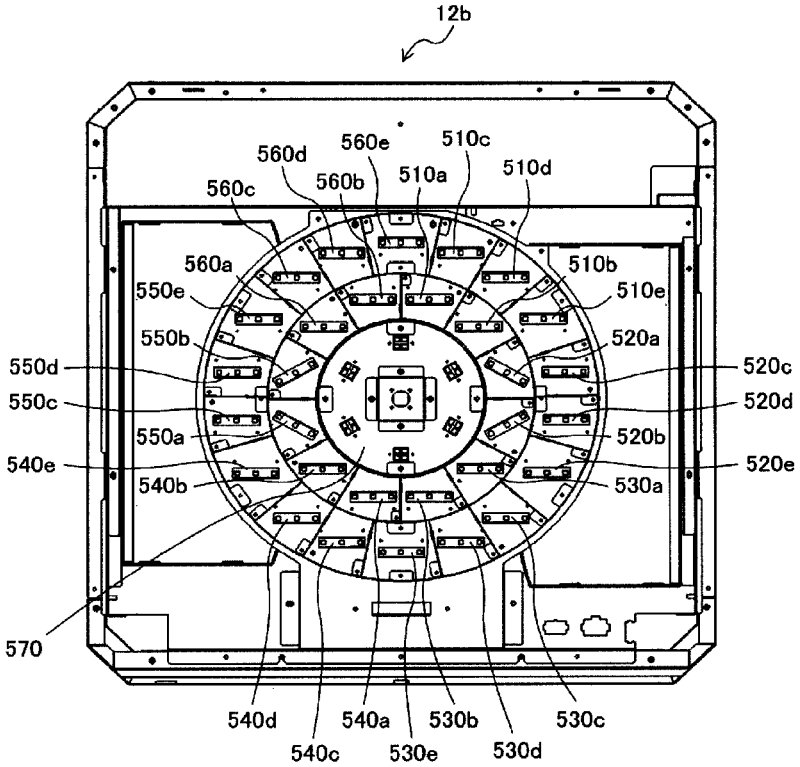
FIG. 44 is a front view showing an inside of the top box 12*c* in a sate in which a rose member 575 disposed at a substantial center is removed.

FIG. 42 is a perspective view showing an inside of the top box 12*c* in a state in which the upper image display panel 131 of the top box 12*c* is removed. FIG. 43 is a front view showing an inside of the top box 12*c* in a state in which the upper image display panel 131 of the top box 12*c* is removed. FIG. 44 is a front view showing an inside of the top box 12*c* in a state in which a rose member 575 disposed at a substantial center is removed.

<Upper Image Display Panel 131>

Figure 41:
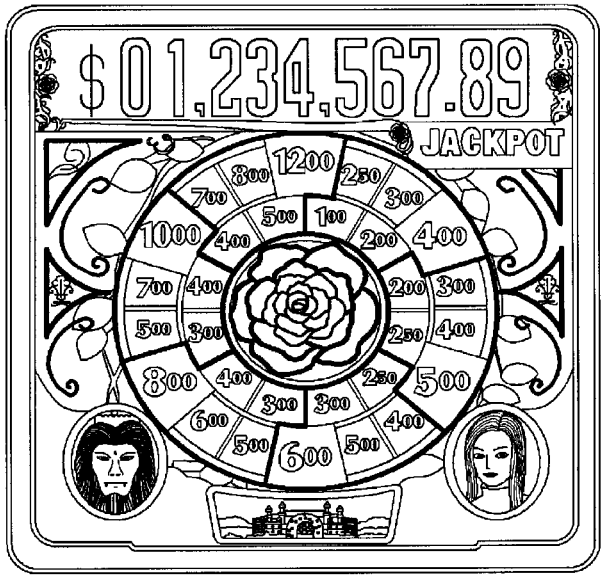
FIG. 41 is a front view showing an outline of a picture assigned to an upper image display panel 131 of a top box 12*c* of a third embodiment of the present invention.

An upper image display panel 131 is provided on a front face of the top box 12*c* as well. The upper image display panel 131 is formed of a transparent glass, plastics, or an acrylic and the like. A transparent portion and a nontransparent portion are formed on the upper image display panel 131. As shown in FIG. 41, numerals indicating payouts for playing a roulette game to be described later are printed on the nontransparent portion. The transparent portion is a portion for causing a player to visually recognize a rose member 575 disposed inside of the top box 12*c*. It is sufficient if the transparent portion of the upper image display panel 131 can cause a player to visually recognize the inside of the top box 12*c*. The transparent portion does not need to be perfectly transparent and may also be assigned with some degree of color.

<Lamp Boxes 510 to 560>

As shown in FIG. 42 and FIG. 43, five lamp boxes 510*a* to 510*e* for playing a roulette game, five lamp boxes 520*a* to 520*e*, five lamp boxes 530*a* to 530*e*, five lamp boxes 540*a* to 540*e*, five lamp boxes 550*a* to 550*e*, and five lamp boxes 560*a* to 560*e* are provided on a rear face of the upper image display panel 131.

The five lamp boxes 510*a* to 510*e* are disposed toward the upper image display panel 131. These lamp boxes are disposed to go around while being taken along a circumference having a first radius. The five lamp boxes 520*a* to 520*e* are disposed toward the upper image display panel 131. These lamp boxes are disposed to go around while being taken along a circumference having a first radius. The five lamp boxes 530*a* to 530*e* are disposed toward the upper image display panel 131. These lamp boxes are disposed to go around while being taken along a circumference having a first radius. The five lamp boxes 540*a* to 540*e* are disposed toward the upper image display panel 131. These lamp boxes are disposed to go around while being taken along a circumference having a first radius. The five lamp boxes 550*a* to 550*e* are disposed toward the upper image display panel 131. These lamp boxes are disposed to go around while being taken along a circumference having a first radius. The five lamp boxes 560*a* to 560*e* are disposed toward the upper image display panel 131. These lamp boxes are disposed to go around while being taken along a circumference having a first radius.

The lamp boxes 510*a* to 510*e* are referred to as a first lamp box group. The lamp boxes 520*a* to 520*e* are referred to as a second lamp box group. The lamp boxes 530*a* to 530*e* are referred to as a third lamp box group. The lamp boxes 540*a* to 540*e* are referred to as a fourth lamp box group. The lamp boxes 550*a* to 550*e* are referred to as a fifth lamp box group. The lamp boxes 560*a* to 560*e* are referred to as a sixth lamp box group. These first to sixth lamp box groups (a plurality of second light emitter groups) are disposed toward the upper image display panel 131. These groups are disposed to go around while being taken along a circumference having a second radius which is greater than the first radius.

Each of the lamp boxes 510*a* to 510*e* configuring the first lamp box group has a lamp which emits blue light. The lamp box 510*a* corresponds to a payment "100"; the lamp box 510*b* corresponds to a payment "200"; the lamp box 510*c* corresponds to a payment "250"; the lamp box 510*d* corresponds to a payment "300"; and the lamp box 510*e* corresponds to a payment "400" (see FIG. 41).

Each of the lamp boxes 520*a* to 520*e* configuring the second lamp box group has a lamp which emits pink light. The lamp box 520*a* corresponds to a payment "200"; the lamp box 520*b* corresponds to a payment "250"; the lamp box 520*c* corresponds to a payment "300"; the lamp box 520*d* corresponds to a payment "400"; and the lamp box 520*e* corresponds to a payment "500" (see FIG. 41).

Each of the lamp boxes 530*a* to 530*e* configuring the third lamp box group has a lamp which emits pale blue light. The lamp box 530*a* corresponds to a payment "250"; the lamp box 530*b* corresponds to a payment "300"; the lamp box 530*c* corresponds to a payment "400"; the lamp box 530*d* corresponds to a payment "500"; and the lamp box 530*e* corresponds to a payment "600" (see FIG. 41).

Each of the lamp boxes 540*a* to 540*e* configuring the fourth lamp box group has a lamp which emits green light. The lamp box 540*a* corresponding to a payment "300"; the lamp box 540*b* corresponds to a payment "400"; the lamp box 540*c* corresponds to a payment "500"; the lamp box 540*d* corresponds to a payment "600"; and the lamp box 540*e* corresponds to a payment "800" (see FIG. 41).

Each of the lamp boxes 550*a* to 550*e* configuring the fifth lamp box group has a lamp which emits white light. The lamp box 550*a* corresponding to a payment "300"; the lamp box 550*b* corresponds to a payment "400"; the lamp box 550*c* corresponds to a payment "500"; the lamp box 550*d* corresponds to a payment "700"; and the lamp box 550*e* corresponds to a payment "1000" (see FIG. 41).

Each of the lamp boxes 560*a* to 560*e* configuring the sixth lamp box group has a lamp which emits red light. The lamp box 560*a* corresponds to a payment "400"; the lamp box 560*b* corresponds to a payment "500"; the lamp box 560*c* corresponds to a payment "700"; the lamp box 560*d* corresponds to a payment "800"; and the lamp box 560*e* corresponds to a payment "1200" (see FIG. 41).

<Lamp Box 570>

A lamp box 570 is disposed at a center part of the top box 12*c*. As shown in FIG. 42, FIG. 43, and FIG. 44, a rose member 575 is disposed on a front face of the lamp box 570. The lamp box 570 illuminates the rose member 575 in a predetermined color. The lamp box 570 can selectively emit light in any one of blue, pink, pale blue, green, white, and red.

While a first roulette game to be described later is played, when blue light is emitted from the first lamp box group, blue light is emitted from the lamp box 570 as well. While the first roulette game is played, when pink light is emitted from the second lamp box group, pink light is emitted from the lamp box 570 as well. While in the play of the first roulette game, when pale blue light is emitted from the third lamp box group, pale blue light is emitted from the lamp box 570 as well. While the first roulette game is played, when green light is emitted from the fourth lamp box group, green light is emitted from the lamp box 570 as well. While the first roulette game is played, when white light is emitted from the fifth lamp box group, white light is emitted from the lamp box 570 as well. While the first roulette game is played, when red light is emitted from the sixth lamp box group, red light is emitted from the lamp box 570 as well.

When the first roulette game completes, light of a color according to a result of the first lottery processing is emitted from the lamp box 570. Specifically, one lamp box group is selected from among the first to sixth lamp box groups in accordance with the result of the first lottery processing. That is, one lamp box group is selected by the first lottery processing to be thus able to determine a color corresponding to such one lamp box group selected. Doing this enables light to be emitted from one lamp box group corresponding to one lamp box group selected. Doing this also enables the light of the determined color to be emitted from the lamp box 570 as well. Doing this further enables the light of a color identical to that of such one lamp box group selected, to be emitted from the lamp box 570.

In a case where the second lamp box group is selected by the first lottery processing, for example, when the first roulette game completes, pink light is emitted from the second lamp box group. Pink light is emitted from the lamp box 570 as well. Where the fourth lamp box group is selected by the first lottery processing, when the first roulette game completes, green light is emitted from the fourth lamp box group. Green light is emitted from the lamp box 570 as well.

The lamp box 570 emits light of a color determined by the first lottery processing and then illuminates the rose member 575 with the thus determined color. Where the fourth lamp box group is selected, for example, green light is emitted from the lamp box 570 and then the rose member 575 is illuminated with green light.

<First Roulette Game and Second Roulette Game>

Figure 47:
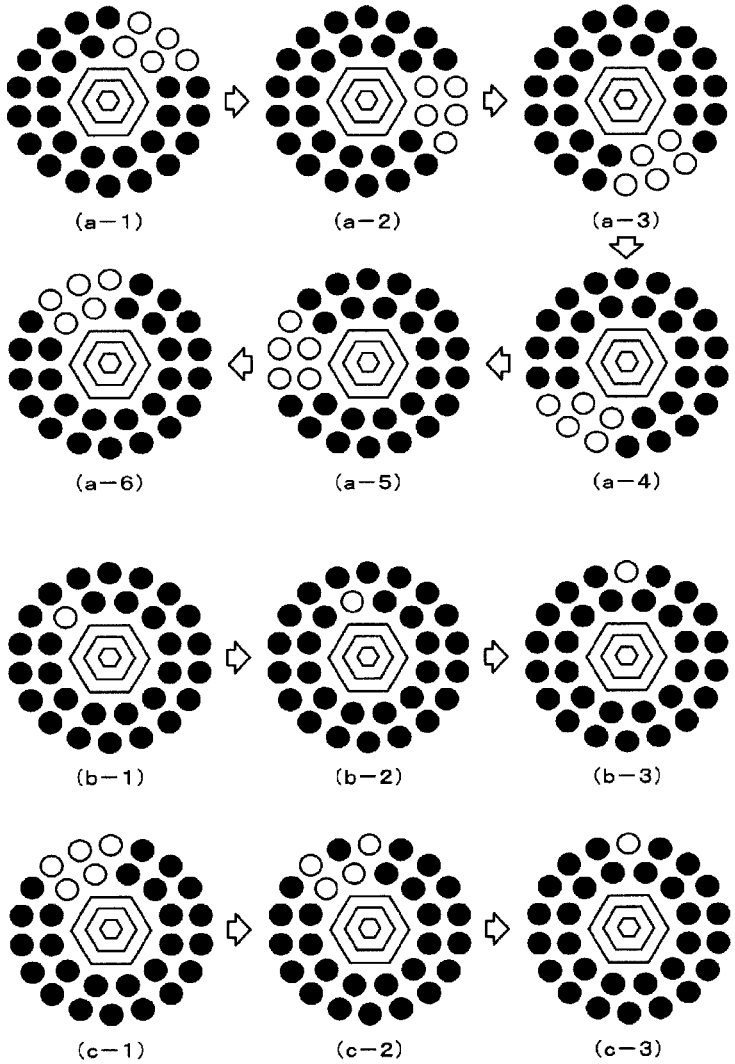
FIG. 47 is a schematic view showing a mode in which the lamp boxes 510*a* to 510*e*, 520*a* to 520*e*, 530*a* to 530*e*, 540*a* to 540*e*, 550*a* to 550*e*, and 560*a* to 560*e* and 570 in a first roulette game and a second roulette game light up and light out.

A first roulette game and a second roulette game are played by top box game processing 3 to be described later. FIGS. 47 (*a*-1) to (*a*-6) are views showing an outline of the first roulette game. FIGS. 47 (*b*-1) to (*b*-3) are views showing an outline of the second roulette game.

First, the first roulette game is played. The first roulette game is a roulette game to be played by employing all of the first to sixth lamp box groups. The first roulette game is select one lamp box group from among the first to sixth lamp box groups. As described above, the first lamp box group consists of lamp boxes 510*a* to 510*e*; the second lamp box group consists of lamp boxes 520*a* to 520*e*; the third lamp box group consists of lamp boxes 530*a* to 530*e*; the fourth lamp box group consists of lamp boxes 540*a* to 540*e*; the fifth lamp box group consists of lamp boxes 550*a* to 550*e*; and the sixth lamp box group consists of lamp boxes 560*a* to 560*e*. Playing the first roulette game enables a player to select one lamp box group from among the first to sixth lamp box groups.

First, only lamp boxes 510*a* to 510*e* configuring the first lamp box group are lit up and then other lamp box groups are lit out. This state is maintained until a predetermined time has elapsed (processing 1-1). Next, only lamp boxes 520*a* to 520*e* configuring the second lamp box group are lit up and then the other lamp box groups are lit out. This state is maintained until a predetermined time has elapsed (processing 1-2). Then, only lamp boxes 530*a* to 530*e* configuring the third lamp box group are lit up and then other lamp box groups are lit out. This state is maintained until a predetermined time has elapsed (processing 1-3). Further, only lamp boxes 540*a* to 540*e* configuring the fourth lamp box group are lit up and then other lamp box groups are lit out. This state is maintained until a predetermined time has elapsed (processing 1-4). Furthermore, only lamp boxes 550*a* to 550*e* configuring the fifth lamp box group are lit up and then other lamp box groups are lit out. This state is maintained until a predetermined time has elapsed (processing 1-5). Moreover, only lamp boxes 560*a* to 560*e* configuring the sixth lamp box group are lit up and then other lamp box groups are lit out. This state is maintained until a predetermined time has elapsed (processing 1-6).

The first roulette game is played by repeating (processing 1-1) to (processing 1-6) described above (see FIGS. 47 (*a*-1) to (*a*-6)). In the first roulette game, lighting up and lighting out are repeated so as to go around in accordance with the abovementioned circumference having a second radius which is greater than a first radius to be thus able to make lighting up and lighting out conspicuous. First lottery processing is conducted and then according to a result of the processing, one lamp box group is selected from among the first to sixth lamp box groups. Only one lamp box group selected is lit up and other lamp box groups are lit out and then the first roulette game is completed.

As described above, while the first roulette game is played or when the first roulette game completes, light of a corresponding color is emitted from a lamp box 570 as well and then a rose member 575 is illuminated with the corresponding color.

Next, the second roulette game is played. The second roulette game is a roulette game employing only one lamp box group selected in the first roulette game. Each of the first to sixth lamp boxes is comprised of five lamp boxes. Therefore, the lamp boxes configuring one lamp box group selected are hereinafter referred to the first to fifth lamp boxes.

First, only the first lamp box configuring one lamp box group selected is lit up and then other lamp boxes are lit out. This state is maintained until a predetermined time has elapsed (processing 2-1). Next, only the second lamp box configuring one lamp box group selected is lit up and then other lamp boxes are lit out. This state is maintained until a predetermined time has elapsed (processing 2-2). Afterwards, only the third lamp box configuring one lamp box group selected is lit up and then other lamp boxes are lit out. This state is maintained until a predetermined time has elapsed (processing 2-3). Further, only the fourth lamp box configuring one lamp box group selected is lit up and then other lamp boxes are lit out. This state is maintained until a predetermined time has elapsed (processing 2-4). Furthermore, only the fifth lamp box configuring one lamp box group selected is lit up and then other lamp boxes are lit out. This state is maintained until a predetermined time has elapsed (processing 2-5).

The second roulette game is played by repeating (processing 2-1) to (processing 2-5) described above (see FIGS. 47 (*b*-1) to (*b*-3)). In the second roulette game, lighting up and lighting out are repeated so as to go around in accordance with the first radius which is smaller than the second radius described above. Thus, lighting up and lighting out can be performed in a predetermined limited range and a player can enhance a sense of expectation or a sense of tension. The second lottery processing is played and then according to a result of the processing, one lamp box is selected from among the first to fifth lamp boxes. Afterwards, only one lamp box selected is lit up and other lamp boxes are lit out and then the second roulette game is completed.

Playing two roulette games in this way enables final determination of one payment awarded to a player.

<Light Guides 580*a* and 580*b*>

Figure 45:
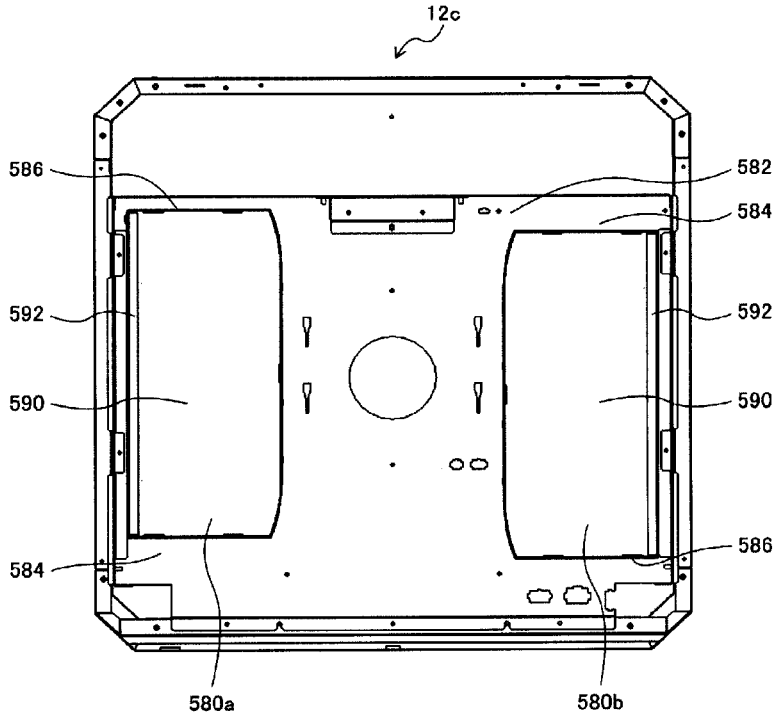
FIG. 45 is a front view showing an inside of the top box 12*c* in a state in which lamp boxes 510*a* to 510*e*, 520*a* to 520*e*, 530*a* to 530*e*, 540*a* to 540*e*, 550*a* to 550*e*, and 560*a* to 560*e* are removed.

FIG. 45 is a front view showing an inside of a top box 12*c* in a state in which lamp boxes 510*a* to 510*e*, 520*a* to 520*e*, 530*a* to 530*e*, 540*a* to 540*e*, 550*a* to 550*e*, and 560*a* to 560*e* are removed.

As shown in FIG. 45, two light guides 580*a* and 580*b* are provided at the left and right inside of the top box 12*c*. The light guide 580*a* is disposed on a rear face so as to correspond to the left side of a nontransparent portion of the upper image display panel 131. The light guide 580*b* is disposed on a rear face so as to correspond to the right side of the nontransparent portion of the upper image display panel 131. As shown in FIG. 45, two light guides 580*a* and 580*b* are provided on a backlight panel 582. The backlight panel 582 is formed in a substantially plate-like shape and then a panel face 584 is formed. The panel face 584 of the backlight panel 582 is fixed to the top box 12*c* so as to face the upper image display panel 131. Two light guides 580*a* and 580*b* are fixed to the panel face 584 by means of a predetermined support member (not shown) via a light guide case 586 to be described later so as to be substantially in parallel to the panel face 584.

Two back lights (not shown) are also disposed on the backlight panel 582. The light emitted from one backlight is made incident to the light guide 580*a*. The light emitted from the other backlight is made incident to the light guide 580*b*.

Each of the two light guides 580*a* and 580*b* is made of a light guide acrylic 590, a light guide reflector 592, and a light guide case 586. The light guide acrylic 590 is formed in a plate-like shape. The light guide reflector 592 is attached to an end part of the light guide acrylic 590. The light guide reflector 592 reflects the light emitted from the light guide acrylic 590 up to the end of the light guide acrylic 590 to be thereby able to make incident to the light guide acrylic 590. The light guide case 586 is for housing and disposing the light guide acrylic 590 at a predetermined position of the backlight panel 582.

Light is made incident with a predetermined face of the light guide acrylic 590 serving as a light incidence face and then the incident light is emitted from an emission face after reflection has been repeated inside of the light guide acrylic 590. The light thus made incident to the light guide acrylic 590 is emitted after being reflected inside of the light guide acrylic 590 a plurality of times. Thus, light of which brightness is approximately uniform relative to each site of the emission face can be emitted from the emission face and the light of which brightness is free of non-uniformity can also be emitted from the emission face. Two light guides 580*a* and 580*b* are disposed so that the emission face of the light guide acrylic 590 (light guides 580*a* and 580*b*) is opposite to the nontransparent portion of the upper image display panel 131. Doing this enables the nontransparent portion of the upper image display panel 131 to be illuminated with approximately uniform brightness, enabling the nontransparent portion to be brightened uniformly.

As described above, light is emitted from the emission face of the light guide acrylic 590 and then the nontransparent portion of the upper image display panel 131 is illuminated. Therefore, the positions or size of two backlights or the number of backlights, or alternatively, the positions or the like of two light guides 580*a* and 580*b* relative to two backlights, may be appropriately determined for the light guide acrylic 590 to make light incident so as to able to emit light from the emission face of the light guide acrylic 590.

As described above, the light guide case 586 houses the light guide acrylic 590. As shown in FIG. 45, a retaining wall and a retaining face for retaining the light guide acrylic 590 are formed at the light guide case 586 along the periphery of the light guide case 586. An opening (not shown) for making the light emitted from backlight incident to the light guide acrylic 590 is formed on the retaining wall or retaining face. The backlight is disposed so as to correspond to this opening. The light emitted from the backlight via this opening can be made incident to the light guide acrylic 590. Further, a reflection member (not shown) is provided inside of the retaining wall and the retaining face. Even if the light made incident to the light guide acrylic 590 is emitted from another face which is different from the emission face, the emitted light is reflected to be thereby able to make incident to the light guide acrylic 590 again and then the light can be efficiently emitted from the emission face.

The emission face of the light guide acrylic 590 is disposed by means of the backlight panel 582 so as to be spaced at a predetermined distance, 40 mm or more for example, from the rear face of the upper image display panel 131. The light emitted from the emission face of the light guide acrylic 590 travels in a radial manner so as to broaden at a variety of angles. Thus, even if members such as a cables are unavoidably disposed between the emission face and the rear face of the upper image display panel 131, they can be caused to reach the rear face of the upper image display panel 131 through a variously angled passageway in accordance with the light traveling in a radial manner from the light guide acrylic 590. Therefore, the nontransparent portion of the upper image display panel 131 can be illuminated without the light being interrupted by the members such as cables.

<Lamp Boxes 575*a* and 575*b*>

As shown in FIG. 42 and FIG. 43, a lamp box 575*a* is disposed at the lower left of the top box 12*c*. A lamp box 575*b* is disposed at the lower right of the top box 12*c*. "A picture of "beast (prince)" is displayed on the upper image display panel 131 corresponding to the lamp box 575*a*. The picture of "beast (prince)" can be illuminated from behind by lighting up the lamp box 575*a*. A picture of "bell (princess)" is displayed on the upper image display panel 131 corresponding to the lamp box 575*b*. The picture of "bell (princess)" can be illuminated from behind by lighting up the lamp box 575*b*.

<<Top Box Game Processing 3>>

Figure 46:
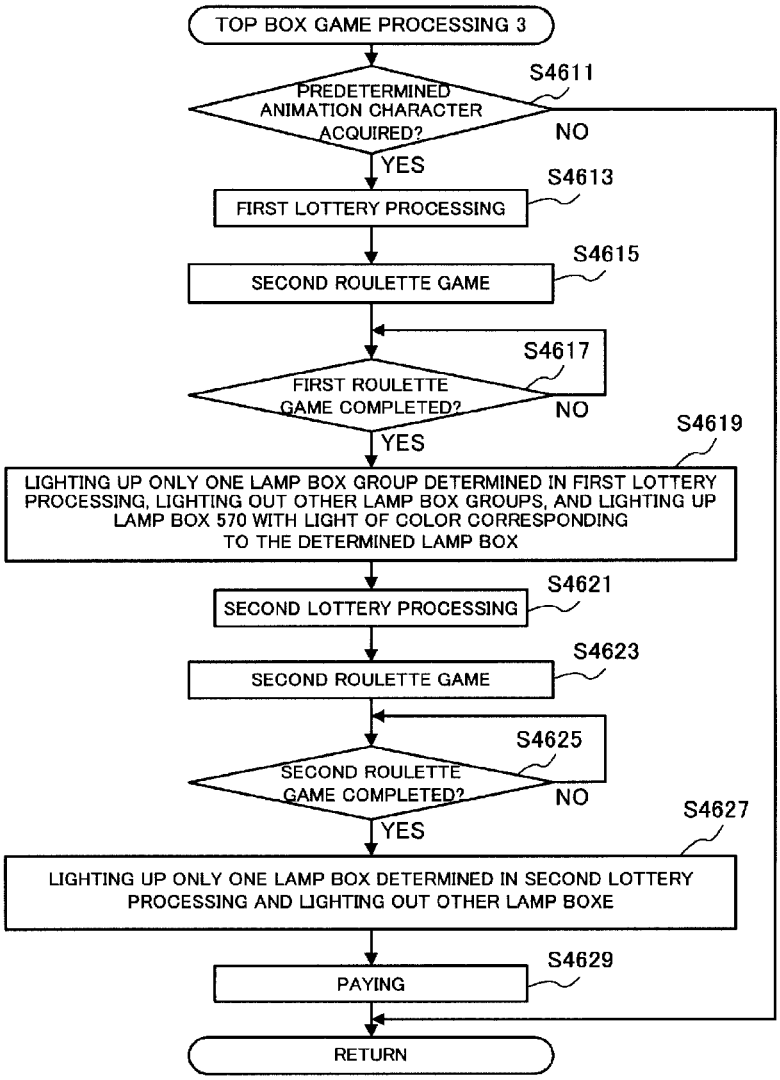
FIG. 46 is a flowchart showing a subroutine of top box game processing 3 employing the top box 12*c* of the third embodiment of the present invention.

FIG. 46 is a flowchart showing a subroutine of top box game processing 3 employing the top box 12*c* of the third embodiment of the present invention. As described above, a subroutine of top box game processing 3 is invoked and executed by processing of step S1921 of FIG. 19.

First, the main CPU 71 executes a subroutine of the animation character acquisition game processing shown in FIG. 19 to thereby determine whether or not "bell (princess)", "beast (prince)", and "palace" animation characters are acquired in an animation character acquisition game (step S4611). When the main CPU 71 determines that the "bell (princess)", "beast (prince)", and "palace" animation characters are not acquired in the animation character acquisition game (NO), this subroutine is completed immediately.

When the main CPU 71 determines that the "bell (princess) ", "beast (prince)", and "palace" animation characters are acquired in the animation character acquisition game (YES), the first lottery processing is executed (step S461). The first lottery processing is processing of generating random numbers and then depending upon values of the random numbers, determining one lamp box group from among the first to sixth lamp box groups. A ROM 52 of a motherboard 70 stores determination table (not shown) for determining the values of the random numbers. Comparing the values of the generated random numbers with the determination table can determine one lamp box group.

A first roulette game is played after processing of step S4613 has been executed (step S4615). In the first roulette game, processing 1-1 to processing 1-6 described above are repeated until determination in step S4617 to be described later has been made.

In processing 1-1, the lamp box 570 is lit up in blue which is identical to the color blue lamp boxes 510*a* to 510*e*. In processing 1-2, the lamp box 570 is lit up in pink which is identical to the color of pink lamp boxes 520*a* to 520*e*. In processing 1-3, the lamp box 570 is lit up in pale blue which is identical to the color of pale blue lamp boxes 530*a* to 530*e*. In processing 1-4, the lamp box 570 is lit up in glean which is identical to the color of green lamp boxes 540*a* to 540*e*. In processing 1-5, the lamp box 570 is lit up in white which is identical to the color of white lamp boxes 550*a* to 550*e*. In processing 1-6, the lamp box 570 is lit up in red which is identical to the color of red lamp boxes 560*a* to 560*e*.

As described above, payments of the blue lamp boxes 510*a* to 510*e* are "100", "200", "250", "300", and "400" which are the lowest numeric values of payments in groups. Payments of the pink lamp boxes 520*a* to 520*e* are "200", "250", "350", "400", and "500" which are the second lowest numeric values of payments in groups. Payments of the pale blue lamp boxes 530*a* to 530*e* are "250", "300", "400", "500" and "600" which are the third lowest numeric values of payments in groups. Payments of the green lamp boxes 540*a* to 540*e* are "300", "400", "500", "600" and "800" which are the fourth lowest numeric values of payments in groups. Payments of the white lamp boxes 550*a* to 550*e* are "300", "400", "500", "700" and "1000" which are the fourth lowest numeric values of payments in groups. Payments of the red lamp boxes 560*a* to 560*e* are "400", "500", "700", "800" and "1200" which are the highest numeric values of payments in groups. Therefore, a player visually recognizes a light-emitted color, thereby making it possible to immediately recognize a group of which payment is high or low.

In particular, as described above, in processing 1-1, only blue light is emitted; in processing 1-2, only pink light is emitted; in processing 1-3, only pale blue light is emitted; in processing 1-4, only green light is emitted; in processing 1-5, only white light is emitted; and in processing 1-6, only red light is emitted. This enables a player to accurately and readily recognize a group of which payment is high or low. This also enables a sense of expectation and a sense of tension to be imparted to the player.

It is determined that a predetermined time has elapsed after processing of step S4615 has been started and then it is determined whether or not the first roulette game is completed (step S4617). When it is determined that the first roulette game is not completed (NO), the routine is reverted to step S4617. When it is determined that the first roulette game is completed (YES), a lamp box group is lit up as the one determined in the first lottery processing executed in the processing of step S4613 described above and then other lamp box groups is lit out. In addition, the lamp box 570 is lit with light of a color corresponding to that lamp box and then the first roulette game is completed (step S4619).

When the fourth lamp box group is selected by the first lottery processing, for example, only the lamp boxes 540*a* to 540*e* configuring the fourth lamp box group are lit up and then the lamp boxes configuring other lamp box groups are lit out. Doing this makes it possible to indicate that the fourth lamp box group has won in the first roulette game. At the same time, the green light corresponding to the selected fourth lamp box group is emitted from the lamp box 570.

Next, the second lottery processing is executed (step 4621). The second lottery processing is processing of generating random numbers and then according to values of the random numbers, determining one lamp box from the first to fifth lamp boxes. As described above, each of the first to sixth lamp box groups is comprised of five lamp boxes and the lamp boxes configuring one lamp box group selected by the first lottery processing are referred to as the first to fifth lamp boxes.

Specifically, when the blue lamp box 510*a* to 510*e* are selected as the result of the first lottery processing, the first lamp box serves as the lamp box 510*a*; the second lamp box serves as the lamp box 510*b*; the third lamp box serves as the lamp box 510*c*; the fourth lamp box serves as the lamp box 510*d*; and the fifth lamp box serves as the lamp box 510*e*.

In addition, when the pink lamp box 520*a* to 520*e* are selected as the result of the first lottery processing, the first lamp box serves as the lamp box 520*a*; the second lamp box serves as the lamp box 520*b*; the third lamp box serves as the lamp box 520*c*; the fourth lamp box serves as the lamp box 520*d*; and the fifth lamp box serves as the lamp box 520*e*.

Further, when the pale blue lamp box 530*a* to 530*e* are selected as the result of the first lottery processing, the first lamp box serves as the lamp box 530*a*; the second lamp box serves as the lamp box 530*b*; the third lamp box serves as the lamp box serves as the lamp box 530*c*; the fourth lamp box serves as the lamp box 530*d*; and the fifth lamp box serves as the lamp box 530*e*.

Furthermore, when the green lamp box 540*a* to 540*e* are selected as the result of the first lottery processing, the first lamp box serves as the lamp box 540*a*; the second lamp box serves as the lamp box 540*b*; the third lamp box serves as the lamp box serves as the lamp box 540*c*; the fourth lamp box serves as the lamp box 540*d*; and the fifth lamp box serves as the lamp box 540*e*.

Moreover, when the white lamp box 550*a* to 550*e* are selected as the result of the first lottery processing, the first lamp box serves as the lamp box 550*a*; the second lamp box serves as the lamp box 550*b*; the third lamp box serves as the lamp box 550*c*; the fourth lamp box serves as the lamp box 550*d*; and the fifth lamp box serves as the lamp box 550*e*.

Still furthermore, when the red lamp box 560*a* to 560*e* are selected as the result of the first lottery processing, the first lamp box serves as the lamp box 560*a*; the second lamp box serves as the lamp box 560*b*; the third lamp box serves as the lamp box serves as the lamp box 560*c*; the fourth lamp box serves as the lamp box 560*d*; and the fifth lamp box serves as the lamp box 560*e*.

After processing of step S4621 has been executed, a second roulette game is played (step S4623). In the second roulette game, processing 2-1 to processing 2-5 described above are repeated until determination of step S4625 to be described later has been made.

In a case where the red lamp boxes 560*a* to 560*e* are selected as the result of the first lottery processing, for example, the first lamp box serves as the lamp box 560*a*; the second lamp box serves as the lamp box 560*b*; the third lamp box serves as the lamp box 560*c*; the fourth lamp box serves as the lamp box 560*d*; and the fifth lamp box serves as the lamp box 560*e*. Therefore, in the second roulette game, action of lighting up the lamp boxes 560*a*, 560*b*, 560*c*, 560*d*, and 560*e* for a predetermined time and then lighting out them is repeated.

Next, it is determined that a predetermined time has elapsed after processing of step S4623 has been started and then it is determined whether or not the second roulette game is completed (step S4625). When it is determined that the second roulette game is not completed (NO), the routine is reverted to step S4625. When it is determined that the second roulette game is completed (YES), only lamp box is lit as the one determined in the second lottery processing determined in the processing of step S4621 described above and then other lamp boxes are lit out, and the second roulette game is completed (step S4627).

Next, a payment corresponding to the lamp box determined by the second roulette game is paid to a player (step S4629 and then this subroutine is completed.

When the red lamp boxes 560*a* to 560*e* are selected as the first lottery processing and then the lamp box 560*e* serving as the fifth lamp box is selected as the result of the second lottery processing, for example, only the lamp box 560*e* is lit up and then other lamp boxes 560*a* to 560*d* are lit out. Doing this, in the second roulette game, makes it possible to indicate that the lamp box 560*e* serving as the fifth lamp box has won, i.e., payment "1200" (see FIG. 41) has won.

While, in the above-described second roulette game, it was shown that action of lighting up the first lamp boxes, second lamp boxes, third lamp boxes, fourth lamp boxes, fifth lamp boxes, and sixth lamp boxes for a predetermined time and then lighting out them is repeated, action according to another mode may also be taken. An outline is shown in FIGS. 47 (*c*-1) to (*c*-3).

First, when the second roulette game is started, all of the first lamp boxes, second lamp boxes, third lamp boxes, fourth lamp boxes, and fifth lamp boxes are lit up. After a predetermined time has elapsed, any one of the lamp boxes which have not been selected as the result of the second lottery processing is then lit out. Further, after a predetermined time has elapsed, another one of the lamp boxes which have not been selected as the result of the second lottery processing is lit out. By repeating such action, finally, only the lamp selected as the result of the second lottery processing is lit up and other lamp boxes are light out and then the second roulette game is completed. Even if the second roulette game is played in such a manner, it is possible to show a payment to be finally awarded to a player. In a case where the lamp boxes which have not been selected as the result of the second lottery processing are sequentially lit out, lighting up and lighting out of the lamp boxes is never repeated. Thus, the lamp boxes which have not been selected as the result of the second lottery processing can be notified immediately and then the second roulette game can be completed within a short period of time.

<<Outline of Gaming Machine>>

A gaming machine 10 in the embodiment of the present invention has:

a symbol display device (a lower image display panel 141) which is capable of variably displaying and then rearranging a plurality of symbols;

a top box (a top box 12*a*) having an illumination target (an upper image display panel 131) which is disposed at an upper part of the symbol display device and disposed on a front face thereof and a plurality of visual recognition targets (such as animation character members 320 and 330) disposed inside thereof; and a controller (a main CPU 71) programmed to executing processing of:

(A) variably displaying and then rearranging the symbols on the symbol display device to thereby execute a normal game;

(B) executing an animation character acquisition game for acquiring a specific animation character from among a plurality of animation characters in accordance with specific symbols having been rearranged in the normal game; and (C) moving at least one specific visual recognition target of the plurality of visual recognition targets, based on a result of the animation character acquisition game.

This configuration enables a player to be given notice in accordance with a mode of moving a visual recognition target in a top box, based on a result of an animation character acquisition game. A sense of expectation or a sense of tension can be imparted to the player. It is also possible to attract the player to a game by utilizing the top box. The visual recognition target is moved in the top box disposed at an upper part of a gaming machine. The mode of the movement of the visual recognition target can be thus visually recognized even at a position spaced from the gaming machine.

Further, other persons around the gaming machine as well as the player can also enhance and hold interest for the gaming machine.

A gaming machine 10 in the embodiment of the present invention, wherein:

the plurality of visual recognition targets include animation character visual recognition targets (animation character members 320 and 330) formed so as to indicate the animation character;

the top box has drive means (a drive member 350) for moving the animation character visual recognition targets; and the processing of (C) includes processing of (D) sending to the drive means a control signal which is based on a result of the animation character acquisition game and then executing a predetermined action to the animation character acquisition targets.

This configuration causes "animation character visual recognition targets" to move. An effect caused by an animation character appearing in an animation character acquisition game is thus provided in a top box as well, thereby making it possible to attract a player and enhance the player's sense of expectation through the effect in the top box as well. In the top box disposed at the upper part of a gaming machine, a conspicuous effect of movement of the animation character target is provided, thus making it possible to attract interest of the persons around the gaming machine as well.

Further, a gaming machine 10 in the embodiment of the present invention, wherein:

the plurality of visual recognition targets include an object visual recognition target (a heart-shaped member 340) formed so as to indicate an object which is different from the animation character; and the processing of (C) includes processing of (E), subsequent to executing the processing of (D), displaying the object visual recognition target in a visually recognizable mode.

This configuration causes an object visual recognition target to be set from a visually unrecognizable state to a visually recognizable state. A changeful effect is thus provided in a top box to be able to further impart a sense of expectation or a sense of tension to a player, making it possible to attract the player more significantly.

What is claimed is:

1. A gaming machine, comprising:

a symbol display device which is capable of variably displaying and then rearranging a plurality of symbols;

a top box disposed at an upper part of the symbol display device and having an illumination target disposed on a front face and a plurality of visual recognition targets disposed therein; and a controller being programmed to execute processing of:

(A) variably displaying and then rearranging the symbols on the symbol display device to thereby execute a normal game;

(B) executing an animation character acquisition game for acquiring an animation character from among a plurality of animation characters when at least one specific symbol is rearranged in the normal game; and (C) moving at least one visual recognition target from among the plurality of visual recognition targets when a result of the animation character acquisition game includes at least one specific animation character, wherein the plurality of visual recognition targets include an animation character visual recognition target formed so as to indicate the animation character, the top box has a drive device for moving the animation character visual recognition target, and the processing of (C) includes processing of (D) sending to the drive device a control signal and then executing a predetermined action to the animation character visual recognition target when the result of the animation character acquisition game includes the at least one specific animation character, and wherein the plurality of visual recognition targets are not moved when the result of the animation character acquisition game does not include the specific animation character.

2. The gaming machine according to claim 1, wherein:

the plurality of visual recognition targets include an object visual recognition target formed so as to indicate an object which is different from the animation character; and the processing of (C) includes processing of (E), subsequent to executing the processing of (D), displaying the object visual recognition target in a visually recognizable mode.

3. The gaming machine according to claim 1, further comprising an input device which is capable of inputting an instruction related to a game by a player's operation, wherein:

the processing of (B) includes processing of (a), selecting an animation character from the plurality of animation characters by a player operating the input device; and the processing of (D) includes processing of (b), when the specific animation character is selected from among the plurality of animation characters in the processing of (a), sending to the drive device a control signal indicating that the specific animation character is selected and then executing a predetermined action to a character visual recognition target corresponding to the specific animation character.

4. The gaming machine according to claim 1, wherein:

the processing of (D) includes processing of (c), when the specific animation character is not selected from among the plurality of animation characters in the processing of (a), sending to the drive device a control signal indicating that a winning prize is awarded in lottery processing and then executing a predetermined action to an animation character visual recognition target corresponding to the specific animation character.

5. The gaming machine according to claim 1, wherein:

the top box has a coupling device for movably coupling a plurality of animation character visual recognition target with the drive device; and the processing of (D) includes processing of (d), when the control signal is sent to the drive device, moving each of the plurality of animation character visual recognition targets via the coupling device.

6. The gaming machine according to claim 5, wherein:

the coupling device has an annular coupling element;

the plurality of animation character visual recognition targets are provided at the coupling element; and the processing of (d) includes processing of (e) simultaneously moving the plurality of animation character visual recognition targets by means of the coupling device.

7. The gaming machine according to claim 1, wherein:

the plurality of visual recognition targets include an object visual recognition target formed so as to indicate an object which is different from the animation character;

the top box has a drive device for moving the object visual recognition target; and the processing of (C) includes processing of (f) sending to the drive device a control signal which is based on a result of the animation character acquisition game and then moving the object visual recognition target.

8. The gaming machine according to claim 5, wherein:

the processing of (d) includes processing of (g) rotating the object visual recognition target around an axis taken along a vertical direction by means of the coupling device.

* * * * *